US005541044A

United States Patent [19]

Yamamoto et al.

[11] Patent Number: 5,541,044

[45] Date of Patent: Jul. 30, 1996

[54] SILVER HALIDE COLOR PHOTOGRAPHIC MATERIAL

[75] Inventors: Mitsuru Yamamoto; Shigeo Hirano; Akira Ogawa; Kouichi Hanaki, all of Kanagawa, Japan

[73] Assignee: Fuji Photo Film Co., Ltd., Kanagawa, Japan

[21] Appl. No.: 152,871

[22] Filed: Nov. 16, 1993

Related U.S. Application Data

[63] Continuation of Ser. No. 852,982, Mar. 17, 1992, abandoned.

[30] Foreign Application Priority Data

Mar. 19, 1991 [JP] Japan ..... 3-078243

[51] Int. Cl.[6] ..... G03C 1/46

[52] U.S. Cl. ..... 430/505; 430/551; 430/557; 430/957

[58] Field of Search ..... 430/557, 957, 430/505, 551

[56] References Cited

U.S. PATENT DOCUMENTS

| | | | |
|---|---|---|---|
| 4,149,886 | 4/1979 | Tanaka et al. | 430/557 |
| 4,248,961 | 2/1981 | Hagen et al. | 430/381 |
| 4,579,816 | 4/1986 | Ohlschlager et al. | 430/544 |
| 5,021,331 | 6/1991 | Vetter et al. | 430/544 |
| 5,055,385 | 10/1991 | Slusarek et al. | 430/544 |
| 5,190,846 | 3/1993 | Yagihara et al. | 430/957 |
| 5,194,369 | 3/1993 | Mihayashi et al. | 430/557 |
| 5,210,012 | 5/1993 | Ono et al. | 430/957 |
| 5,213,958 | 5/1993 | Motoki et al. | 430/557 |

FOREIGN PATENT DOCUMENTS

| | | |
|---|---|---|
| 169458 | 1/1986 | European Pat. Off. . |
| 447920A1 | 9/1991 | European Pat. Off. . |
| 0447920 | 9/1991 | European Pat. Off. . |
| 447920 | 9/1991 | European Pat. Off. . |
| 1558452 | 2/1969 | France . |
| 64546 | 1/1989 | Japan . |
| 6472140 | 3/1989 | Japan . |
| 1204680 | 9/1970 | United Kingdom . |
| 1477410 | 6/1977 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch, LLP.

[57] ABSTRACT

The present invention relates to a silver halide color photographic material comprising a support having thereon at least one silver halide emulsion layer, wherein at least one layer of said photographic material contains at least one yellow coupler represented by the following general formulas (3) or (2):

(3)

(2)

as defined in the specification.

25 Claims, No Drawings

SILVER HALIDE COLOR PHOTOGRAPHIC MATERIAL

This application is a continuation of application Ser. No. 07/852,982 filed on Mar. 17, 1992, now abandoned.

FIELD OF THE INVENTION

The present invention relates to a silver halide color photographic material which is excellent in sharpness and storage stability.

BACKGROUND OF THE INVENTION

It is an important matter to develop a technique for improving image quality in the field of silver halide color photographic materials. Methods for obtaining high image quality with small formats have been developed one after another in recent years. However, it is believed that these methods still have problems. Moreover, it has been demanded to further improve these methods.

DIR compounds are conventionally used at present to improve sharpness, particularly edge effect. The DIR compounds which are conventionally used are DIR couplers which release imagewise a development inhibitor by the coupling reaction with the oxidation product of a color developing agent to form a developed dye.

However, when the DIR couplers are used, there is a problem that when the dye formed by the coupling reaction is different from a dye obtained by a main coupler, color turbidity is formed and this phenomenon is not preferred from the viewpoint of color reproducibility. To prevent this color turbidity from being formed, DIR couplers having a hue equal to the developed dye of each of the main yellow, magenta and cyan couplers must be developed, and DIR couplers of as many as three types of couplers must be developed, said DIR couplers having the optimum reactivity. Costs in the development and synthesis of these DIR couplers are increased. Thus, non-color forming DIR compounds have been demanded.

The non-color forming DIR compounds can be classified into two groups, that is, a coupling type and an oxidation-reduction type according to the reaction system with the oxidation products of color developing agents. The coupling type compounds include compounds described in JP-B-51-16141 (the term "JP-B" as used herein means an "examined Japanese patent publication"), JP-B-51-16142 and U.S. Pat. Nos. 4,226,943 and 4,171,223. The oxidation reduction type compounds include the DIR hydroquinone compounds described in U.S. Pat. Nos. 3,379,529 and 3,639,417, JP-A-49-129536 (the term "JP-A" as used herein means an "unexamined published Japanese patent application"), JP-A-64-546 and JP-A-2-21127 and DIR hydrazine compounds described in JP-A-61-213847, JP-A- 64-88451 and U.S. Pat. No. 4,684,604. It is preferred that a development inhibitor is released from the DIR compound in the first development stage when reversal color light-sensitive materials are processed in the processing stage including B/W development (first development) and color development (second development). This is because in the second development stage, it is intended to rapidly develop all of the silver halides which are not developed in the first development stage and hence the silver development rate is very quick. Accordingly, when a development inhibiting action is imagewise effected in the second development stage, silver development is retarded and processing in the color development becomes unstable. Hence, it is preferred that the DIR compounds are reacted in the first development stage. In this case, however, the oxidation-reduction type DIR compounds capable of reacting with the oxidation product of developing agents for B/W must be used.

When conventional yellow couplers are used in combination with the oxidation-reduction type DIR compounds, there are problems because improving the edge effect can scarcely be obtained and the performance of the light-sensitive materials is liable to be changed during storage under moist heat conditions.

SUMMARY OF THE INVENTION

Accordingly, an object of the present invention is to provide a color light-sensitive material which is excellent in sharpness.

Another object of the present invention is to provide a color light-sensitive material which is excellent in storage stability over a long period of time.

The above-described objects of the present invention have been achieved by providing a silver halide color photographic material comprising a support having thereon at least one silver halide emulsion layer, wherein at least one layer for forming said photographic material contains at least one yellow coupler represented by the following general formula (1) or (2) and at least one layer for forming said photographic material contains at least one member of the compounds represented by the following general formula (F):

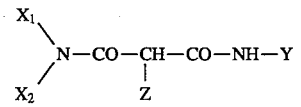

(1)

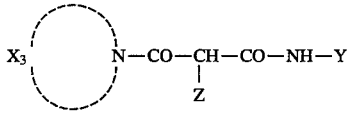

(2)

wherein $X_1$ and $X_2$ each represents an alkyl group, an aryl group or a heterocyclic group; $X_3$ represents an organic residue which forms a nitrogen-containing heterocyclic group together with >N—; Y represents an aryl group or a heterocyclic group; and Z represents a group which is released when the coupler of general formula (1) or (2) reacts with the oxidation product of a developing agent:

$$A\text{-}(L)_n\text{-}(G)_m\text{-}(Time)_t\text{-}X \qquad (F)$$

wherein A represents an oxidation-reduction (redox) mother nucleus or a precursor thereof and is an atomic group which enables $\text{-}(Time)_t X$ to be released only when it is oxidized during the course of photographic development; Time represents a group which releases X after $\text{-}(Time)_t X$ is released from the oxidation product of A; X represents a development inhibitor; L represents a divalent linking group; G represents a polarizable group; and n, m and t each represents 0 or 1.

DETAILED DESCRIPTION OF THE INVENTION

The couplers represented by general formulae (1) and (2) are illustrated in more detail below.

The alkyl group represented by $X_1$ and $X_2$ is a straight-chain, branched or cyclic, saturated or unsaturated, substituted or unsubstituted alkyl group having 1 to 30 carbon atoms, preferably 1 to 20 carbon atoms. Examples of the alkyl group include methyl, ethyl, propyl, butyl, cyclopropyl, allyl, t-octyl, i-butyl, dodecyl and 2-hexyldocyl.

The heterocyclic group represented by $X_1$ and $X_2$ is a 3- to 12-membered, preferably 5- or 6-membered, saturated or unsaturated substituted or unsubstituted, monocyclic or condensed ring heterocyclic group having 1 to 20 carbon atoms, preferably 1 to 10 carbon atoms and at least one hetero-atom of a nitrogen atom, an oxygen atom or a sulfur atom. Examples of the heterocyclic group include 3-pyrrolidinyl, 1,2,4-triazol-3-yl, 2-pyridyl, 4-pyrimidinyl, 3-pyrazolyl, 2-pyrrolyl, 2,4-dioxo- 1,3-imidazolidin-5-yl and pyranyl.

The aryl group represented by $X_1$ and $X_2$ is a substituted or unsubstituted aryl group having 6 to 20 carbon atoms, preferably 6 to 10 carbon atoms. Typical examples of the aryl group include phenyl and naphthyl.

The nitrogen-containing heterocyclic group represented by $X_3$ together with >N— is a 3- to 12-membered, preferably 5- or 6-membered, substituted or unsubstituted, saturated or unsaturated, monocyclic or condensed ring heterocyclic group having 1 to 20 carbon atoms, preferably 1 to 15 carbon atoms. The heterocyclic group may optionally have another heteroatom such as an oxygen atom or a sulfur atom in addition to the nitrogen atom. Examples of the heterocyclic group include pyrrolidino, piperidino, morpholino, 1-piperazinyl, 1-indolinyl, 1,2,3,4-tetrahydroquinolin-1-yl, 1-imidazolidinyl, 1-pyrazolyl, 3-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl and benzoxazine-4-yl.

When $X_1$ and $X_2$ each represents a substituted alkyl group, a substituted aryl group or a substituted heterocyclic group and, when $X_3$ represents a substituted nitrogen-containing heterocyclic group together with >N—, examples of substituent groups include a halogen atom (e.g., a fluorine atom and a chlorine atom) an alkoxycarbonyl group (e.g., having 2 to 30 carbon atoms, preferably 2 to 20 carbon atoms, such as methoxycarbonyl, dodecyloxycarbonyl, hexadecyloxycarbonyl), an acylamino group (e.g., having 2 to 30 atoms, preferably 2 to 20 carbon atoms, such as acetamido, tetradecaneamido, 2-(2,4-di-t-amylphenoxy)butaneamido, benzamido), a sulfonamido group (e.g., having 1 to 30 carbon preferably 1 to 20 carbon atoms, such as methaneatoms, sulfonamido, dodecanesulfonamido, hexadecylsulfonamido, benzenesulfonamido), a carbamoyl group (e.g., having 1 to 30 carbon atoms, preferably 1 to 20 carbon atoms, such as N-butylcarbamoyl, N,N-diethylcarbamoyl), an N-sulfonylcarbamoyl group (e.g., having 1 to 30 carbon atoms, preferably 1 to 20 carbon atoms, such as mesylcarbamoyl, N-dodecylsulfonylcarbamoyl), a sulfamoyl group (e.g., having 1 to 30 carbon atoms, preferably 1 to 20 carbon atoms, such as N-butylsulfamoyl, N-dodecylsulfamoyl, N-hexadecylsulfamoyl, N-3-(2,4-di-t-amylphenoxy)butylsulfamoyl, N,N-diethylsulfamoyl), an alkoxy group (e.g., having 1 to 30 carbon atoms, preferably 1 to 20 carbon atoms, such as methoxy, hexadecyloxy, isopropoxy), an aryloxy group (e.g., having 6 to 20 carbon atoms, preferably 6 to 10 carbon atoms, phenoxy, 4-methoxyphenoxy, 3-t-butyl-4-hydroxy-phenoxy, naphthoxy), an aryloxycarbonyl group (e.g., having 7 to 20 carbon atoms, preferably 7 to 11 carbon atoms, such as phenoxycarbonyl), an N-acylsulfamoyl group (e.g., having 2 to 30 carbon atoms, preferably 2 to 20 carbon atoms, such as N-propanoylsulfamoyl, N-tetradecanoylsulfamoyl), a sulfonyl group (e.g., having 1 to 30 carbon atoms, preferably 1 to 20 carbon atoms, such as methanesulfonyl, octanesulfonyl, 4-hydroxyphenylsulfonyl, dodecanesulfonyl), an alkoxycarbonylamino group (e.g., having 1 to 30 carbon atoms, preferably 1 to 20 carbon atoms, such as ethoxycarbonylamino), a cyano group, a nitro group, a carboxyl group, a hydroxyl group, a sulfo group, an alkylthio group (e.g., having 1 to 30 carbon atoms, preferably 1 to 20 carbon atoms, such as methylthio, dodecylthio, dodecylcarbamoylmethylthio), a ureido group (e.g., having 1 to 30 carbon atoms, preferably 1 to 20 carbon atoms, such as N-phenylureido, N-hexadecylureido), an aryl group (e.g., having 6 to 20 carbon atoms, preferably 6 to 10 carbon atoms, such as phenyl, naphthyl, 4-methyoxy-phenyl), a heterocyclic group (e.g., a 3- to 12-membered, preferably 5- or 6-membered, monocyclic or condensed ring having 1 to 20 carbon atoms, preferably 1 to 10 carbon atoms, and at least one heteroatom of a nitrogen atom, an oxygen atom and a sulfur atom, such as 2-pyridyl, 3-pyrazoyl, 1-pyrrolyl, 2,4-dioxo-1,3-imidazolidin-1-yl, 2-benzoxazolyl, morpholino, indolyl), an alkyl group (e.g., a straight-chain, branched or cyclic, saturated or unsaturated alkyl group having 1 to 30 carbon atoms, preferably 1 to 20 carbon atoms, such as methyl, ethyl, isopropyl, cyclopropyl, t-pentyl, t-octyl, cyclopentyl, t-butyl, s-butyl, dodecyl, 2-hexyldecyl), an acyl group (e.g., having 1 to 30 carbon atoms, preferably 2 to 20 carbon atoms, such as acetyl, benzoyl), an acyloxy group (e.g., having 2 to 30 carbon atoms, preferably 2 to 20 carbon atoms, such as propanoyloxy, tetradecanoyloxy), an arylthio group (e.g., having 6 to 20 carbon atoms, preferably 6 to 10 carbon atoms, such as phenylthio, naphthylthio), a sulfamoylamino group (e.g., having 0 to 30 atoms, preferably 0 to 20 carbon atoms, such as N-butylsulfamoylamino, N-dodecylsulfamoylamino, N-phenylsulfamoylamino) and an N-sulfonylsulfamoyl group (e.g., having 1 to 30 carbon atoms, preferably 1 to 20 carbon atoms, such as N-mesylsulfamoyl, N-ethanesulfonylsulfamoyl, N-dodecanesulfonylsulfamoyl, N-hexadecanesulfonylsulfamoyl). The above-described substituent groups may be further substituted. Examples of such substituent groups include those described above in the definition of the substituent groups for $X_1$ and $X_2$.

Among the above-described substituent groups, the preferred substituent groups include an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group and an aryl group.

The aryl group represented by Y in general formulae (1) and (2) is a substituted or unsubstituted aryl group having 6 to 20 carbon atoms, preferably 6 to 10 carbon atoms. Typical examples of the aryl group include a phenyl group and a naphthyl group.

When Y represents a substituted aryl group or a substituted heterocyclic group, examples of the substituent groups include those described above in the definition of the substituent groups for $X_1$.

When Y is a substituted group, preferably one of the substituent groups is a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

Particularly preferred is the case where Y is a phenyl group having at least one substituent group at the ortho-position.

The group represented by Z in general formulae (1) and (2) may be any of the conventional groups which are released on coupling. Preferred examples of Z include a nitrogen-containing heterocyclic group which is bonded to the coupling site through a nitrogen atom, an aryloxy group, an arylthio group, a heterocyclic oxy group, a heterocyclic thio group, an acyloxy group, a carbamoyloxy group, an alkylthio group or a halogen atom.

These releasing groups may be any of the non-photographically useful groups, the photographically useful groups and the precursors thereof (e.g., a development inhibitor, a development accelerator, a desilverization accelerator, a fogging agent, a dye, a hardening agent, a coupler, a scavenger for the oxidation product of a developing agent, a fluorescent dye, a developing agent or an electron transfer agent).

Useful examples of the photographic useful group represented by Z include conventional photographically useful groups and releasing groups (e.g., timing groups) which release a photographically useful group as described in U.S. Pat. Nos. 4,248,962, 4,409,323, 4,438,193, 4,421,845, 4,618,571, 4,652,516, 4,861,701, 4,782,012, 4,857,440, 4,847,185, 4,477,562, 4,438,193, 4,628,024, 4,618,571 and 4,741,994, European Patent Publication Nos. 193,389A, 348,139A and 272,573A.

When Z represents a nitrogen-containing heterocyclic group which is bonded to the coupling site through a nitrogen atom, Z is preferably a 5- or a 6-membered, substituted or unsubstituted, saturated or unsaturated, monocyclic or condensed ring heterocyclic group having 1 to 15 carbon atoms, preferably 1 to 10 carbon atoms. The heterocyclic group may have another hetero-atom such as an oxygen atom or a sulfur atom in addition to the nitrogen atom. Preferred examples of the heterocyclic group include 1-pyrazolyl, 1-imidazolyl, pyrrolino, 1,2,4-triazol-2-yl, 1,2,3-triazol- 1-yl, benztriazolyl, benzimidazolyl, imidazolidine- 2,4-dione-3-yl, oxazolidine-2,4-dione-3-yl, 1,2,4-triazolidine-3,5-dione-4-yl, imidazolidine-2,4,5-trione- 3-yl, 2-imidazolinon-1-yl, 3,5-dioxomorpholino and 1-indazolyl. When these heterocyclic groups are substituted, examples of the substituent groups include those described above in the definition of the substituent groups for $X_1$. Preferably, one of the substituent groups is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, cyano group or a sulfonyl group.

The aromatic oxy group represented by Z is a substituted or unsubstituted aromatic oxy group preferably having 6 to 10 carbon atoms. It is particularly preferred that Z is a substituted or an unsubstituted phenoxy group. When Z is a substituted group, examples of the substituent groups include those described above in the definition of the substituent groups for $X_1$. Preferred is the case where at least one substituent group is an electron attractive group. Examples of such an electron attractive group include a sulfonyl group, an alkoxycarbonyl group, a sulfamoyl group, a halogen atom, a carbamoyl group, a nitro group, a cyano group and an acyl group.

The aromatic thio group represented by Z is a substituted or an unsubstituted aromatic thio group preferably having 6 to 10 carbon atoms. Particularly preferred is a substituted or an unsubstituted phenylthio group. Examples of substituent groups include those describes above in the definition of the substituent groups for $X_1$. When Z is a substituted group, preferably at least one substituent group is an alkyl group, an alkoxy group, a sulfonyl group, an alkoxycarbonyl group, a sulfamoyl group, a halogen atom, a carbamoyl group or a nitro group. When Z represents a heterocyclic oxy group, the heterocyclic moiety thereof is a 3- to 12-membered, preferably 5- or 6-membered, substituted or unsubstituted, saturated or unsaturated, monocyclic or condensed ring heterocyclic group having 1 to 20 carbon atoms, preferably 1 to 10 carbon atoms and at least one hetero-atom of a nitrogen atom, an oxygen atom or a sulfur atom. Examples of the heterocyclic oxy group include a pyridyloxy group, a pyrazolyloxy group and a furyloxy group. Examples of the substituent groups include those described above in the definition of the substituent groups for $X_1$. When Z has one or more substituent groups, preferably one of the substituent group is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group.

When Z represents a heterocyclic thio group, the heterocyclic moiety thereof is a 3- to 12-membered, preferably 5- or 6-membered, substituted or unsubstituted, saturated or unsaturated, monocyclic or condensed ring heterocyclic group having 1 to 20 carbon atoms, preferably 1 to 10 carbon atoms and at least one heteroatom of a nitrogen atom, an oxygen atom and a sulfur atom. Examples of the heterocyclic thio group include a tetrazolylthio group, a 1,3,4-thiadiazolylthio group, a 1,3,4-oxadiazolylthio group, a 1,3,4-triazolylthio group, a benzimidazolylthio group, a benzthiazolylthio group and a 2-pyridylthio group. Examples of the substituent groups include those described above in the definition of the substituent groups for $X_1$. When Z has one or more substituent groups, preferably at least one substituent group is an alkyl group, an aryl group, a carboxyl group, an alkoxy group, a halogen atom, an alkoxycarbonyl group, an aryloxysulfonyl group, an alkylthio group, an acylamino group, a sulfonamido group, a nitro group, a carbamoyl group, a heterocyclic group or a sulfonyl group.

The acyloxy group represented by Z is preferably a monocyclic or condensed ring, substituted or unsubstituted, aromatic acyloxy group or a substituted or unsubstituted aliphatic acyloxy group having 2 to 30 carbon atoms, preferably 2 to 20 carbon atoms. Examples of substituent groups include those described above in the definition of the substituent groups for $X_1$.

The carbamoyloxy group represented by Z is an aliphatic, aromatic or heterocyclic, substituted or unsubstituted carbamoyloxy group having 1 to 30 carbon atoms, preferably 1 to 20 carbon atoms. Examples of the carbamoyloxy group include N,N-diethylcarbamoyloxy, N-phenylcarbamoyloxy, 1-imidazolylcarbonyloxy and 1-pyrrolocarbonyloxy. Examples of substituent groups include those described above in the definition of the substituent groups for $X_1$.

The alkylthio group represented by Z is a straight-chain, branched or cyclic, saturated or unsaturated, substituted or unsubstituted, alkylthio group having 1 to 30 carbon atoms, preferably 1 to 20 carbon atoms. Examples of substituent groups include those described above in the definition of the substituent groups for $X_1$.

Among the couplers of general formulae (1) and (2), there are particularly preferred the compounds where the group represented by $X_1$ in general formula (1) is preferably an alkyl group with an alkyl group having 1 to 10 carbon atoms being particularly preferred. The compounds where the group represented by Y in general formulae (1) and (2) is preferably an aromatic group with a phenyl group having at least one substituent group at the ortho-position being particularly preferred (e.g., examples of substituent groups include those described above in the definition of the substituent groups for the case where Y is an aryl group, and preferred examples of the substituent groups are as described above). The preferred compounds are where the group represented by Z is preferably a 5- or 6-membered nitrogen-containing heterocyclic group which is bonded to the coupling site through a nitrogen atom, an aromatic oxy group, a 5- or 6-membered heterocyclic oxy group or a 5- or 6-membered heterocyclic thio group.

Among the couplers of general formulae (1) and (2), preferred couplers can be represented by the following formula (3), (4) or (5):

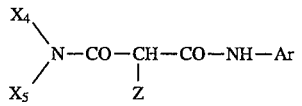

(3)

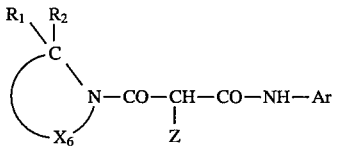

(4)

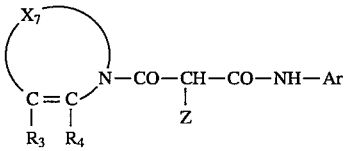

(5)

wherein Z is as defined in general formula (1); $X_4$ and $X_5$ each represents an alkyl group or an aromatic group; Ar represents a phenyl group having at least one substituent group at the ortho-position; $X_6$ represents an organic residue which forms a nitrogen-containing heterocyclic group (monocyclic or condensed ring) together with —$C(R_1R_2)$—N<; $X_7$ represents an organic residue which forms a nitrogen-containing heterocyclic group (monocyclic or condensed ring) together with —$C(R_3)$=$C(R_4)$—N<; and $R_1$, $R_2$, $R_3$ and $R_4$ each represents a hydrogen atom or a substituent group.

The details and preferred ranges of the groups represented by $X_4$ to $X_7$, Ar and Z in general formulae (3) to (5) are the same as described above in general formulae (1) and (2). Each of the groups represented by $R_1$ to $R_4$ may be further substituted. Examples of such substituent groups include those described above in the definition of the substituent groups for $X_1$.

Among the above-described couplers, particularly preferred are the couplers represented by general formula (4) or (5).

The couplers represented by general formulae (1) to (5) may be joined to each other by the group of $X_1$ to $X_7$, Y, Ar, $R_1$ to $R_4$ or Z through a bivalent or polyvalent group to form a dimer or a polymer (e.g., a telomer or a polymer). In this case, the number of carbon atoms may exceed the number of carbon atoms defined above for each substituent group.

It is preferred that the couplers of general formulae (1) to (5) are nondiffusible type couplers. The term "nondiffusible type coupler" as used herein refers to a coupler having a group in the molecule, said group increasing sufficiently the molecular weight to fix the coupler in a layer to which the coupler is added. Generally, an alkyl group having 8 to 30 carbon atoms, preferably 10 to 20 carbon atoms in total or an aryl group having a substituent group having 4 to 20 carbon atoms in total is used as the nondiffusible group. The nondiffusible group may be attached at any position, or two or more nondiffusible groups may be used.

Examples of the yellow couplers of general formulae (1) to (5) include the following compounds, but the present invention is not limited thereto.

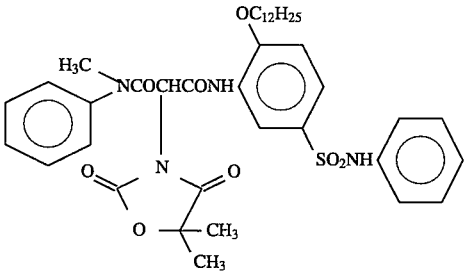

Y-1

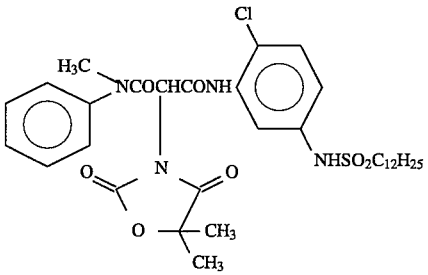

Y-2

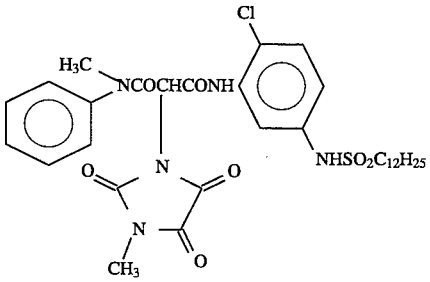

Y-3

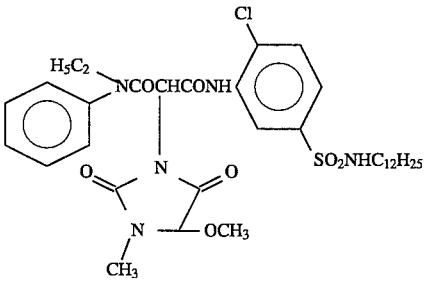

Y-4

-continued
Y-5
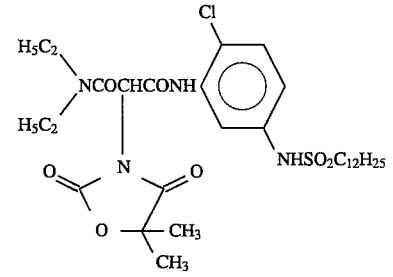
Y-6
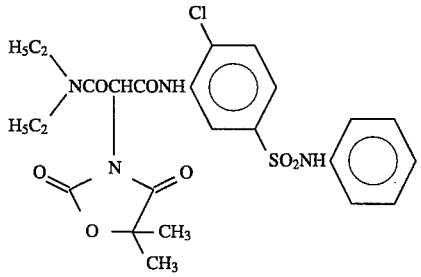
Y-7
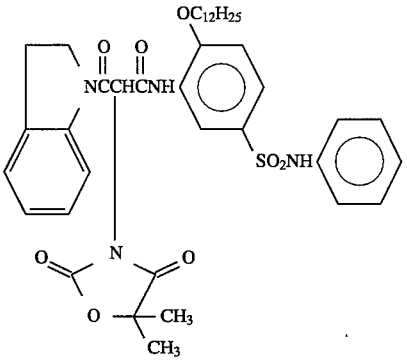
Y-8
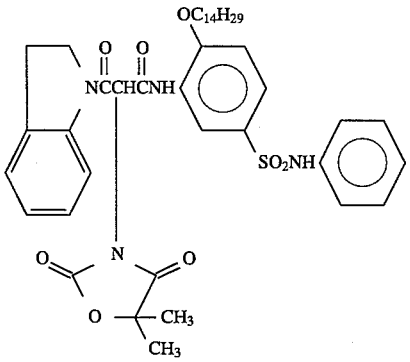
Y-9
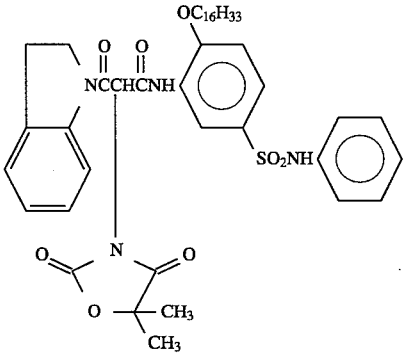
Y-10
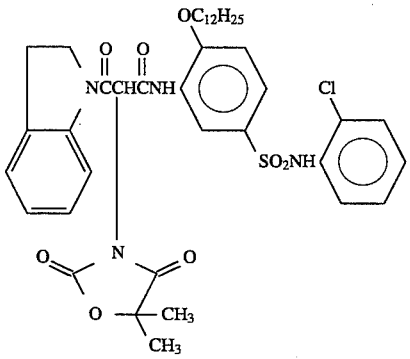
Y-11
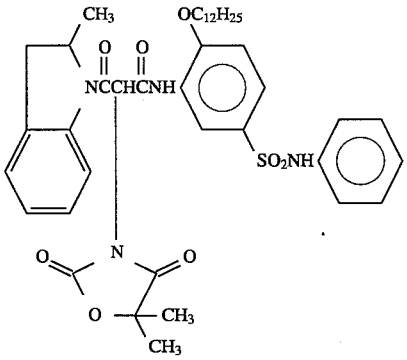
Y-12
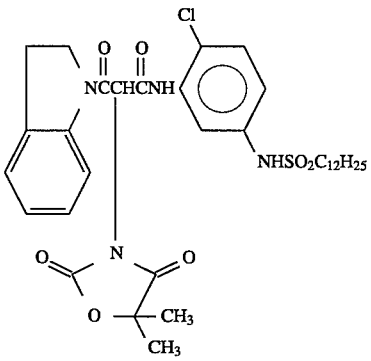

-continued
Y-13
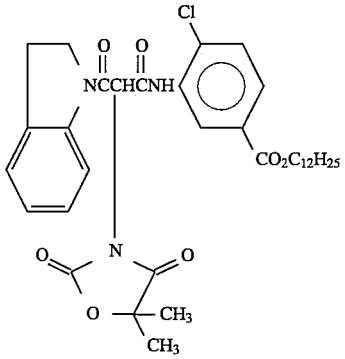
Y-14
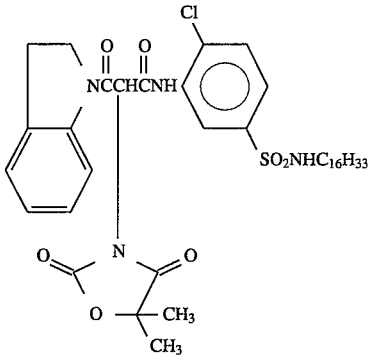
Y-15
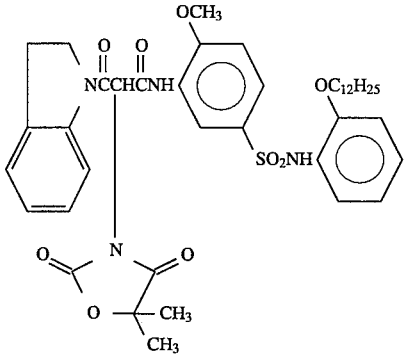
Y-16
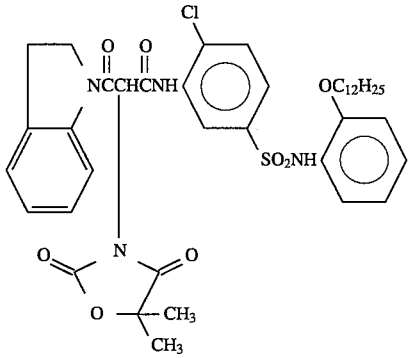
Y-17
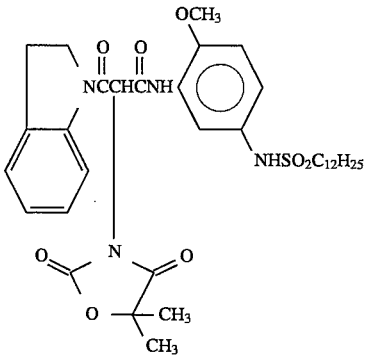
Y-18
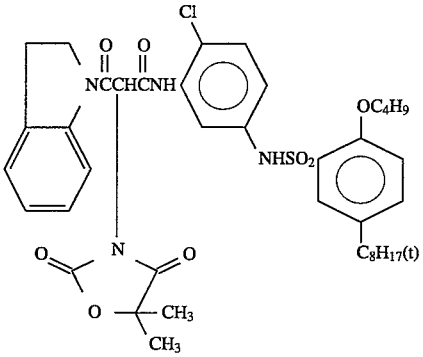
Y-19
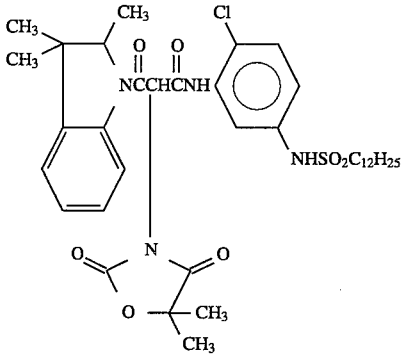
Y-20
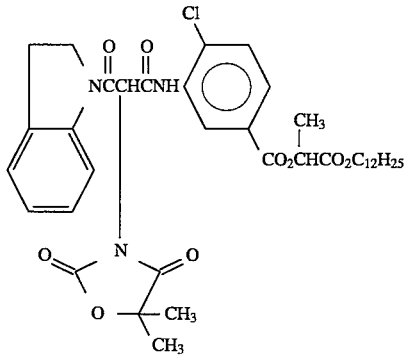

-continued
Y-21
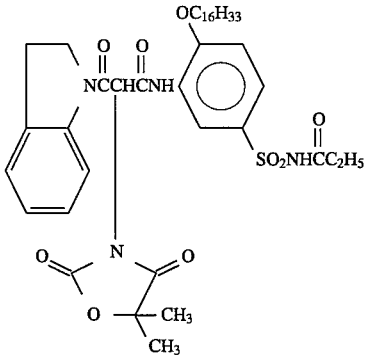
Y-22
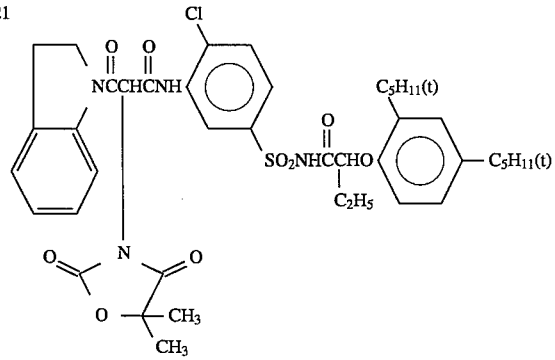
Y-23
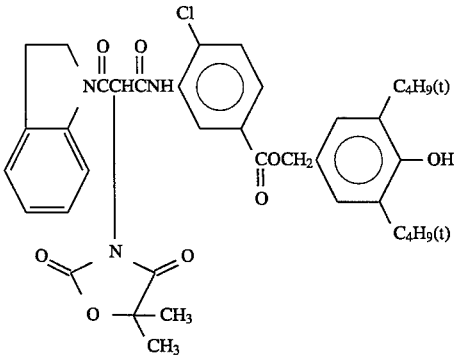
Y-24
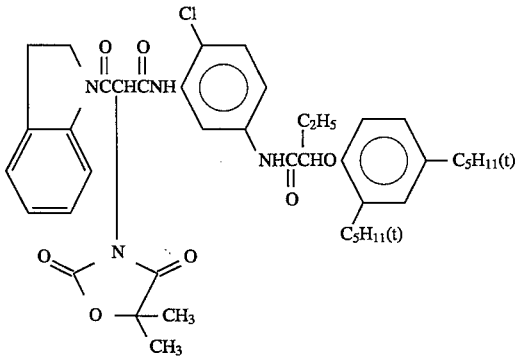
Y-25
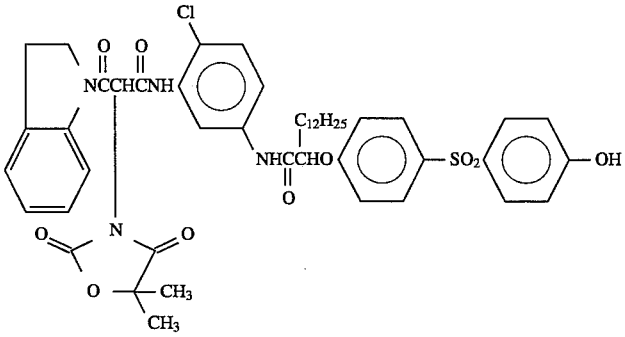
Y-26
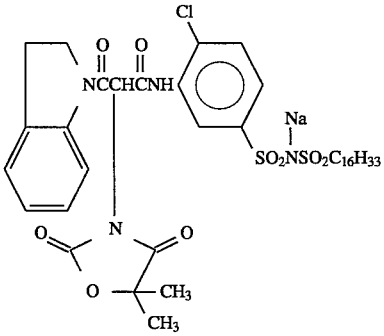
Y-27
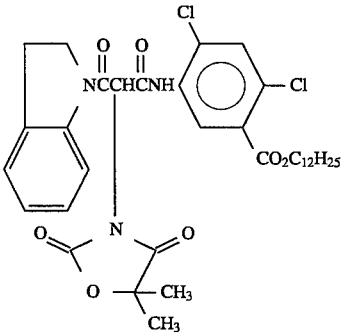

-continued
Y-28
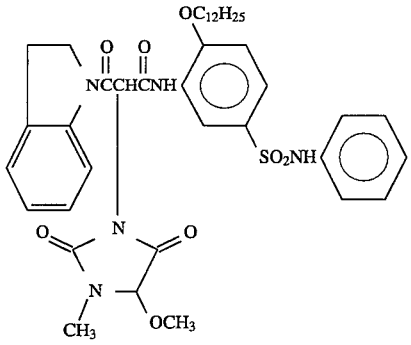
Y-29
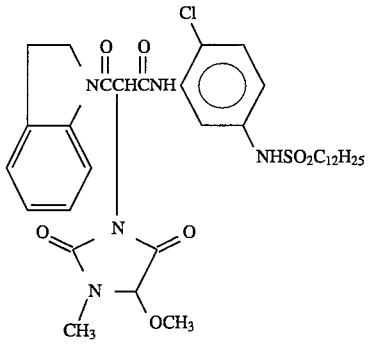
Y-30
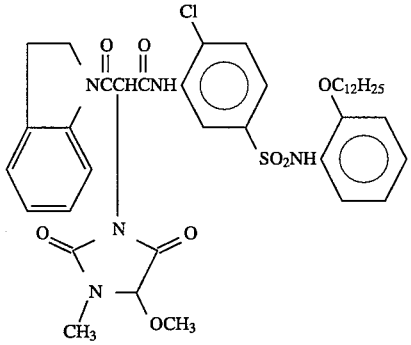
Y-31
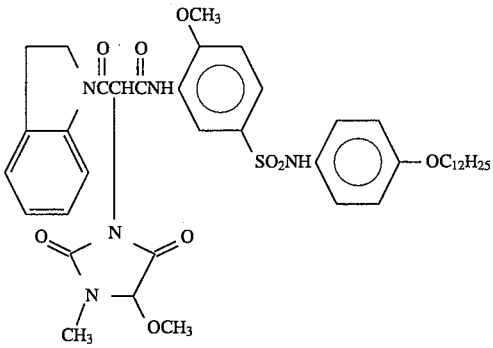
Y-32
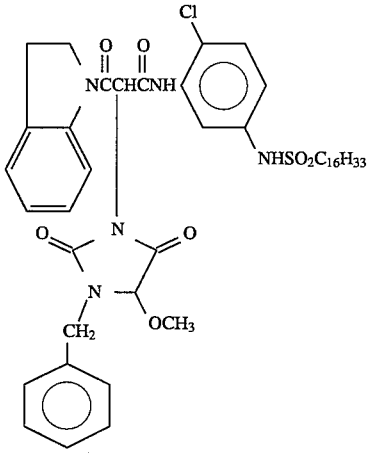
Y-33
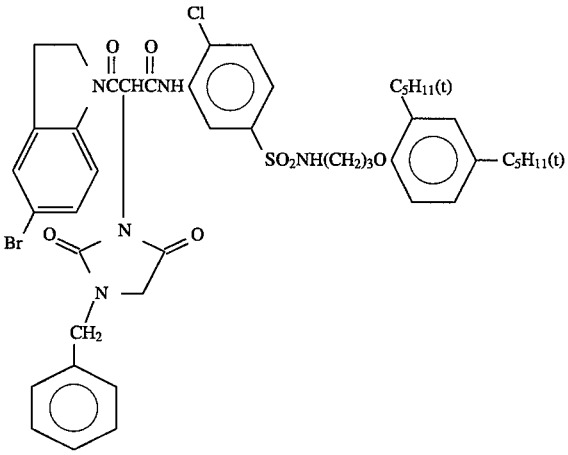

-continued
Y-34
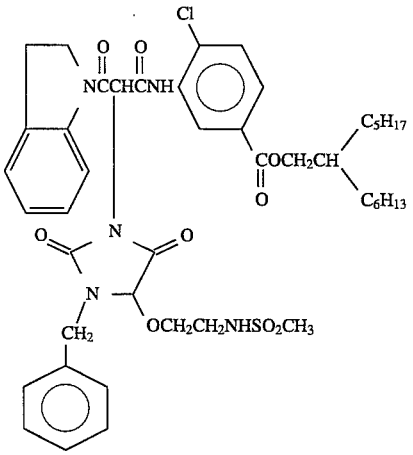
Y-35
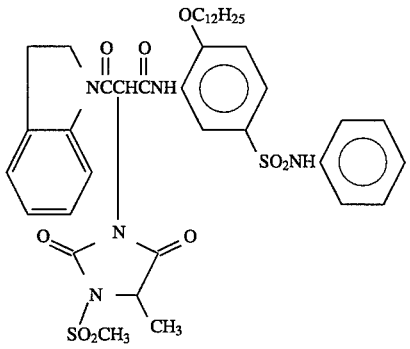
Y-36
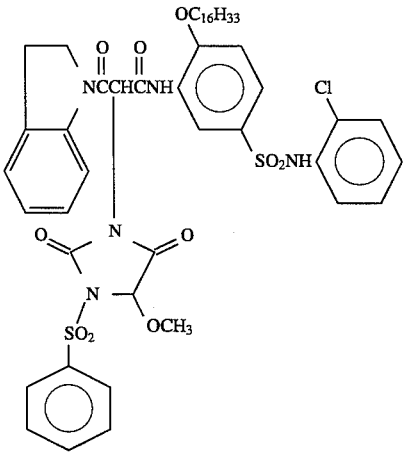
Y-37
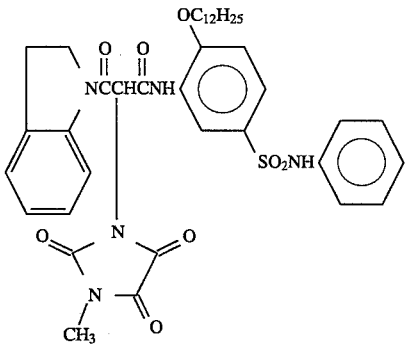
Y-38
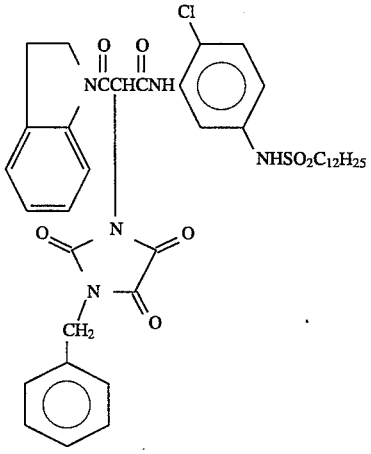
Y-39
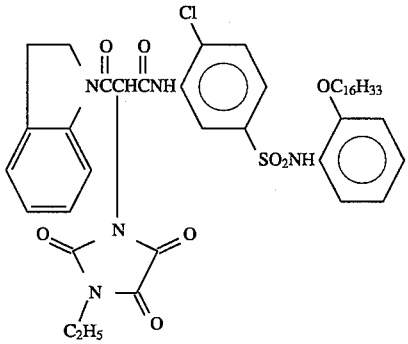

-continued
Y-40
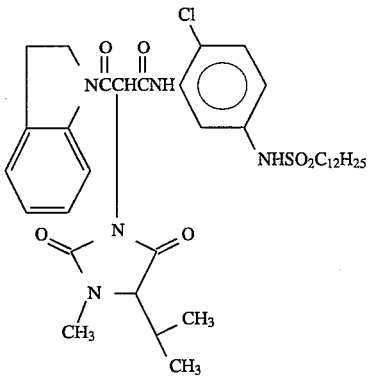
Y-41
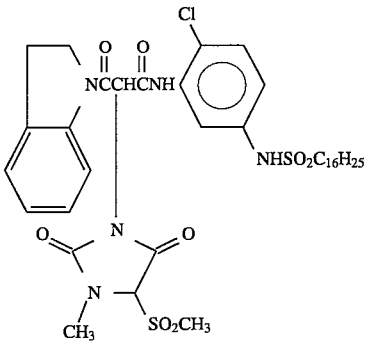
Y-42
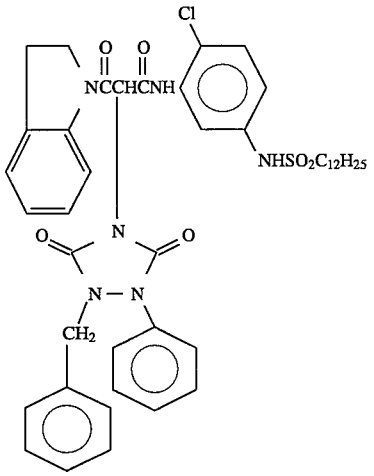
Y-43
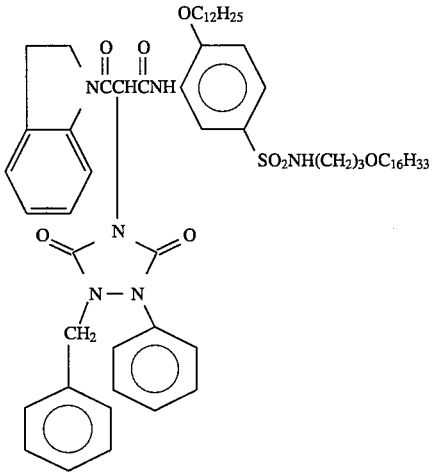
Y-44
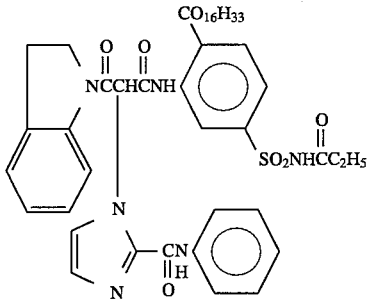
Y-45
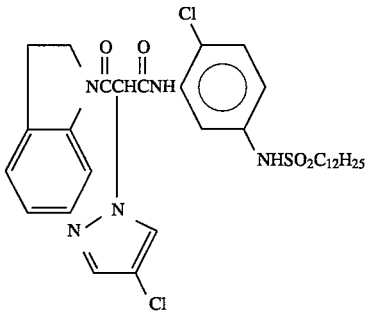
Y-46
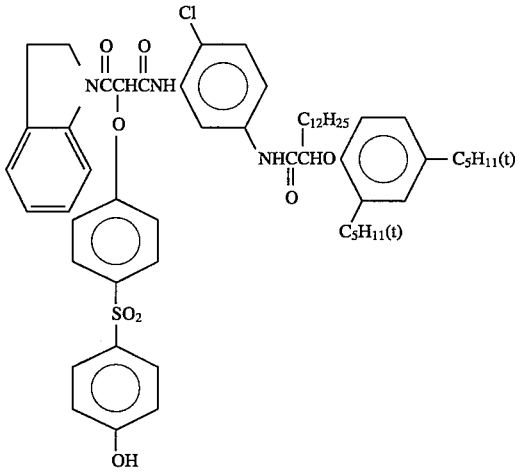
Y-47
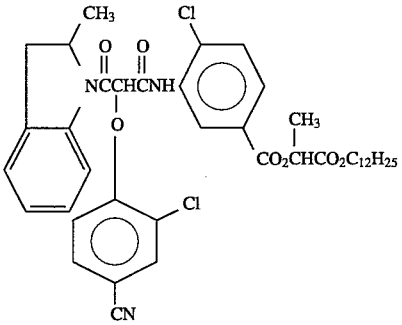

-continued
Y-48
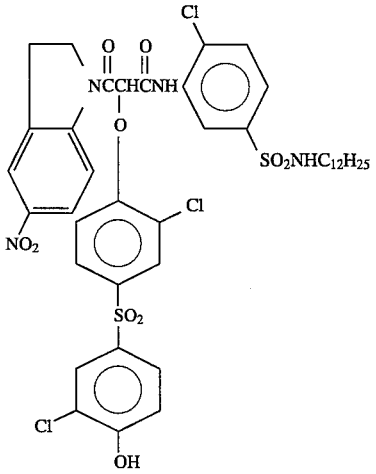
Y-49
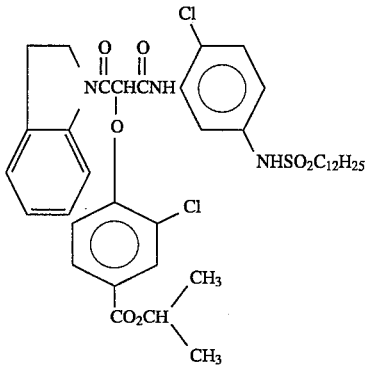
Y-50
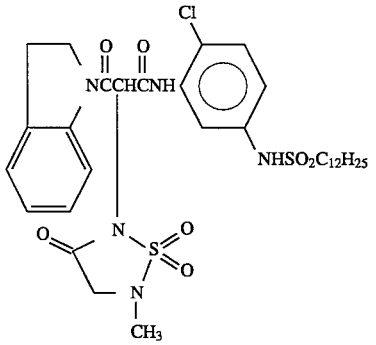
Y-51
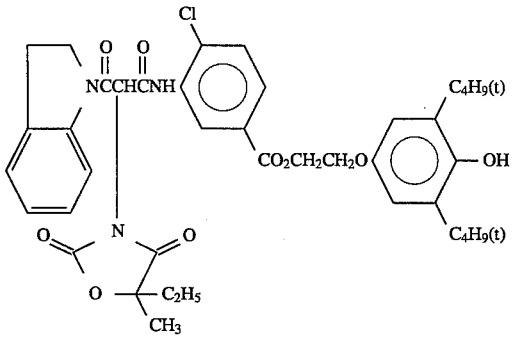
Y-52
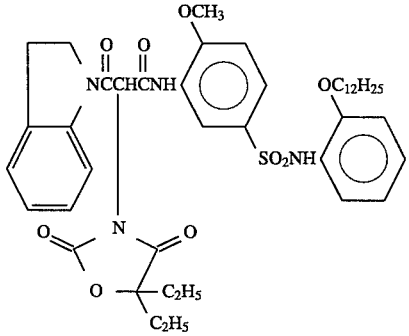
Y-53
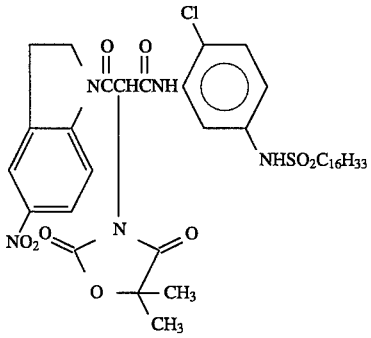
Y-54
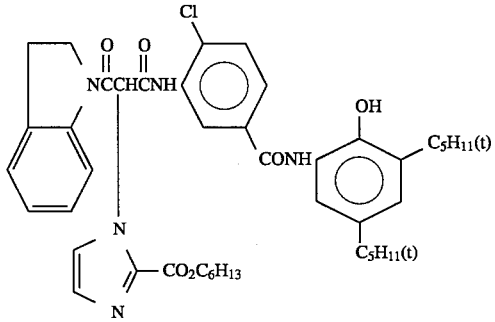
Y-55
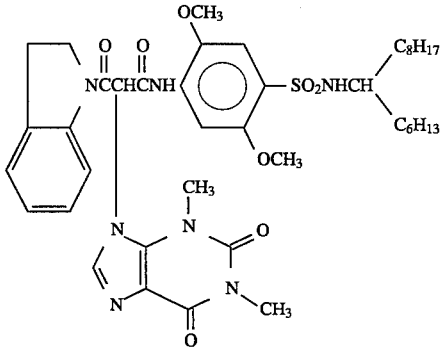

-continued
Y-56
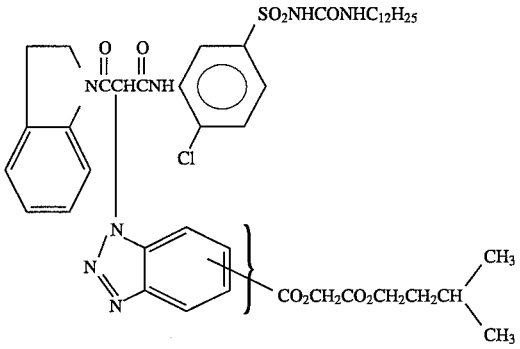
Y-57
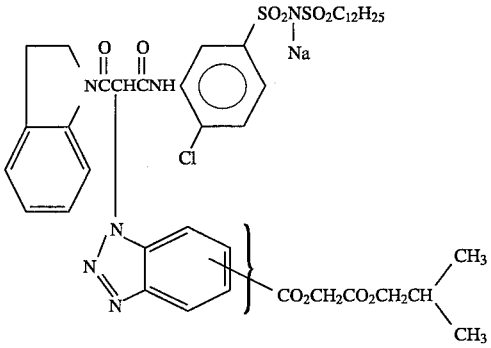
Y-58
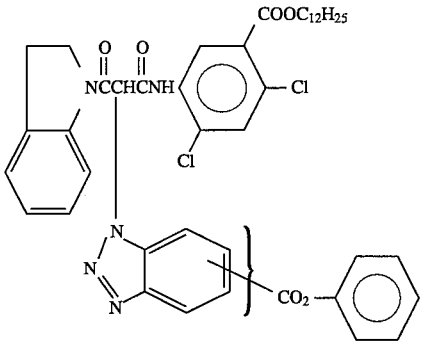
Y-59
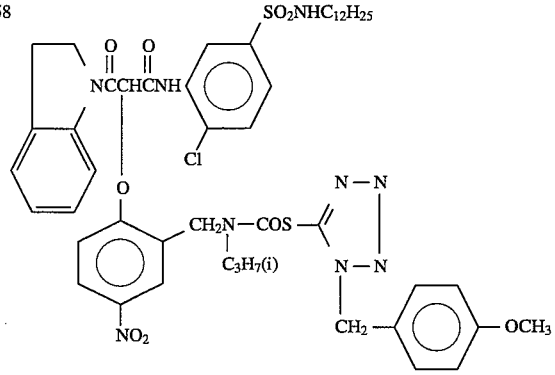
Y-60
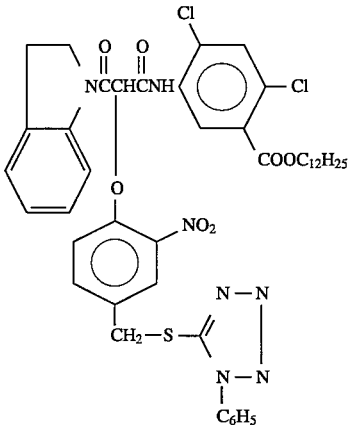
Y-61
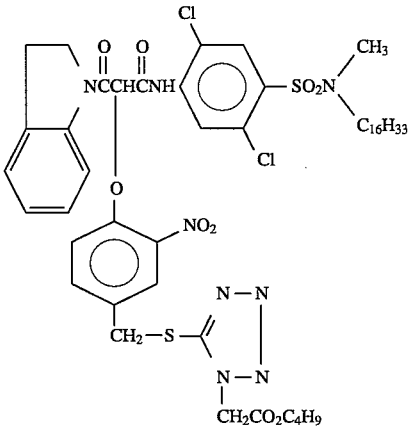
Y-62
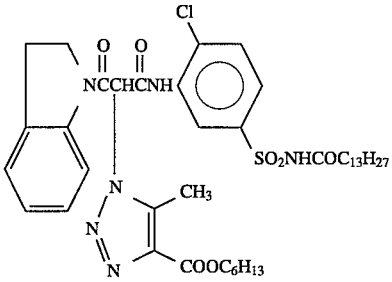
The yellow couplers of general formulae (1) to (5) according to the present invention can be synthesized by the following reaction scheme.

Synthesis Example 1

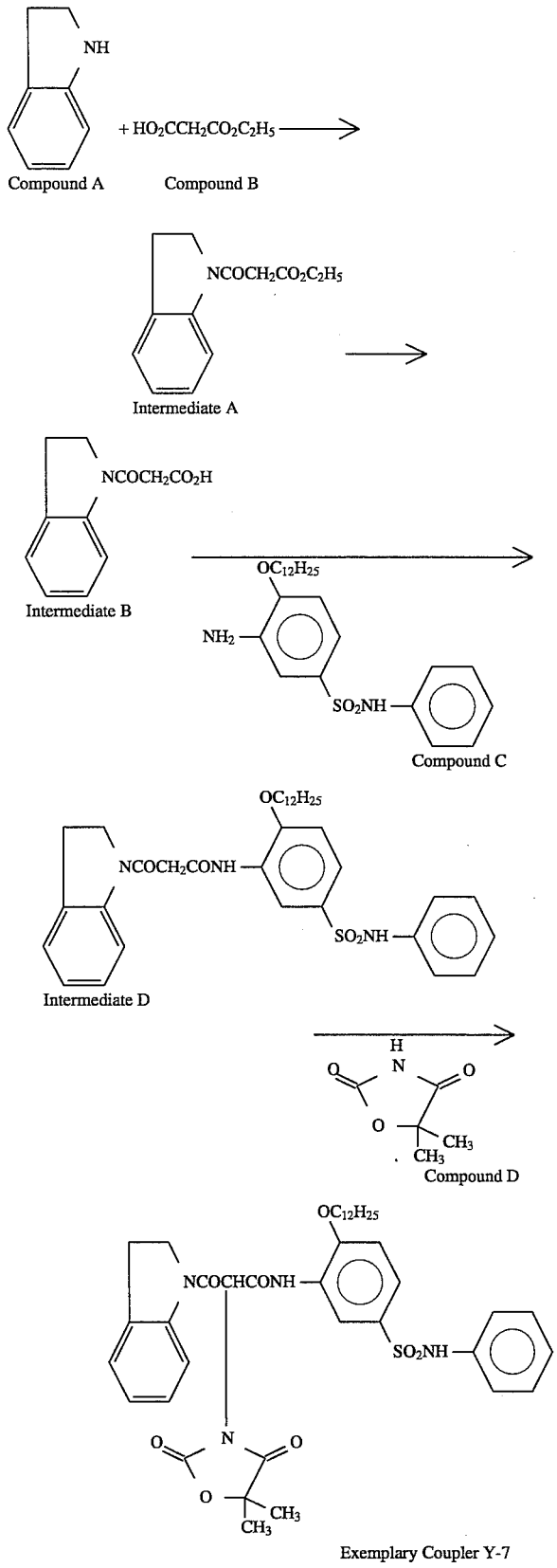

Synthesis of intermediate B 357.5 g (3.0 mol) of compound A and 396.3 g (3.0 mol) of compound B were dissolved in 1.2 l of ethyl acetate and 0.6 l of dimethylformamide. To the resulting solution was added dropwise an acetonitrile (400 ml) solution of 631 g (3.06 mol) of dicyclohexylcarbodiimide at 20° to 30° C. while stirring. The mixture was reacted at 20° to 30° C. for 2 hours, and the precipitated dicyclohexylurea was recovered by filtration. To the filtrate were added 500 ml of ethyl acetate and 1 l of water. The water layer was removed. The organic layer was washed twice with 1 l of water and dried over anhydrous sodium sulfate. Ethyl acetate was distilled off under reduced pressure to obtain 692 g (98.9%) of an intermediate B as an oily product.

In 3 l of ethyl alcohol was dissolved 692 g (2.97 mol) of the intermediate A, and 430 g of a 30% aqueous solution of sodium hydroxide was added dropwise thereto while stirring at 75° to 80° C. After dropwise addition, the mixture was reacted at the above temperature for 30 minutes, and the precipitated crystals were recovered by filtration. (Yield: 658 g)

The crystals were suspended in 5 l of water. To the resulting suspension was added dropwise 300 ml of concentrated hydrochloric acid while stirring at 40° to 50° C. After the mixture was stirred at the above temperature for one hour, the resulting crystals were recovered by filtration to obtain 579 g (95%) of an intermediate B (decomposition point: 127° C.).

Synthesis of intermediate D 45.1 g (0.22 mol) of the intermediate B and 86.6 g (0.2 mol) of compound C were dissolved in 400 ml of ethyl acetate and 200 ml of dimethylacetamide. To the resulting solution was added dropwise an acetonitrile (100 ml) solution of 66 g (0.32 mol) of dicyclohexylcarbodiimide while stirring at 15° to 30° C. The mixture was reacted at 20° to 30° C. for 2 hours, and the precipitated dicyclohexylurea was recovered by filtration.

To the filtrate were added 400 ml of ethyl acetate and 600 ml of water. The water layer was removed. The organic layer was washed twice with water and dried over anhydrous sodium sulfate. Ethyl acetate was distilled off under reduced pressure to obtain 162 g of an oily material.

The oily material was crystallized from 100 ml of ethyl acetate and 300 ml of n-hexane to obtain 108 g (87.1%) of an intermediate D (melting point: 132°–134° C.).

TABLE 1

| Elemental analysis for intermediate D | | | |
|---|---|---|---|
| | C % | H % | N % |
| Calculated | 67.82 | 7.32 | 6.78 |
| Found | 67.81 | 7.32 | 6.76 |

Synthesis of coupler Y-7

In 300 ml of dichloromethane was dissolved 49.6 g (0.08 mol) of the intermediate D. To the resulting solution was added dropwise 11.4 g (0.084 mol) of sulfuryl chloride while stirring at 10° to 15° C.

After the mixture was reacted at the above temperature for 30 minutes, 200 g of a 5% aqueous solution of sodium bicarbonate was added dropwise to the reaction mixture. The organic layer was recovered, washed with 200 ml of water and dried over anhydrous sodium sulfate. Dichloromethane was distilled off under reduced pressure to obtain 47 g of an oily material.

In 200 ml of acetonitrile was dissolved 47 g of the oily material. To the resulting solution were added 28.4 g (0.22 mol) of compound D and 22.2 g (0.22 mol) of triethylamine while stirring. The mixture was reacted at 40° to 50° C. for 4 hours, and the reaction mixture was poured into 300 ml of water. The precipitated oily material was extracted with 300 ml of ethyl acetate. The organic layer was washed with 200 g of a 5% aqueous solution of sodium hydroxide and twice with 300 ml of water. The organic layer was acidified with dilute hydrochloric acid, washed twice with water and concentrated under reduced pressure to obtain a residue (yield: 70 g).

The resulting oily material was crystallized from a mixed solvent of 50 ml of ethyl acetate and 100 ml of n-hexane to obtain 47.8 g (80%) of Coupler Y-7 (melting point: 145°–7° C.).

Elemental analysis for Coupler Y-7

| | C % | H % | N % |
|---|---|---|---|
| Calculated | 64.32 | 6.75 | 7.50 |
| Found | 64.31 | 6.73 | 7.50 |

Synthesis Example 2

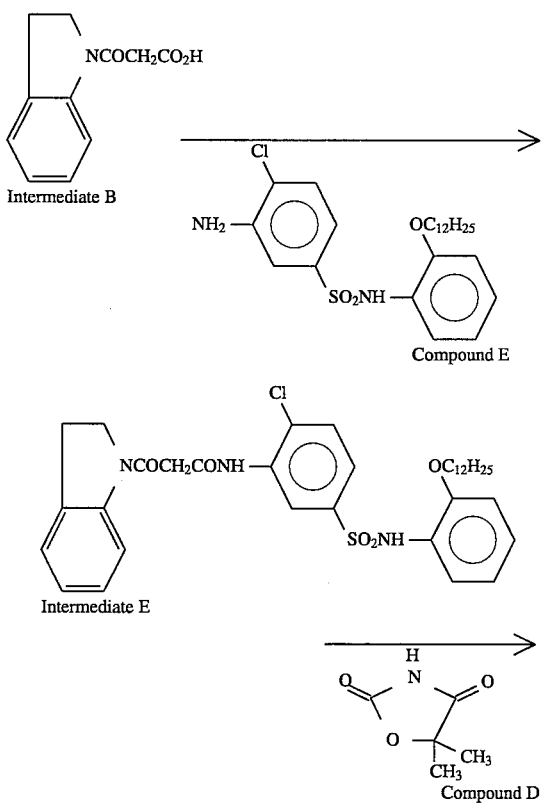

-continued

Synthesis Example 2

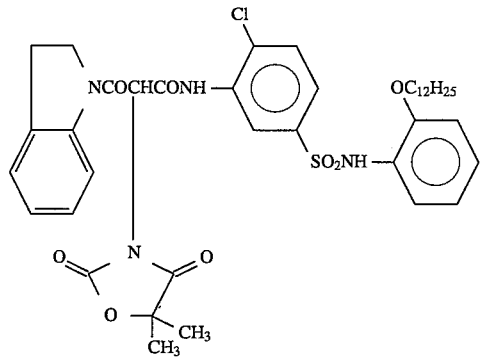

Coupler Y-16

Synthesis of intermediate E 90.3 g (0.44 mol) of intermediate B and 187 g (0.4 mol) of compound E were dissolved in 500 ml of ethyl acetate and 300 ml of dimethylformamide. An acetonitrile (200 ml) solution of 131.9 g (0.64 mol) of dicyclohexylcarbodiimide was added dropwise to the resulting solution while stirring at 15° to 30° C.

The mixture was reacted at 20° to 30° C. for 2 hours, and the precipitated dicyclohexylurea was recovered by filtration. To the filtrate were added 500 ml of ethyl acetate and 600 ml of water. After the water layer was removed, the organic layer was washed twice with water and dried over anhydrous sodium sulfate. Ethyl acetate was distilled off under reduced pressure to obtain 281 g of an oily material.

The oily material was dissolved in 1.5 l of n-hexane by heating. Insoluble materials were removed by filtration. The n-hexane solution was cooled with water, and the precipitated intermediate E was recovered by filtration. Yield: 243.4 g (93%) Melting point: 103°–5° C.

TABLE 3

Elemental analysis for intermediate E

| | C % | H % | N % |
|---|---|---|---|
| Calculated | 64.25 | 6.78 | 6.42 |
| Found | 64.24 | 6.76 | 6.43 |

Synthesis of Coupler Y-16

In 200 ml of dichloromethane was dissolved 39.3 g (0.06 mol) of intermediate E. To the resulting solution was added dropwise 8.7 g (0.064 mol) of sulfuryl chloride while stirring at 10° to 15° C.

After the mixture was reacted at the above temperature for 30 minutes, 200 g of a 4% aqueous solution of sodium bicarbonate was added dropwise to the reaction mixture. The organic layer was recovered, washed with 200 ml of water and dried over anhydrous sodium sulfate. Dichloromethane was distilled off under reduced pressure to obtain 41.3 g of an oily material.

41.3 g of the oily material was dissolved in 100 ml of acetonitrile and 200 ml of dimethylacetamide. To the resulting solution were added 20.8 g (0.16 mol) of compound D and 16.2 g of triethylamine while stirring. The mixture was reacted at 30° to 40° C. for 3 hours and poured into 400 ml of water. The precipitated oily material was extracted with 300 ml of ethyl acetate. The organic layer was washed with 300 g of a 2% aqueous solution of sodium hydroxide and then twice with water. The organic layer was acidified with dilute hydrochloric acid, washed twice with water and concentrated under reduced pressure to obtain 42 g of a residue.

The residue was crystallized from 200 ml of methanol to obtain 39.8 g (85%) of Coupler Y-16 (melting point: 110°–112° C.).

TABLE 4

| Elemental analysis for Coupler Y-16 | | | |
|---|---|---|---|
| | C % | H % | N % |
| Calculated | 61.48 | 6.32 | 7.17 |
| Found | 61.46 | 6.30 | 7.18 |

Synthesis Example 3

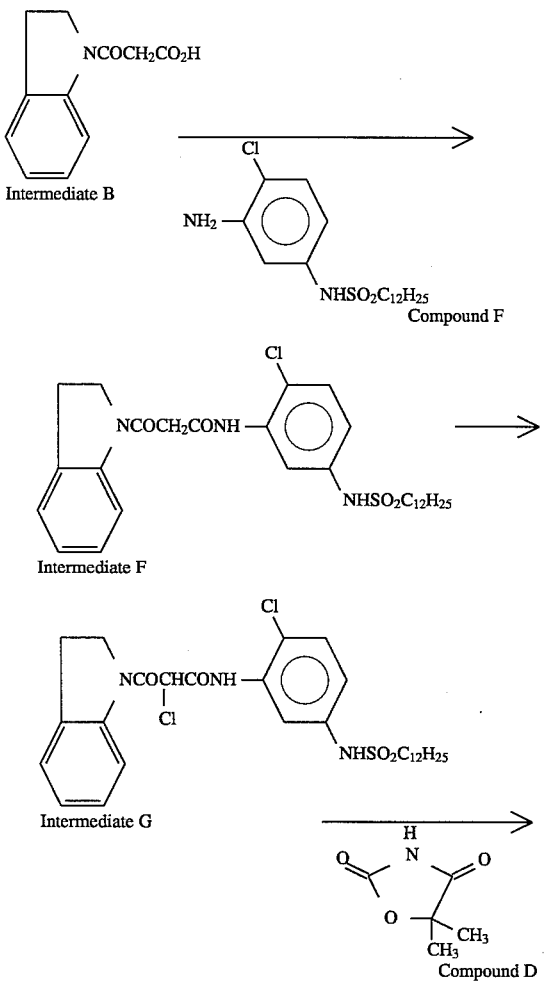

-continued

Synthesis Example 3

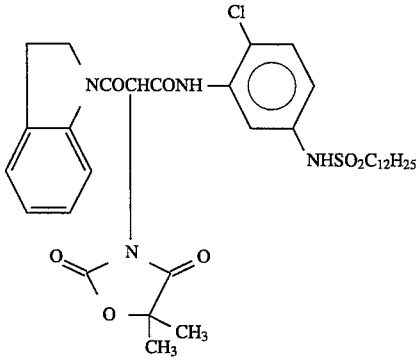

Coupler Y-12

Synthesis of intermediate F 104.7 g (0.51 mol) of intermediate B and 187.5 g (0.5 mol) of compound F were dissolved in 1 l of ethyl acetate and 400 ml of dimethylformamide. A dimethylformamide (100 ml) solution of 107.3 g (0.525 mol) of dicyclohexylcarbodiimide was added dropwise to the resulting solution while stirring at 15° to 30° C. After the mixture was reacted at 20° to 30° C. for one hour, 500 ml of ethyl acetate was added to the reaction mixture, and the mixture was heated at 50° to 60° C. The resulting dicyclohexylurea was recovered by filtration.

To the filtrate was added 500 ml of water. After the water layer was removed, the organic layer was washed twice with water and dried over anhydrous sodium sulfate. Ethyl acetate was distilled off under reduced pressure to obtain 290 g of an oily material. The oily material was dissolved in 1 l of ethyl acetate and 2 l of methanol by heating. Insoluble matters were removed by filtration, and the filtrate was cooled with water to precipitate an intermediate F as crystals. The crystals were recovered by filtration. Yield: 267 g (95%). Melting point 163°–4° C.

TABLE 5

| Elemental analysis for intermediate F | | | |
|---|---|---|---|
| | C % | H % | N % |
| Calculated | 61.95 | 7.17 | 7.48 |
| Found | 61.93 | 7.17 | 7.46 |

Synthesis of intermediate G

In 500 ml of dichloromethane was dissolved 114.0 g (0.2 mol) of intermediate F. To the resulting solution, 28.4 g (0.21 mol) of sulfuryl chloride was added dropwise while stirring at 10° to 15° C.

The mixture was reacted at the above temperature for 30 minutes, and 500 g of a 6% aqueous solution of sodium bicarbonate was added dropwise to the reaction mixture. The organic layer was separated, washed with 500 ml of water and dried over anhydrous sodium sulfate. Dichloromethane was distilled off under reduced pressure to precipitate an intermediate G as crystals. The crystals were recovered by filtration. Yield: 108.6 g (91%).

Synthesis of coupler Y-12

In 80 ml of dimethylformamide was dissolved 29.8 g (0.05 mol) of intermediate G. To the resulting solution was added dropwise 10.1 g (0.10 mol) of triethylamine while stirring at 20° to 30° C. The mixture was reacted at 40° to 45° C. for one hour. Subsequently, 30 ml of ethyl acetate and 200 ml of water were added to the reaction mixture. The organic layer was washed twice with 400 g of a 2% aqueous solution of sodium hydroxide and then once with water. The organic layer was acidified with dilute hydrochloric acid, washed twice with water and concentrated under reduced pressure to obtain 34 g of a residue. The residue was crystallized from a mixed solvent of 50 ml of ethyl acetate and 150 ml of n-hexane to obtain 19 g of Coupler Y-12.

The resulting crystals were recrystallized from 0 ml of a mixed solvent of ethyl acetate/n-hexane=⅓ by volume to obtain 15 g (43.5%) of Coupler Y-12 (melting point: 135°–6° C.).

TABLE 6

| Elemental analysis for Coupler Y-12 | | | |
|---|---|---|---|
| | C % | H % | N % |
| Calculated | 59.24 | 6.58 | 8.13 |
| Found | 59.27 | 6.56 | 8.12 |

Synthesis Example 4

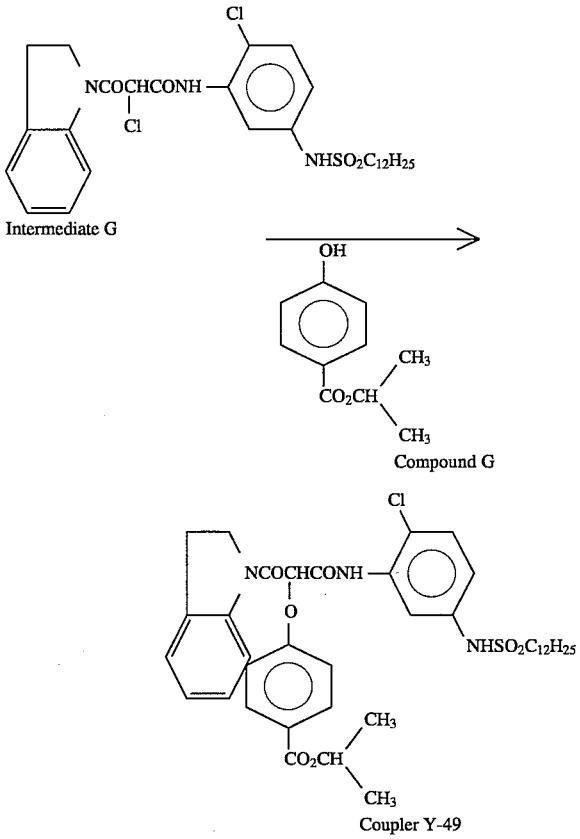

Synthesis of Coupler Y-49

27.0 g (0.15 mol) of compound G and 15.2 g (0.15 mol) of triethylamine were dissolved in 50 ml of dimethylformamide. A solution of 29.8 g (0.05 mol) of intermediate G in dimethylformamide (30 ml) was added dropwise to the mixture while stirring.

The mixture was reacted at 30° to 40° C. for 4 hours, and 400 ml of ethyl acetate and 300 ml of water were added to the reaction mixture. The organic layer was washed with 400 g of a 2% aqueous solution of sodium hydroxide and then twice with water. The organic layer was acidified with dilute hydrochloric acid, washed twice with water and dried over anhydrous sodium sulfate. Ethyl acetate was distilled off under reduced pressure to obtain 54 g of a residue.

The residue was crystallized from 300 ml of a mixed solvent of ethyl acetate/methanol (½ by volume), and Coupler Y-49 was recovered by filtration. The resulting crystals were recrystallized from 200 ml of a mixed solvent of ethyl acetate/methanol (½ by volume) to obtain 29.8 g (77.5%) of Coupler Y-49. Melting point: 190°–191° C.

TABLE 7

| Elemental analysis for coupler Y-49 | | | |
|---|---|---|---|
| | C % | H % | N % |
| Calculated | 63.26 | 6.81 | 5.68 |
| Found | 63.24 | 6.79 | 5.67 |

The compounds represented by general formula (F) according to the present invention will be illustrated in more detail below.

$$A\text{-}(L)_n\text{-}(G)_m\text{-}(Time)_t\text{-}X \qquad (F)$$

The oxidation-reduction (redox) mother nucleus represented by A is a group which follows the Kendall-Pelz rule described in T. H. James, *The Theory of the Photographic Process,* 4th Edition, P298, MacMillan Publishing Co., Ltd. (1977). Examples of A include hydroquinone, catechol, p-aminophenol, o-aminophenol, 1,2-naphthalenediol, 1,4-naphthalenediol, 1,6-naphthalenediol, 1,2-aminonaphthol, 1,4-amionaphthol, 1,6-aminonaphthol, gallic acid esters, gallic acid amide, hydrazine, hydroxylamine, pyrazolidone and reductone.

It is preferred that the amino group on these redox mother nuclei is substituted by a sulfonyl group having 1 to 25 carbon atoms or an acyl group having 1 to 25 carbon atoms. Examples of the sulfonyl group include a substituted or unsubstituted aliphatic sulfonyl group and a substituted or unsubstituted aromatic sulfonyl group. Examples of the acyl group include a substituted or unsubstituted aliphatic acyl group and a substituted or unsubstituted aromatic acyl group. The hydroxyl group or the amino group on the redox mother nucleus A may be protected by a protective group which can be removed during the course of development. Examples of the protective group include protective groups having 1 to 25 carbon atoms such as an acyl group, an alkoxycarbonyl group and a carbamoyl group and those described in JP-A-59-197037 and JP-A-59- 201057. Further, the protective group may be combined together with the following substituent group for A to form a 5-membered, 6-membered or 7-membered ring, if possible.

The redox mother nucleus represented by A may have one or more substituent groups at the positions where the substituent groups can be attached to the nucleus. The substituent groups have no more than 25 carbon atoms. Examples of such substituent groups include an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic residue and $-(L)_n-(G)_m-(Time)_tX$. These substituent groups may be further substituted. Examples of such substituent groups include those described above in the definition of the substituent groups for A. Further, these substituent groups may be combined together to form a saturated or unsaturated carbon ring or a saturated or unsaturated heterocyclic ring.

Preferred examples of A include hydroquinone, catechol, p-aminophenol, o-aminophenol, 1,4-naphthalenediol, 1,4-aminonaphthol, gallic acid esters, gallic acid amides and hydrazine. More preferred are hydroquinone, catechol, p-aminophenol, o-aminophenol and hydrazine. Most preferred are hydroquinone and hydrazine.

L represents a divalent bonding group. Preferred examples of L include alkylene, alkenylene, arylene, oxyalkylene, oxyarylene, aminoalkyleneoxy, aminoalkenyleneoxy, aminoaryleneoxy and an oxygen atom.

G represents an acid group. Preferred examples of G include the following groups:

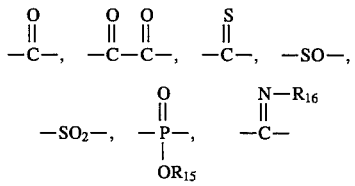

wherein $R_{15}$ represents an alkyl group, an aryl group or a heterocyclic ring, and $R_{16}$ represents a hydrogen atom or has the same meaning as $R_{15}$. More preferred examples of G include the following groups:

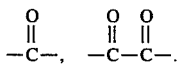

Most preferably, G is the following group:

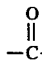

In general formula (F), n and m each represents 0 or 1. Whether 0 or 1 is preferred varies on the type of A. When A is hydroquinone, catechol, aminophenol, naphthalenediol, aminonaphthol or a gallic acid derivative, it is preferred that n=0, and it is more preferred that n=m=0. When A is hydrazine or hydroxylamine, it is preferred that n=0 and m=1. When A is pyrazolidone, it is preferred that n=m=1.

The group represented by —(Time)$_t$—X in general formula (F) is a group which is released as —(Time)$_t$—X only when the redox mother nucleus represented by A undergoes a cross oxidation reaction during development to form an oxidation product.

It is preferred that Time is bonded to G through a sulfur atom, a nitrogen atom, an oxygen atom or a selenium atom.

Time is a group capable of releasing X after (Time)$_t$X is released. Time may have a timing controlling function. Time may be a redox group or a coupler which releases X by the reaction with the oxidation product of a developing agent.

Examples of Time, which is a group having a timing controlling function, include those described in U.S. Pat. Nos. 4,248,962 and 4,409,323, U.K. Patent 2,096,783, U.S. Pat. No. 4,146,396, JP-A-51-146828 and JP-A- 57-56837. Time may be a group composed of a combination of two or more groups selected from among the above-described groups.

Preferred examples of the timing controlling groups include the following groups.

(1) A group which utilizes the cleavage reaction of hemi-acetal.

Examples of this group include those described in U.S. Pat. No. 4,146,396, JP-A-60-249148 and JP-A-60- 249149. The group can be represented by the following general formula:

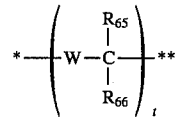

wherein the mark * represents a position where the group is bonded to the left-hand moiety in general formula (F); the mark ** represents a position where the group is bonded to the right-hand moiety in general formula (F); W represents an oxygen atom, a sulfur atom or a group of —N($R_{67}$)—; $R_{65}$ and $R_{66}$ each represents a hydrogen atom or a substituent group; $R_{67}$ represents a substituent group; and t represents 1 or 2 and when t is 2, two —W—C($R_{65}$)($R_{66}$)— groups may be the same or different. Typical examples of the substituent group represented by $R_{65}$, $R_{66}$ and $R_{67}$ include an $R_{69}$ group, an $R_{69}$CO— group, an $R_{69}SO_2$-group, an N($R_{69}$)($R_{70}$)CO— group and an N($R_{69}$) ($R_{70}$)$SO_2$— group wherein $R_{69}$ is an aliphatic group, an aromatic group or a heterocyclic group; and $R_{70}$ is an aliphatic group, an aromatic group, a heterocyclic group or a hydrogen atom. The cases where $R_{65}$, $R_{66}$ and $R_{67}$ are each a divalent group and are combined together to form a ring structure, are also included within the scope of the present invention.

(2) A group which causes a cleavage reaction by utilizing an intramolecular nucleophilic substitution reaction.

Examples of this group include the timing groups described in U.S. Pat. No. 4,248,962. The group can be represented by the following general formula:

*—Nu—Link—E—** wherein the mark * represents a position where the group is bonded to the left-hand moiety in general formula (F); the mark  represents a position where the group is bonded to the right-hand moiety in general formula (F); Nu represents a nucleophilic group (examples of the nucleophilic group include an oxygen atom and a sulfur atom); E represents an electrophilic group and is a group which is nucleophilically attacked by Nu to thereby cause the cleavage of a bond between the mark  and E; and Link represents a bonding group which sterically bonds Nu to E so that an intramolecular nucleophilic substitution reaction between Nu and E takes place.

(3) A group which cause a cleavage reaction by utilizing an electron transfer reaction along a conjugated system.

Examples of this group are described in U.S. Pat. Nos. 4,409,323 and 4,421,845. The group can be represented by the following general formula:

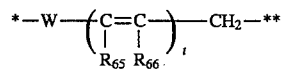

wherein the marks * and **, W, $R_{65}$, $R_{66}$, and t are as defined above.

(4) A group which utilizes a cleavage reaction by the hydrolysis of an ester

Examples of this group include the bonding groups represented by the following formulae as described in West German Patent OLS No. 2,626,315:

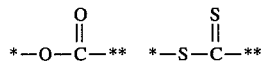

wherein the marks * and ** are as defined above.

(5) A group which utilizes the cleavage reaction of an iminoketal

Examples of this group include the bonding groups described in U.S. Pat. No. 4,546,073. The group can be represented by the following general formula:

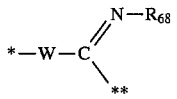

wherein the marks * and ** are as defined above; and $R_{68}$ has the same meaning as $R_{67}$.

Examples of Time, which is a coupler or a redox group, include the following cases.

When the coupler is a phenol type coupler, the coupler is bonded to G in general formula (F) through an oxygen atom of a residue formed by removing the hydrogen atom from a hydroxyl group. When the coupler is a 5-pyrazoline type coupler, the coupler is bonded to G through an oxygen atom of a residue formed by removing the hydrogen atom from a hydroxyl group of a 5-hydroxypyrazole in a tautomeric form. Each of these couplers functions as a coupler only when released from G, and each coupler reacts with the oxidation product of a developing agent, and X, which is bonded to Time at the coupling position, is released therefrom.

Preferred examples of Time, which is a coupler, include groups represented by the following general formulae:

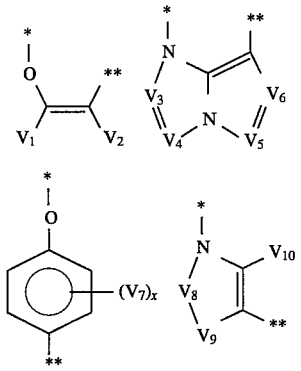

wherein $V_1$ and $V_2$ each represents a substituent group which can be the same substituent groups as those described previously for the redox mother nucleus; $V_3$, $V_4$, $V_5$ and $V_6$ each represents a nitrogen atom or a substituted or unsubstituted methine group; $V_7$ represents a substituent group which can be the same substituent groups as those described previously for the redox mother nucleus; x represents an integer of 0 to 4 and when x is two or greater, two or more $V_7$ groups may be the same or different, or two $V_7$ groups may be combined together to form a ring structure; $V_8$ represents an —CO— group, an —$SO_2$— group, an oxygen atom or a substituted imino group; $V_9$ represents a non-metallic atomic group for forming a 5- to 7-membered ring; and $V_{10}$ represents a hydrogen atom or a substituent group which can be the same substituent groups as those described previously for the redox mother nucleus.

When the group represented by Time is a redox group, a group represented by the following general formula is preferred:

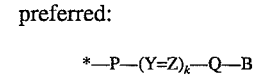

wherein P and Q represent independently an oxygen atom or a substituted or unsubstituted imino group; at least one or more of the Y and Z groups represents a methine group having at least one substituent group X, and the other Y and Z each represents a substituted or unsubstituted methine group or a nitrogen atom; k represents an integer of 1 to 3 (one or more Y and Z groups may be the same or different); and B represents a hydrogen atom or a group which is released by an alkali. The cases where the substituent groups of any two of P, Y, Z, Q and B are each a divalent group and are combined together to form a ring structure, are also included within the scope of the present invention. Examples of such cases include the cases where $(Y{=}Z)_k$ forms a benzene ring or a pyridine ring.

When P and Q each represents a substituted or unsubstituted imino group, it is preferred that P and Q are each a sulfonyl group- or an acyl group-substituted imino group. In this case, P and Q each can be represented by the following general formula:

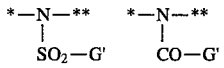

wherein the mark * represents a position where the group is bonded to G in general formula (F) or to B in the above general formula; the mark ** represents a position where the group is bonded to one of the free bonds of —$(Y{=}Z)_k$—; and the group represented by G' represents an aliphatic group, an aromatic group or a heterocyclic group.

Among the redox groups represented by *—P—$(Y{=}Z)_k$—Q—B, groups represented by the following formulae are particularly preferred:

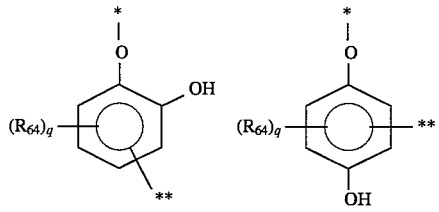

wherein the mark * represents a position where the group is bonded to G in general formula (F); the mark ** represents a position where the group is bonded to X; $R_{64}$ represents a substituent group which can be the same substituent groups as those described previously for the redox mother nucleus; and q represents an integer of 0 to 3, and when q is 2 or greater, two or more $R_{64}$ groups may be the same or different. The cases where two $R_{64}$ groups on neighboring carbon atoms are each a divalent group and are combined together to form a ring structure are also included within the scope of the present invention.

X represents a development inhibitor. Preferred examples of X include compounds where a mercapto group is attached to a heterocyclic ring represented by the following formula (X') and heterocyclic compounds capable of forming imino silver represented by the following general formula (X"):

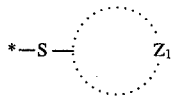

(X')

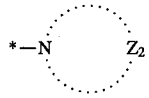

(X")

wherein $Z_1$ represents a non-metallic atomic group required for forming a monocyclic or condensed ring heterocyclic ring; and $Z_2$ represents a non-metallic atomic group required for forming a monocyclic or condensed ring heterocyclic ring together with N. These heterocyclic rings may have one or more substituent groups. The mark * represents a position where the group is bonded to Time. More preferably, the heterocyclic ring represented by $Z_1$ or $Z_2$ is a 5- to 8-membered heterocyclic ring having at least one hetero-atom of nitrogen, oxygen, sulfur or selenium. Among them, a 5- or 6-membered heterocyclic ring is most preferred.

Examples of the heterocyclic ring represented by $Z_1$ include azoles (e.g., tetrazole, 1,2,4-triazole, 1,2,3-triazole, 1,3,4-thiadiazole, 1,3,4-oxadiazole, 1,3-thiazole, 1,3-oxazole, imidazole, benzthiazole, benzoxazole, benzimidazole, pyrrole, pyrazole, indazole), azaindenes (e.g., tetraazaindene, pentaazaindene, triazaindene) and azines (e.g., pyrimidine, triazine, pyrazine, pyridazine).

Examples of the heterocyclic ring represented by $Z_2$ include triazoles (e.g., 1,2,4-triazole, benztriazole, 1,2,3-triazole), indazole, benzimidazole, azaindenes (e.g., tetraazaindene, pentaazaindene) and tetrazole.

These heterocyclic rings may have one or more substituent groups. Preferred examples of the substituent groups for the development inhibitors (e.g., the compounds where a mercapto group is attached to heterocyclic ring and the heterocyclic compounds capable of forming imino silver) represented by the above general formulas include an $R_{77}$ group, an $R_{78}O$— group, an $R_{77}S$— group, an $R_{77}OCO$— group, an $R_{77}OSO_2$— group, a halogen, a cyano group, a nitro group, an $R_{77}SO_2$— group, an $R_{78}CO$— group, an $R_{77}COO$— group,

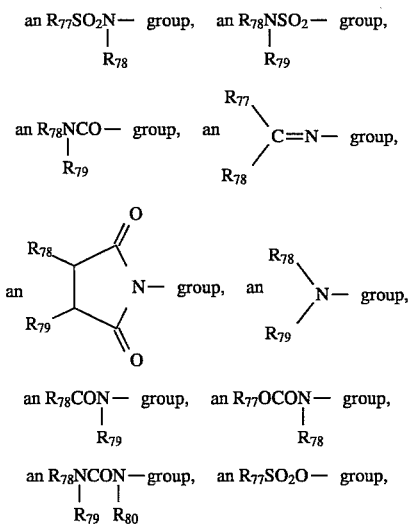

-continued

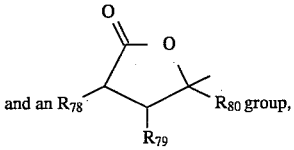

wherein $R_{77}$ represents an aliphatic group, an aromatic group or a heterocyclic group; and $R_{78}$, $R_{79}$, and $R_{80}$ each represents an aliphatic group, an aromatic group, a heterocyclic group or a hydrogen atom. When one molecule has two or more $R_{77}$, $R_{78}$, $R_{79}$, and $R_{80}$ groups, they may be combined together to form a ring (e.g., benzene ring).

Examples of the compounds where a mercapto group is attached to a heterocyclic ring, as represented by the above general formula, include substituted or unsubstituted mercaptoazoles (e.g., 1-phenyl-5-mercaptotetrazole, 1-propyl-5-mercapto-tetrazole, 1-butyl-5-mercaptotetrazole, 2-methylthio-5-mercapto-1,3,4-thiadiazole, 3-methyl-4-phenyl-5-mercapto-1,2,4-triazole, 1-( 4-ethylcarbamoylphenyl)-2-mercaptoimidazole, 2-mercaptobenzoxazole, 2-mercaptobenzimidazole, 2-mercaptobenzthiazole, 2-mercaptobenzoxazole, 2-phenyl-5-mercapto- 1,3,4-oxadiazole, 1-{3-(3-methylureido)phenyl}- 5-mercaptotetrazole, 1-(4-nitrophenyl)-5-mercaptotetrazole, 5-(2-ethylhexanoylamino)-2-mercaptobenzimidazole), substituted or unsubstituted mercaptoazaindenes (e.g., 6-methyl-4-mercapto-1,3,3a,7-tetrazaindene, 4,6-dimethyl- 2-mercapto-1,3,3a,7-tetrazaindene) and substituted or unsubstituted mercaptopyrimidines (e.g., 2-mercaptopyrimidine, 2-mercapto-4-methyl-6-hydroxypyrimidine).

Examples of the heterocyclic compounds capable of forming imino silver include substituted or unsubstituted triazoles (e.g., 1,2,4-triazole, benztriazole, 5-methylbenztriazole, 5-nitrobenztriazole, 5-bromobenztriazole, 5-n-butylbenztriazole, 5,6-dimethylbenztriazole), substituted or unsubstituted indazoles (e.g., indazole, 5-nitroindazole, 3-nitroindazole, 3-chloro-5-nitroindazole) and substituted or unsubstituted benzimidazoles (e.g., 5-nitrobenzimidazole, 5,6-dichlorobenzimidazole).

X may be such a group that X is released from Time in general formula (F) and becomes a compound having a development inhibiting effect. X then takes part in certain chemical reactions with ingredients in a developing solution and is converted into a compound which has substantially no development inhibiting effect or has a greatly reduced such an effect. Examples of functional groups which undergo such chemical reactions include an ester group, a carbonyl group, an imino group, an immonium group, a Michael addition accepting group and an imido group.

Examples of such deactivation type development inhibitors include residues of inhibitors described in U.S. Pat. No. 4,477,563, JP-A-60-218644,JP-A-60-221750, JP-A-60-233650 and JP-A-61-11743.

Among them, those having an ester group are preferred. Specific examples thereof include 1-(3-phenoxycarbonylphenyl)- 5-mercaptotetrazole, 1-(4-phenoxycarbonylphenyl)- 5-mercaptotetrazole, 1-(3-maleinimidophenyl)- 5-mercaptotetrazole, 5-phenoxycarbonylbenztriazole, 5-(4-cyanophenoxycarbonyl)benztriazole, 2-phenoxycarbonylmethylthio-5-mercapto-1,3-4-thiadiazole, 5-nitro-3-phenoxycarbonylimidazole, 5-(2,3-dichloropropyloxycarbonyl)benztriazole, 1-(4-benzoyloxyphenyl)-5-mercaptotetrazole, 5-(2-methanesulfonylethoxycarbonyl)-2-mercaptobenzthiazole, 5-cinnamoylaminobenztriazole, 1-(3-vinylcarbonylphenyl)-5-mercaptotetrazole, 3-succinimidomethylbenztriazole, 2-{4-succinimidophenyl}- 5-mercapto-1,3,4-oxadiazole, 6-phenoxycarbonyl- 2-mercaptobenzoxazole, 2-(1-methoxycarbonylethylthio)- 5-mercapto-1,3,4-thiadiazole, 2-butoxycarbonylmethoxycarbonylmethylthio- 5-mercapto-1,3,4-thiadiazole, 2-(N-hexylcarbamoylmethoxycarbonylmethylthio)- 5-mercapto- 1,3,4-thiadiazole and 5-butoxycarbonylmethoxycarbonylbenztriazole.

Among the compounds of general formula (F), compounds represented by the following general formulae (G) and (H) are more preferred:

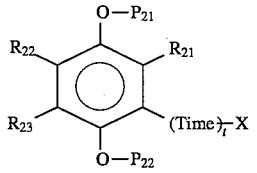

(G)

wherein $R_{21}$ to $R_{23}$ each represents a hydrogen atom or a group which can be attached to a hydroquinone nucleus; $P_{21}$ and $P_{22}$ each represents a hydrogen atom or a protective group which can be removed during development; and Time, X and t are the same as those set forth in general formula (F);

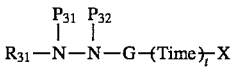

(H)

wherein $R_{31}$ represents an aryl group, a heterocyclic group, an alkyl group, an aralkyl group, an alkenyl group or an alkynyl group; $P_{31}$ and $P_{32}$ represent a hydrogen atom or a protective group which can be removed during development; and G, Time, X and t are the same as those set forth in general formula (F).

The compounds of general formula (G) will be illustrated in more detail below.

Examples of substituent groups represented by $R_{21}$ to $R_{23}$ include those described above in the definition of the substituent groups for A in general formula (F).

$R_{22}$ to $R_{23}$ are each preferably a hydrogen atom, an alkylthio group, an arylthio group, an alkoxy group, an aryloxy group, an amido group, a sulfonamido group, an alkoxycarbonylamino group or a ureido group. More preferably, $R_{22}$ and $R_{23}$ are each a hydrogen atom, an alkylthio group, an alkoxy group, an amido group, a sulfonamido group, an alkoxycarbonylamino group or a ureido group.

$R_{21}$ is preferably a hydrogen atom, a carbamoyl group, an alkoxycarbonyl group, a sulfamoyl group, a sulfonyl group, a cyano group, an acyl group or a heterocyclic group. More preferably, $R_{21}$ is a hydrogen atom, a carbamoyl group, an alkoxycarbonyl group, a sulfamoyl group or a cyano group. $R_{22}$ and $R_{23}$ may be combined together to form a ring.

Examples of the protective group represented by $P_{21}$ and $P_{22}$ include those described above in the definitions of the protective groups for A in general formula (F). Preferred examples of the protective group include hydrolyzable groups such as an acyl group, an alkoxycarbonyl group, an aryloxycarbonyl group, a carbamoyl group, an imidoyl group, an oxazolyl group and a sulfonyl group; precursor groups of a type utilizing a reverse Michael reaction as described in U.S. Pat. No. 4,009,029; precursor groups of a type utilizing, as an intramolecular nucleophilic group, an anion formed by a ring cleavage reaction as described in U.S. Pat. No. 4,310,612; precursor groups which cause a cleavage reaction by the electron transfer of an anion through a conjugated system as described in U.S. Pat. Nos. 3,674,478, 3,932,480 and 3,993,661; precursor groups which cause a cleavage reaction by the electron transfer of an anion after a ring cleavage reaction as described in U.S. Pat. No. 4,335,200; and precursor groups utilizing an imidomethyl group described in U.S. Pat. Nos. 4,363,865 and 4,410,618.

Preferably, $P_{21}$ and $P_{22}$ are each a hydrogen atom.

Preferred examples of x are mercaptoazoles and benztriazoles. More preferred are mercaptotetrazoles, 5-mercapto-1,3,4-thiadiazoles and 5-mercapto-1,3,4-oxadiazoles as the mercaptoazoles.

Most preferred are 5-mercapto-1,3,4-thiadiazoles as X.

Among the compounds of general formula (G), compounds represented by the following general formulae (I) and (J) are preferred:

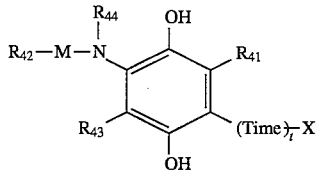

(I)

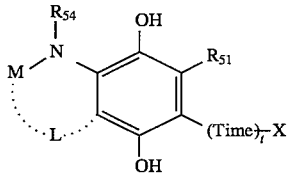

(J)

wherein $R_{42}$ represents an aliphatic group, an aromatic group or a heterocyclic group; M represents $$-\overset{O}{\overset{\|}{C}}-,\quad -SO_2-,\quad -\overset{R_{45}}{\overset{|}{N}}-\overset{O}{\overset{\|}{C}}-,\quad -O-\overset{O}{\overset{\|}{C}}-,\ \text{or}\ -\overset{R_{45}}{\overset{|}{N}}-SO_2-;$$

$R_{44}$, $R_{45}$ and $R_{54}$ each represents a hydrogen atom, an alkyl group or an aryl group; L represents a divalent linking group required for forming a 5- to 7-membered ring; $R_{41}$ and $R_{51}$ each has the same meaning as $R_{21}$ in general formula (G); $R_{43}$ has the same meaning as $R_{23}$ in general formula (G); and $-(Time)_t-X$ has the same meaning as $-(Time)_t-X$ in general formula (G). $R_{42}$ will be described in more detail. The aliphatic group represented by $R_{42}$ is a straight-chain, branched or cyclic alkyl, alkenyl or alkynyl group having 1 to 30 carbon atoms. The aromatic group is an aryl group having 6 to 30 carbon atoms such as a phenyl group or a naphthyl group. The heterocyclic group is a 3- to 12-membered heterocyclic group having at least one hetero-atom of nitrogen, oxygen or sulfur. These may have one or more substituent groups. Examples of the substituent groups include those described above in the definition of the substituent groups for A.

The compounds of general formula (H) will be described in more detail below.

The aryl group represented by $R_{31}$ has 6 to 30 carbons and includes phenyl and naphthyl. The heterocyclic group is a 5- to 7-membered heterocyclic group having at least one hetero-atom of nitrogen, oxygen or sulfur and includes furyl and pyridyl. The alkyl group has 1 to 30 carbon atoms and includes methyl, hexyl and octadecyl. The aralkyl group has 7 to 30 carbon atoms and includes benzyl and trityl. The alkenyl group has 2 to 30 carbon atoms and includes allyl. The alkynyl group has 2 to 30 carbon atoms and include, for example, a propargyl group. $R_{31}$ is preferably an aryl group and more preferably a phenyl group.

Examples of the protective group represented by $P_{31}$ and $P_{32}$ include those described above in the definition of the protective groups for A in general formula (F). $P_{31}$ and $P_{32}$ are preferably a hydrogen atom.

G is preferably —CO—, and preferred examples of X include those described above in general formula (G).

$R_{21}$ and $R_{23}$ in general formula (G) and $R_{31}$ in general formula (H) may be substituted. Substituent groups may have a ballast group or an adsorptive group to impart nondiffusibility, and the ballast group is preferred. When $R_{31}$ is a phenyl group, electron donating groups are preferred as the substituent groups. Examples of the electron donating groups include a sulfonamido group, an amido group, an alkoxy group and a ureido group. When $R_{21}$, $R_{22}$, $R_{23}$ or $R_{31}$ has a ballast group, it is particularly preferred that the compounds have a polar group such as a hydroxyl group, a carboxy group or a sulfo group in the molecular structure.

Examples of the compounds of general formula (F) include, but are not limited to, the following compounds:

I-1

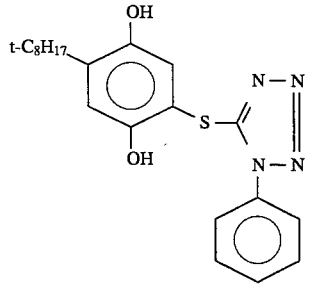

I-2

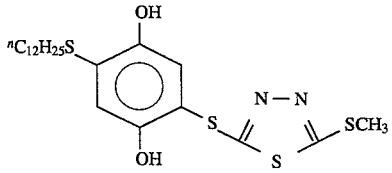

I-3

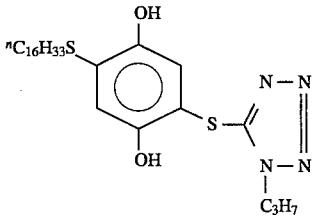

I-4

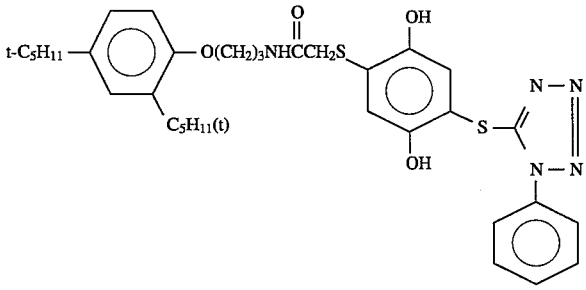

I-5

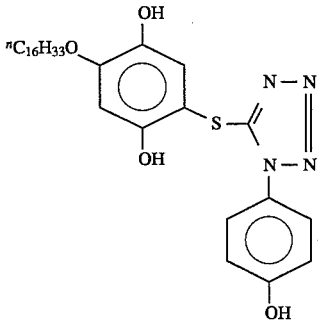

I-6

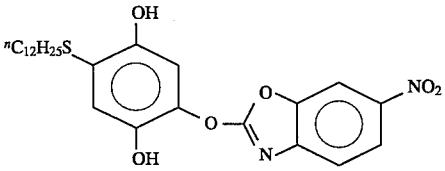

I-7

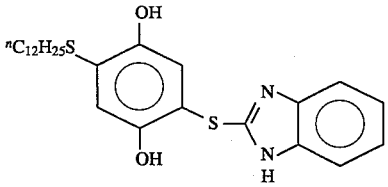

I-8

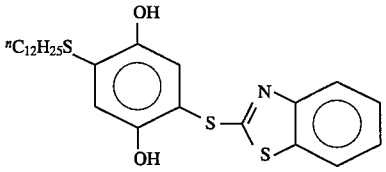

-continued
I-9
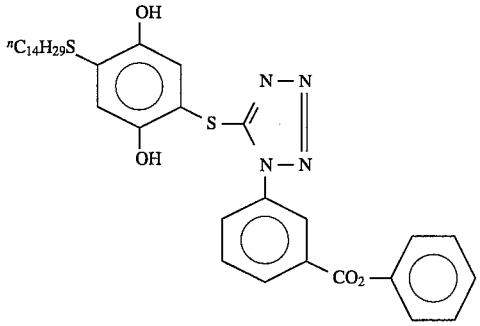
I-10
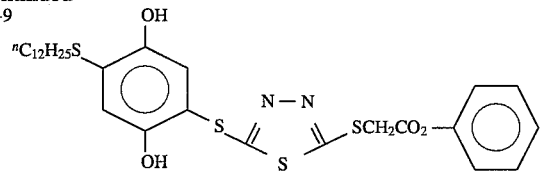
I-11
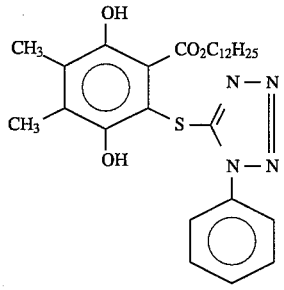
I-12
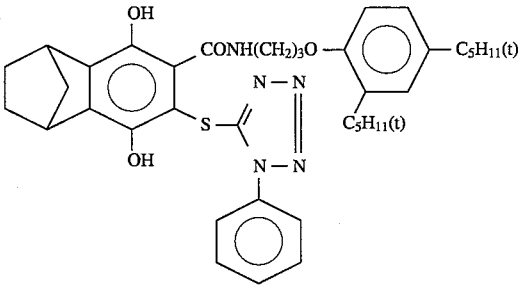
I-13
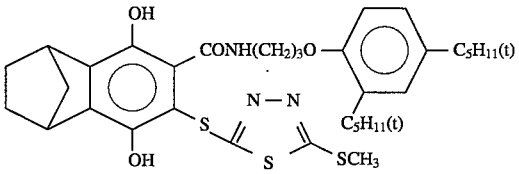
I-14
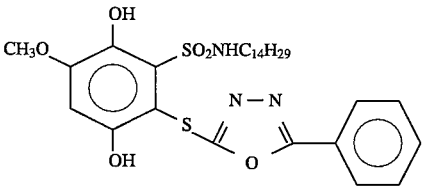
I-15
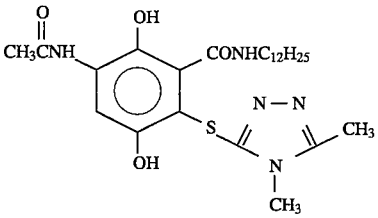
I-16
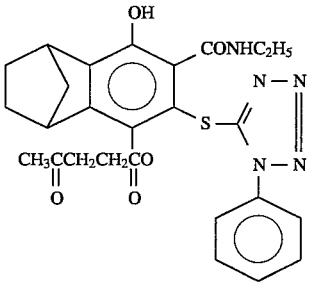
I-17
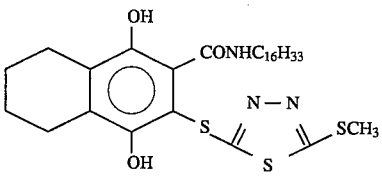
I-18
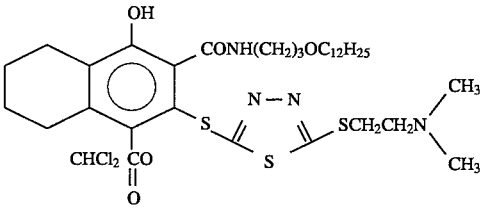
I-19
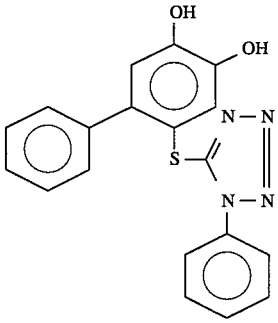
I-20
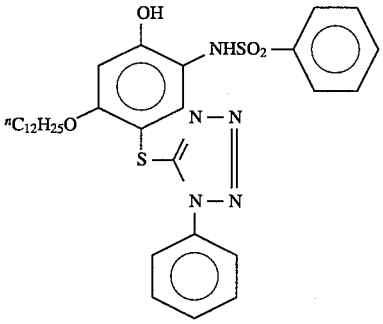

-continued
I-21
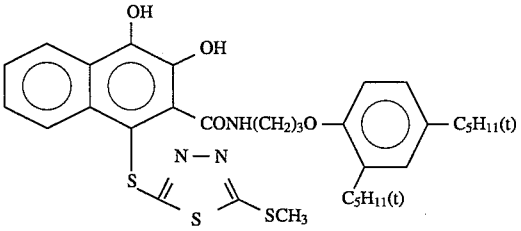
I-22
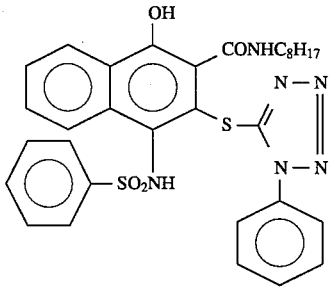
I-23
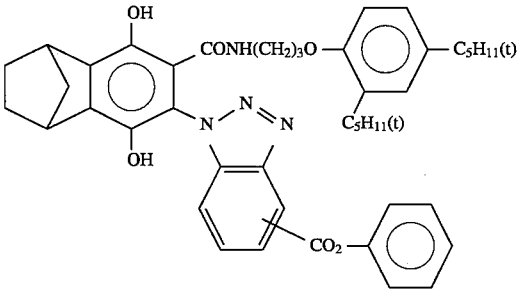
I-24
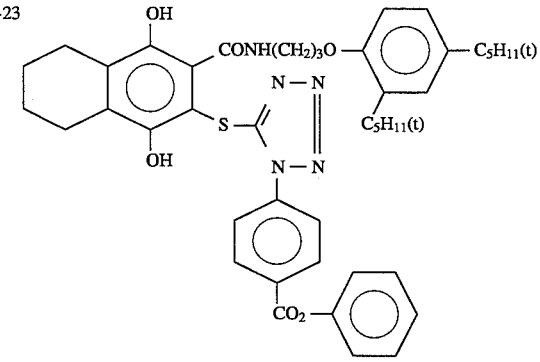
I-25
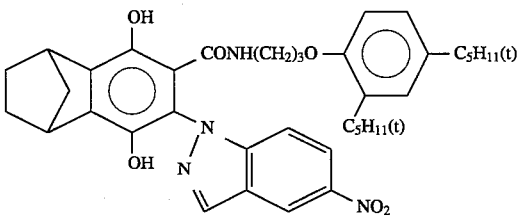
I-26
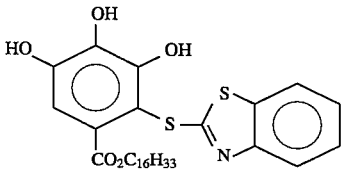
I-27
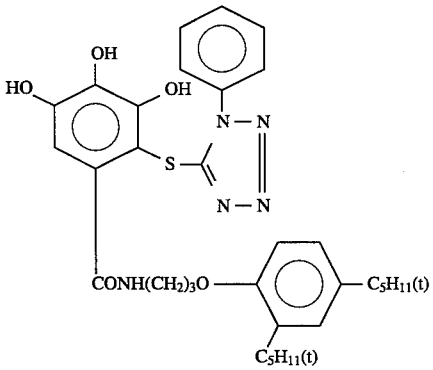
I-28
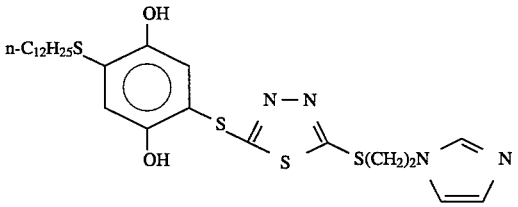
I-29
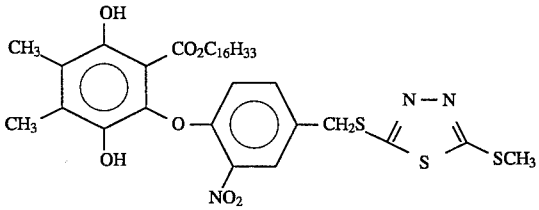

-continued
I-30
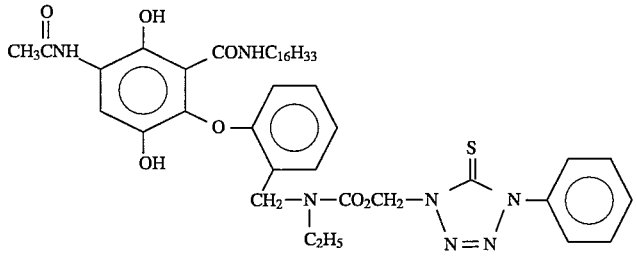
I-31
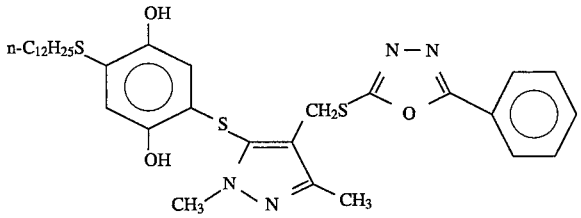
I-32
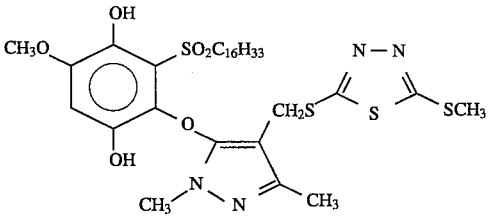
I-33
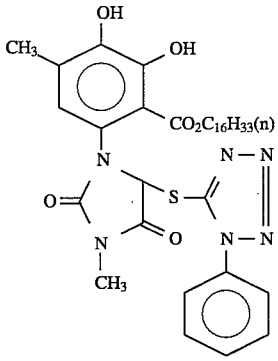
I-34
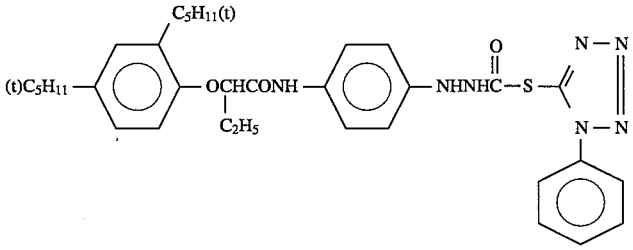
I-35
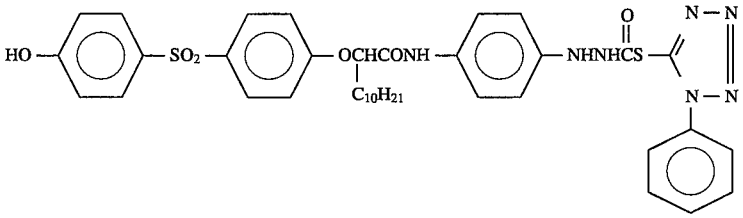
I-36
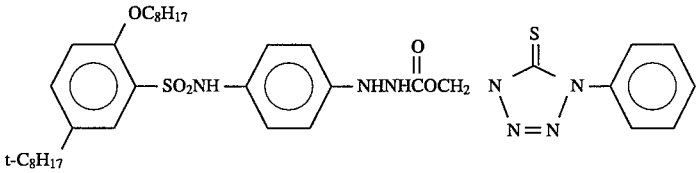

-continued
I-37
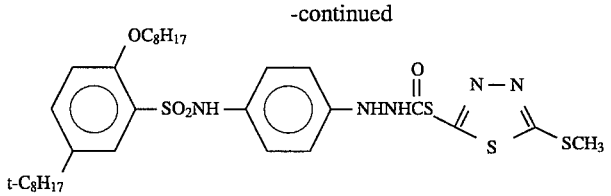
I-38
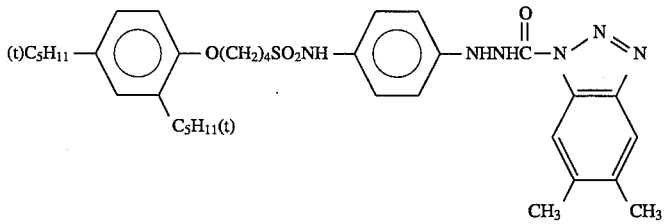
I-39
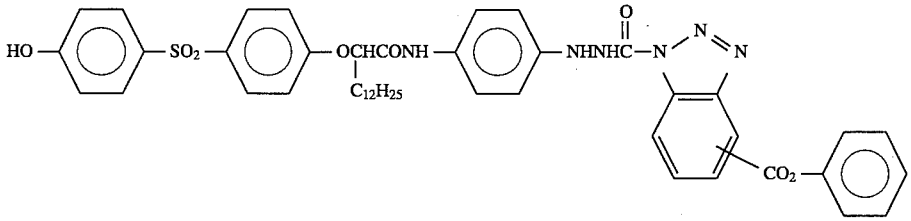
I-40
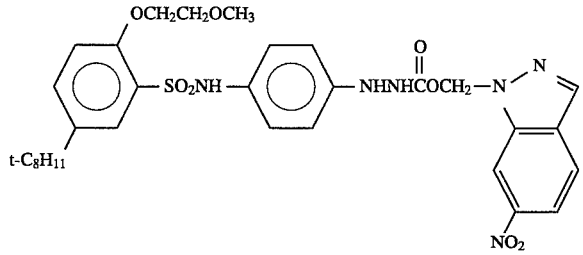
I-41
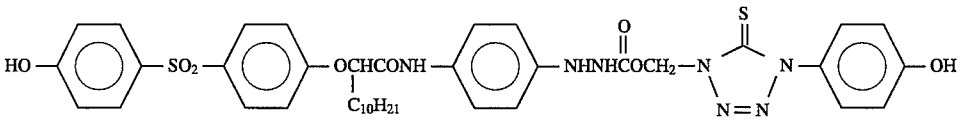
I-42
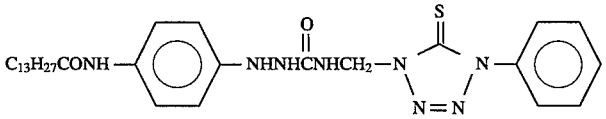
I-43
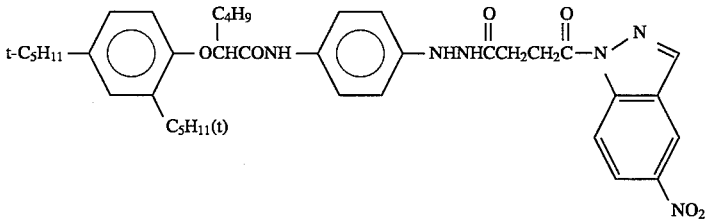
I-44
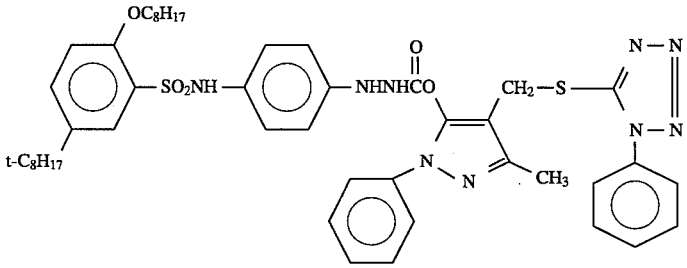

-continued
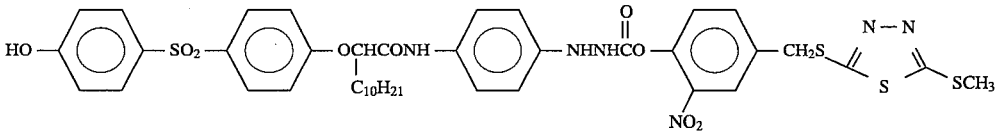
I-45
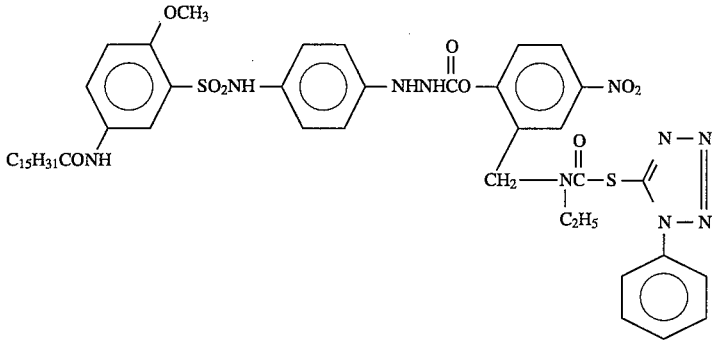
I-46
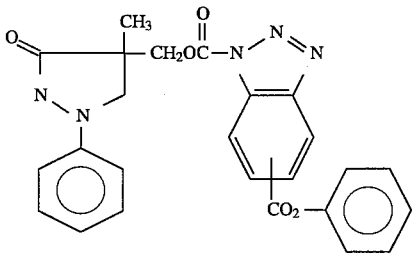
I-47
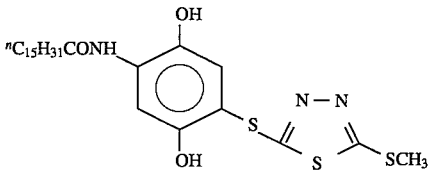
I-48
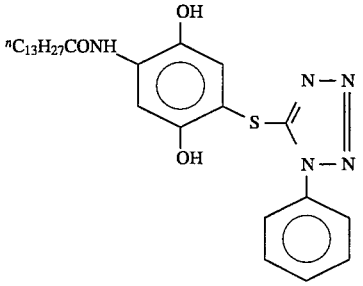
I-49
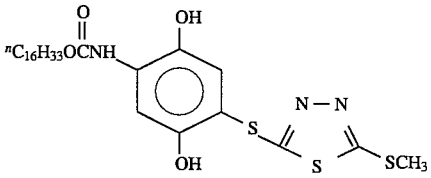
I-50
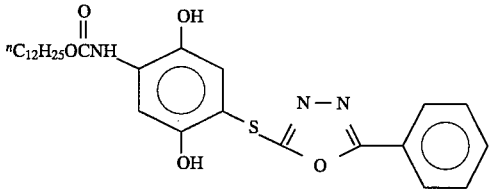
I-51
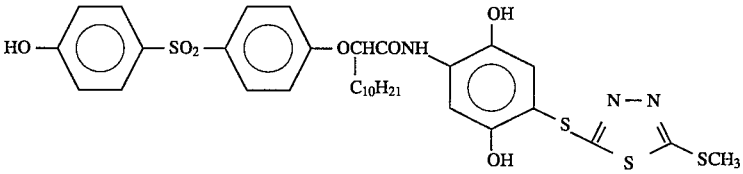
I-52

-continued
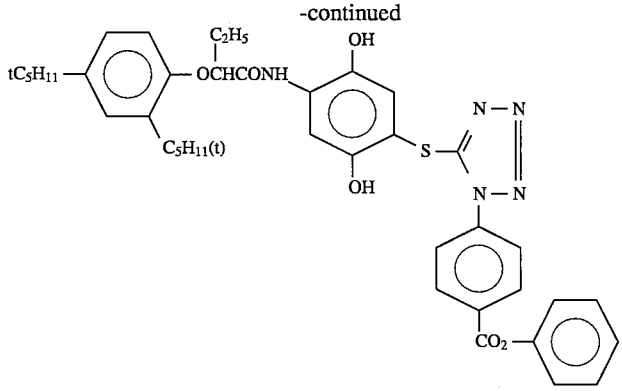
I-53
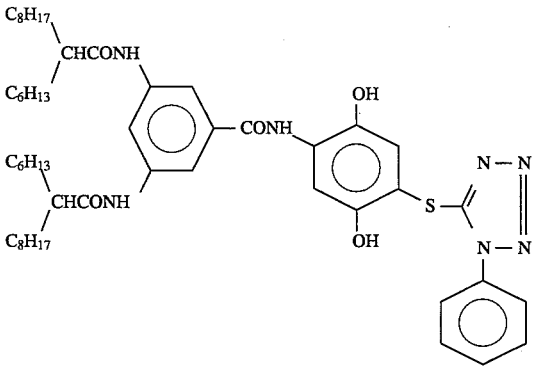
I-54
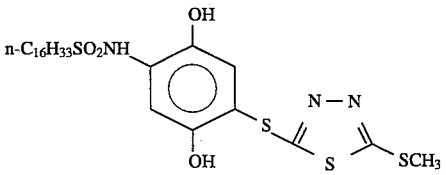
I-55
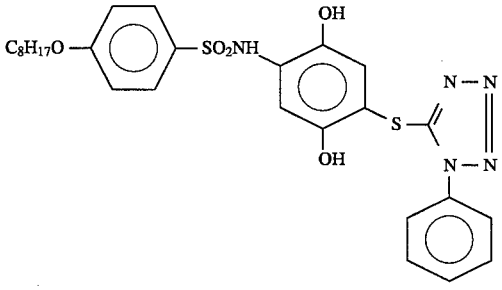
I-56
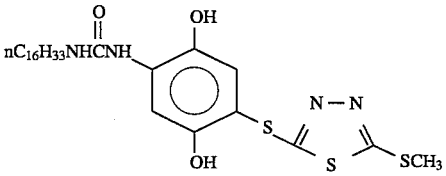
I-57
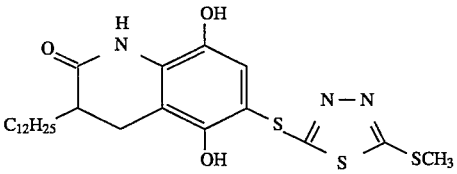
I-58
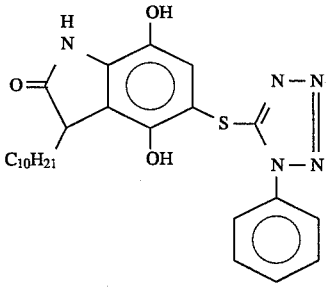
I-59
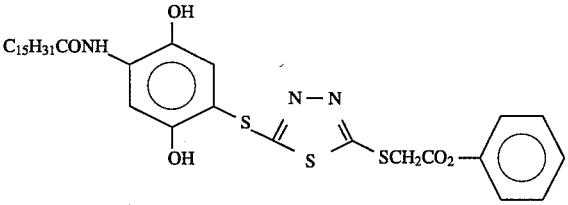
I-60

-continued
I-61
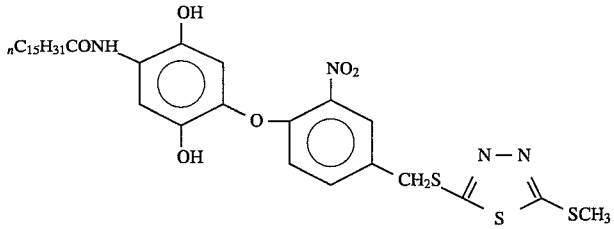
I-62
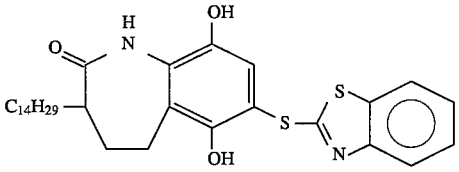
I-63
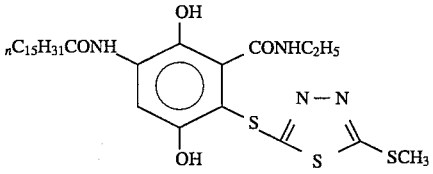
I-64
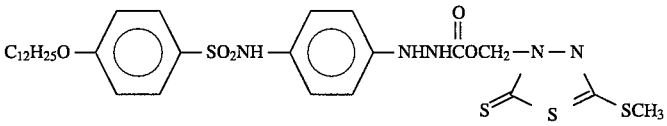
I-65
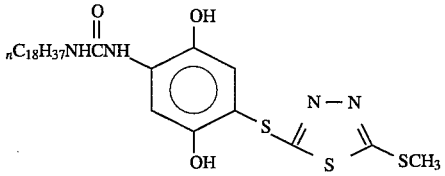
I-66
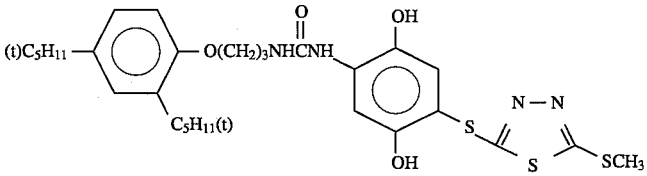
I-67
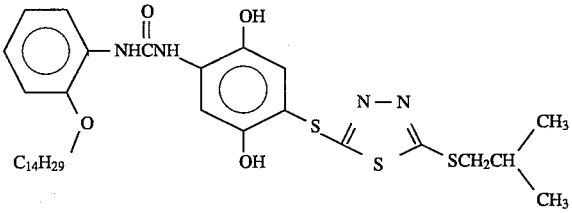
I-68
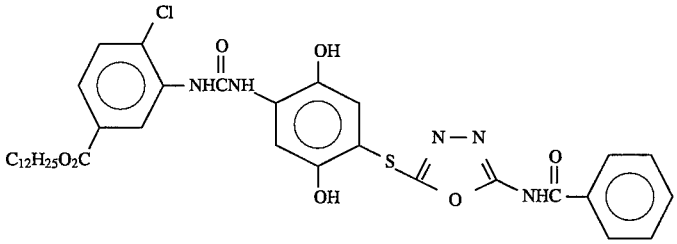

-continued
I-69
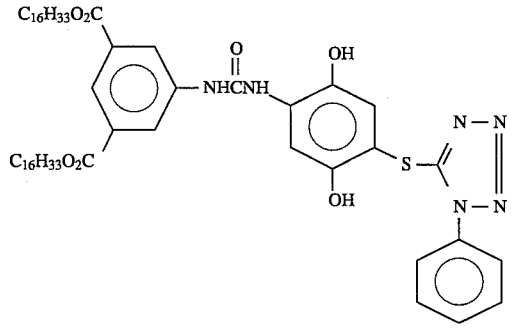
I-70
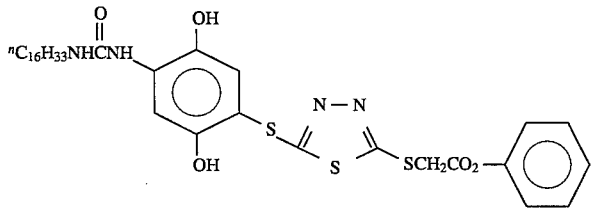
I-71
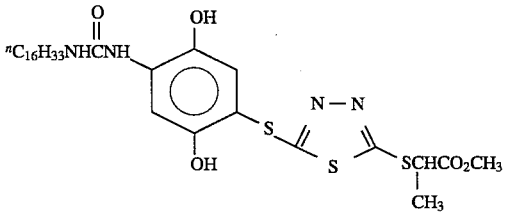
I-72
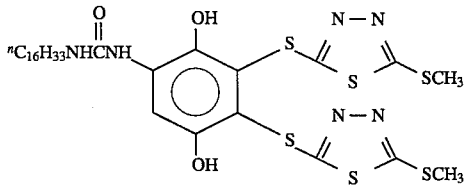
I-73
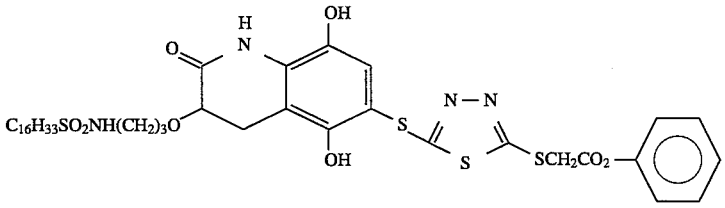
I-74
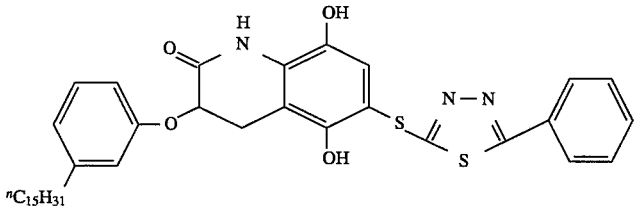
I-75
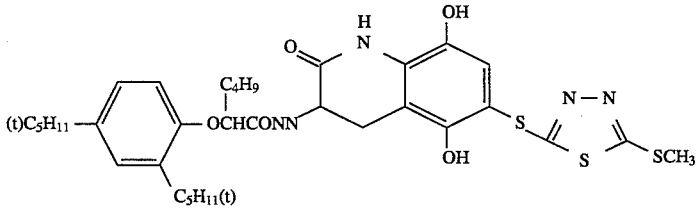
I-76
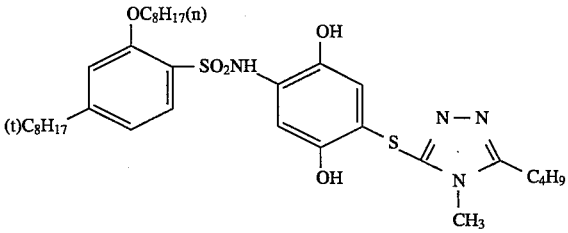

-continued
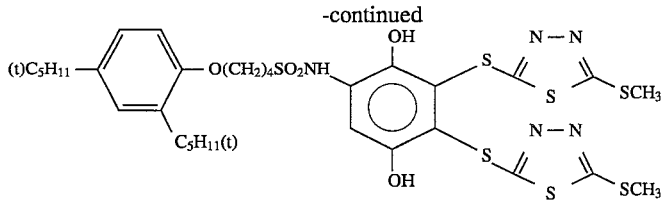
I-77
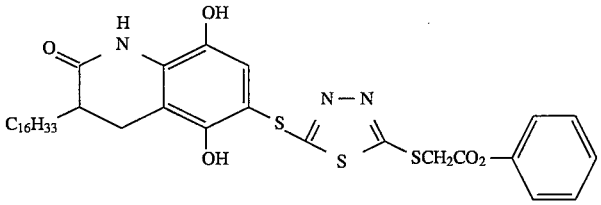
I-78
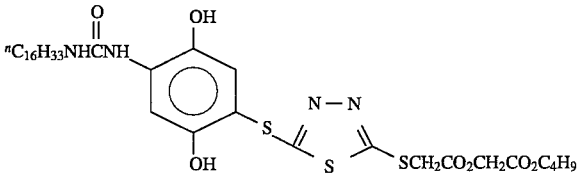
I-79
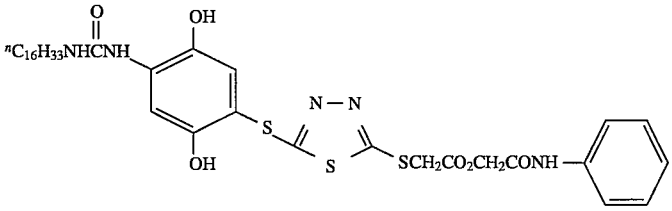
I-80
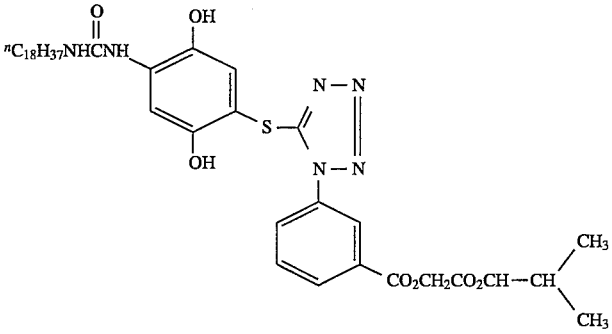
I-81
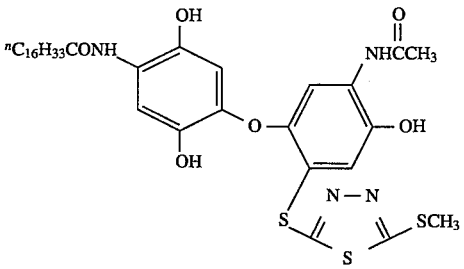
I-82
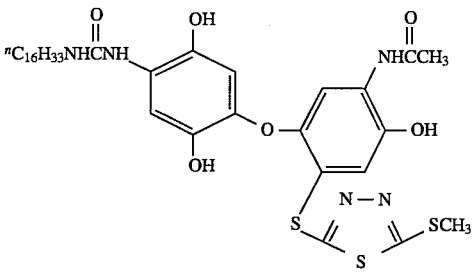
I-83

-continued

I-84

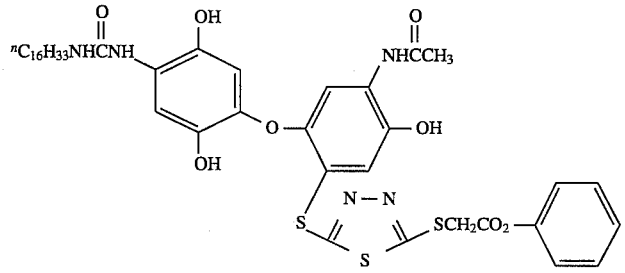

I-85

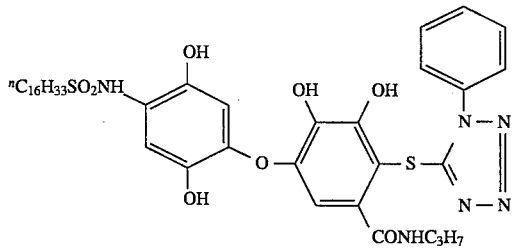

I-86

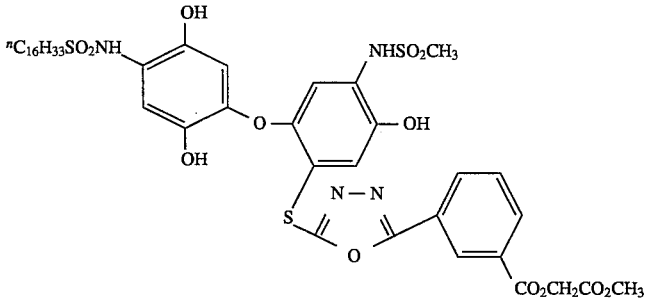

I-86

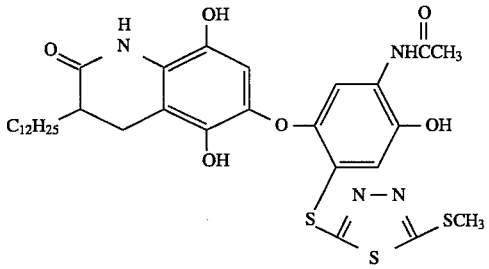

I-87

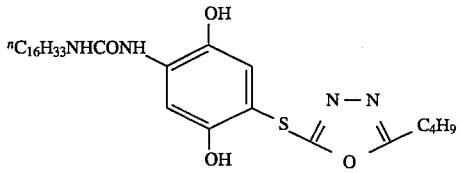

The compounds of general formula (F) according to the present invention can be synthesized according to the methods described in JP-A-49-129536, JP-A-52-57828, JP-A-60-21044, JP-A-60-233642, JP-A-60-233648, JP-A-61-18946, JP-A-61-156043, JP-A-61-213847, JP-A-61-230135, JP-A-61-236549, JP-A-62-62352, JP-A-62-103639, and U.S. Pat. Nos. 3,379,529, 3,620,746, 4,332,828, 4,377,634 and 4,684,604.

The compounds of general formula (F) may be added to arbitrary emulsion layers and/or non-sensitive layers or both layers. The compounds are used in an amount of preferably 0.001 to 0.2 mmol/$m^2$, more preferably 0.01 to 0.1 mmol/$m^2$.

The yellow couplers of general formulae (1) to (5) according to the present invention are used in an amount of 1.0 to $1.0\times10^{-3}$ mol, preferably $5.0\times10^{-1}$ to $2.0\times10^{-2}$ mol, more preferably $4.0\times10^{-1}$ to $5.0\times10^{-2}$ mol per mol of silver halide.

The yellow couplers of general formulae (1) to (5) according to the present invention may be used in combination with two or more of them or together with other conventional couplers.

The couplers of general formulae (1) to (5) can be introduced into color light-sensitive materials by various conventional dispersion methods.

When oil-in-water dispersion methods are used, there may be used methods wherein organic solvents (e.g., ethyl acetate, butyl acetate, methyl ethyl ketone, propanol) are used, and a fine dispersion is coated to thereby allow substantially no low boiling point organic solvent to be left behind in a dry layer. When high-boiling point organic solvents are used, there can be used any organic solvent having a boiling point of not lower than 175° C. under atmospheric pressure. The high-boiling point organic solvents may be used either alone or as a mixture of two or more of them. The ratio of the coupler of the present invention to the high-boiling point organic solvent can be widely varied, but is generally not higher than 5.0 by weight per gram of the coupler, preferably 0 to 2.0, more preferably 0.01 to 1.0 by weight per gram of the coupler.

Latex dispersion methods described hereinafter can be used.

Further, the couplers of the present invention may be mixed with or may be allowed to coexist with various couplers or compounds described hereinafter.

Each dispersion of cyan, magenta and yellow couplers in the present invention can contain the high-boiling organic solvent having a boiling point of not lower than 150° C. in a ratio represented by the following formula:

$$0 \leqq \text{High-boiling point organic solvent (weight)/coupler (weight)} \leqq 1.0$$

The ratio is preferably not higher than 0.7, more preferably not higher than 0.5 from the viewpoint of improving sharpness and the strength of layers.

The amount of the high-boiling point organic solvent refers to the amount of the organic solvent co-emulsified.

The light-sensitive material of the present invention may comprise a support having thereon at least one silver halide emulsion layer of a blue color-sensitive layer, a green color sensitive layer and/or a red color-sensitive layer. There is no particular limitation with regard to the number of silver halide emulsion layers and non-sensitive layers and the order of layers. A typical example of the light-sensitive material is a silver halide photographic material comprising a support having thereon at least one light-sensitive layer comprising a plurality of silver halide emulsion layers having substantially the same color sensitivity, but different light sensitivity. The light-sensitive layer is a unit light-sensitive layer having color sensitivity to any one of blue light, green light and red light. In a multi-layer silver halide color photographic material, the arrangement is generally made in an order of a red color-sensitive layer, a green color-sensitive layer and a blue color-sensitive layer from the side of the support. However, the arrangement may be made in the reverse order to that described above according to intended purpose. There may be used such an arrangement that between layers having the same color sensitivity, there is interposed a light-sensitive layer having different color sensitivity.

Non-sensitive layers such as interlayers may be provided between the silver halide light-sensitive layers or as the uppermost layer and the lowermost layer.

The interlayers may contain couplers, DIR compounds, etc., described in JP-A-61-43748, JP-A-59- 113438, JP-A-59-113440, JP-A-61-20037 and JP-A-61-20038, and the interlayers may contain conventional color mixing inhibitors.

A plurality of the silver halide emulsion layers which form each light-sensitive layer are preferably in the form of a double layer structure composed of a high-sensitivity emulsion layer and a low-sensitivity emulsion layer as described in West German Patent 1,121,470 or U.K. Patent 923,045. Generally, it is preferred that the emulsion layers are so arranged that light sensitivity is lowered in turn toward the support. A non-sensitive layer may be provided between the silver halide emulsion layers. The low-sensitivity emulsion layer may be provided on the side which is farther away from the support, and the high-sensitivity emulsion layer may be provided on the side which is nearer the support as described in JP-A-57-112751, JP-A-62-200350, JP-A-62-206541 and JP-A-62-206543.

More specifically, the arrangement may be made in order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), in order of BH/BL/GL/GH/RH/RL or in order of BH/BL/GH/GL/RL/RH from the side which is farthest away from the support.

The arrangement may be made in order of blue-sensitive layer/GH/RH/GL/RL from the side which is farthest away from the support as described in JP-B-55- 34932. The arrangement may be made in order of blue-sensitive layer/GL/RL/GH/RH from the side which is farthest away from the support as described in JP-A-56- 25738 and JP-A-62-63936.

Further, there may be used an arrangement of a three layer structure composed of three layers having different light sensitivity wherein light sensitivity is lowered in turn toward the support in such a way that the upper layer is a silver halide emulsion layer having the highest light sensitivity, the intermediate layer is a silver halide emulsion layer having light sensitivity lower than that of the upper layer, and the lower layer is a silver halide emulsion layer having light sensitivity lower than that of the intermediate layer as described in JP-B-49-15495. In the case of such a three layer structure composed of three layers having different sensitivity, the arrangement may also be made in a unit layer having the same color sensitivity in order of intermediate-sensitivity emulsion layer/high-sensitivity emulsion layer/low-sensitivity emulsion layer from the side which is farther away from the support as described in JP-A-59-202464.

Further, the arrangement may be made in order of high-sensitivity emulsion layer/low-sensitivity emulsion layer/intermediate-sensitivity emulsion layer or in order of low-sensitivity emulsion layer/intermediate-sensitivity emulsion layer/high-sensitivity emulsion layer. Furthermore, a four or more layer structure may be used, and various arrangements may be made as described above.

It is preferred that a donor layer (CL) having an interlayer effect having a spectral sensitivity distribution different from that of principal light-sensitive layers such as BL, GL and RL as described in U.S. Pat. Nos. 4,663,271, 4,705,744 and 4,707,436, JP-A- 62-160448 and JP-A-63-89850 is arranged adjacent to or close to principal light-sensitive layers to improve color reproducibility.

As mentioned above, various layer structures and arrangements can be chosen according to the purposes of the light-sensitive materials.

Preferred silver halides to be contained in the photographic emulsion layers of the photographic materials of the present invention are silver iodobromide, silver iodochloride and silver iodochlorobromide, each having a silver iodide content of about not higher than 30 mol %. Particularly preferred are silver iodobromide and silver iodochlorobromide, each having a silver iodide content of about 2 mol % to about 10 mol %.

Silver halide grains in the photographic emulsions may have a regular crystal form such as cube, octahedron or tetradecahedron, an irregular crystal form such as a spherical form or a plate form, a form having crystal defects such as a twinning plane or a composite form thereof.

With regard to the grain size of silver halide, grains may range from fine grains having a grain size of not larger than about 0.2 μm to large-size grains having a grain size of about 10 μm in terms of a diameter of a circle having an area equal to the projected area of the grain. Any polydisperse emulsion and monodisperse emulsion may be used.

Silver halide photographic emulsions which can be used in the present invention can be prepared, for example, by the methods described in *Research Disclosure* (RD) No. 17643 (December 1978), pp. 22–23, "I. Emulsion Preparation and Types"; *Research Disclosure* No. 18716 (November 1979), page 648; *Research Disclosure* No. 307105 (November 1989) pp. 863–845; P. Glafkides, *Chemie et Phisique Photographique* (Paul Montel 1967); G. F. Duffin, *Photographic*

*Emulsion Chemistry* (Focal press 1966); and V. L. Zelikman et al., *Making and Coating Photographic Emulsion* (Focal Press 1964).

Monodisperse emulsions described in U.S. Pat. Nos. 3,574,628 and 3,655,394 and U.K. Patent 1,413,748 are also preferred.

Tabular grains having an aspect ratio of not lower than about 3 can also be used in the present invention. The tabular grains can be easily prepared according to the methods described in Gutoff, *Photographic Science and Engineering*, Vol. 14, pp. 248–257 (1970); U.S. Pat. Nos. 4,434,226, 4,414,310, 4,433,048 and 4,439,520 and U.K. Patent 2,112, 157.

Crystal structure may be uniform, or the interior of the grain and the surface layer thereof may be different in halogen composition. The crystal structure of the grain may be a laminar structure. Silver halide grains having different halogen compositions may be joined together by epitaxial growth. Silver halide grains may be joined to a compound other than silver halide, such as silver thiocyanate or lead oxide. Mixtures of grains having various crystal forms may be used.

The above-described emulsions may be any of a surface latent image type emulsion wherein a latent image is predominantly formed on the surface of the grain, and an internal latent image type emulsion wherein a latent image is predominantly formed in the interior of the grain. However, the emulsions must be a negative type emulsion. The internal latent image type emulsion may be a core/shell type internal image type emulsion as described in JP-A-63-264740. Methods for preparing the core/shell type internal latent image type emulsion are described in JP-A-59-133542. The thickness of the shell of the grain in the emulsion varies depending on development conditions, etc., but is preferably 3 to 40 nm, particularly preferably 5 to 20 nm.

The silver halide emulsions are generally subjected to physical ripening, chemical ripening and spectral sensitization. Additives used in these stages are described in *Research Disclosure* No. 17643, ibid. No. 18716 and ibid. 307105, and the locations of these disclosures are summarized in the Table described hereinafter.

Two or more light-sensitive silver halide emulsions having different properties in at least one of grain size, grain size distribution, halogen composition, grain form and sensitivity may be mixed and used in the same layer of the light-sensitive material of the present invention.

Silver halide grains wherein the surfaces of the grains are fogged as described in U.S. Pat. No. 4,082,553; silver halide grains wherein the interiors of the grains are fogged as described in U.S. Pat. No. 4,626,498 and JP-A- 59-214852; and colloidal silver can be preferably used in light-sensitive silver halide emulsion layers and/or substantially non-sensitive colloidal layers. The term "silver halide grains wherein the interiors or surfaces of the grains are fogged" as used herein refers to silver halide grains which can be developed uniformly (non-imagewise) irrespective of the unexposed area of the light-sensitive material and the exposed area thereof. Methods for preparing silver halide grains wherein the interiors or surfaces of the grains are fogged are described in U.S. Pat. No. 4,626,498 and JP-A-59-214852.

Silver halide for forming the internal nuclei of the core/shell type silver halide grains wherein the interior of the grains are fogged may be silver halide having the same halogen composition or a different halogen composition. Any of silver chloride, silver chlorobromide, silver iodobromide and silver chloroiodobromide can be used as silver halide wherein the interior or surface of the grains are fogged. There is no particular limitation with regard to the grain size of these fogged silver halide grains, and the mean grain size thereof is preferably 0.01 to 0.75 μm, particularly preferably 0.05 to 0.6 μm. Further, there is no particular limitation with regard to grain form. The fogged grains may have a regular form, and a polydisperse emulsion may be used. However, a monodisperse (at least 95%, in terms of weight or the number of grains, of silver halide grains has a grain size of within ±40% of the mean grain size) emulsion is preferred.

It is preferred that non-sensitive fine silver halide grains are used in the present invention. The term "non-sensitive fine silver halide grains" as used herein refers to fine silver halide grains which are not sensitive to light during imagewise exposure for obtaining a dye image and are substantially not developed during the course of development. It is preferred that the fine silver halide grains are previously not fogged.

The fine silver halide grains have a silver bromide content of 0 to 100 mol % and may optionally contain silver chloride and/or silver iodide. The fine silver halide grains preferably contain 0.5 to 10 mol % of silver iodide.

The fine silver halide grains have a mean grain size (the average value of the diameters of circles corresponding to the projected area of the grains) of preferably 0.01 to 0.5 μm, more preferably 0.02 to 0.2 μm.

The fine silver halide gains can be prepared in the same manner as in the preparation of conventional light-sensitive silver halide grains. In this case, the surfaces of the silver halide grains do not need to be optically sensitized, and spectral sensitization is not required. However, it is preferred that conventional stabilizers such as triazole, azaindene, benzthiazolium or mercapto compounds or zinc compounds are added to coating solutions, before the fine silver halide grains are added. Colloidal silver can be added to layers containing the fine silver halide grains.

The coating weight of silver coated on the light-sensitive materials of the present invention is preferably not more than 6.0 g/m$^2$, most preferably not more than 4.5 g/m$^2$.

Conventional photographic additives which can be used in the present invention are described in the aforesaid three *Research Disclosures*, and indicated in the following Table.

| Type of Additive | RD17643 | RD18716 | RD307105 |
|---|---|---|---|
| 1. Chemical Sensitizers | Page 23 | Page 648, right hand column | Page 866 |
| 2. Sensitivity Increasing Agents | | Page 648, right hand column | |
| 3. Spectral Sensitizers, Super-Sensitizers | Pages 23–24 | Page 648 right hand column - page 649 right hand column | Pages 866–868 |
| 4. Brightening Agents | Page 24 | Page 647, right hand | Page 868 |

-continued

| Type of Additive | RD17643 | RD18716 | RD307105 |
|---|---|---|---|
| | | column | |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |
| 8. Dye Image Stabilizers | Page 25 | page 650, left hand column | Page 872 |
| 9. Hardening Agents | Page 26 | Page 651, left hand column | Pages 874–875 |
| 10. Binders | Page 26 | Page 651, left hand column | Pages 873–874 |
| 11. Plasticizers Lubricants | Page 27 | Page 650, right hand column | Page 876 |
| 12. Coating aids Surfactants | Pages 26–27 | Page 650, right hand column | Pages 875–876 |
| 13. Anti-static agents | Pages 27 | Page 650, right hand column | Pages 876–877 |
| 14. Matting Agents | | | Pages 878–879 |

It is preferred that compounds capable of reacting with formaldehyde to fix it as described in U.S. Pat. Nos. 4,411,987 and 4,435,503 are added to the light-sensitive materials to prevent photographic performance from being deteriorated by formaldehyde gas.

It is also preferred that the light-sensitive materials of the present invention contain mercapto compounds described in U.S. Pat. Nos. 4,740,454 and 4,788,132, JP-A-62-18539 and JP-A-1-283551.

Further, it is preferred that the light-sensitive materials of the present invention contain compounds which release a fogging agent, a development accelerator, a solvent for silver halide or a precursor thereof irrespective of the amount of developed silver formed by development as described in JP-A-1-106052.

Furthermore, it is preferred that the light-sensitive materials of the present invention contain dyes dispersed by the methods described in WO(PCT) 88/04794 and published PTA application (in Japan) No. 1- 502912 and dyes described in EP 317,308A, U.S. Pat. No. 4,420,555 and JP-A-1-259358.

Various color couplers can be used in the present invention. Specific examples thereof are described in the patent specifications cited in the aforesaid Research Disclosure No.17643, VII-C to G and ibid. No. 307105, VII-C to G.

Preferred examples of yellow couplers include, in addition to the compounds of general formulae (1) and (2) according to the present invention, those described in U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249,473A.

Preferred magenta couplers include 5-pyrazolone compounds and pyrazoloazole compounds. Magenta couplers described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO(PCT) 88/04765 are particularly preferred.

Cyan couplers include phenol couplers and naphthol couplers. Cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent OLS No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658 are preferred. Further, 1-naphthol type cyan couplers characterized by having a ballast group at the 2-position described in JP-A-55-108662, pyrazoloazole couplers described in JP-A-64-553, JP-A- 64-554, JP-A-64-555 and JP-A-64-556 and imidazole couplers described in U.S. Pat. No. 4,818,672 can be used.

Typical examples of dye forming polymer couplers are described in U.S. Pat. Nos. 3,451,820, 4,080,211, 4,367,282, 4,409,320 and 4,576,910, U.K. Patent 2,102,137 and European Patent 341,188A.

Preferred examples of couplers which produce a developed dye having proper diffusibility include those described in U.S. Pat. No. 4,366,237, U.K. Patent 2,125,570, European Patent 96,570 and West German Patent OLS No. 3,234,533.

Preferred examples of colored couplers for correcting unwanted absorption of developed dyes include those described in *Research Disclosure* No. 17643, item VII-G, ibid. No. 307105, item VII-G, U.S. Pat. No. 4,163,670, JP-B-57-39413, U.S. Pat. Nos. 4,004,929 and 4,138,258 and U.K. Patent 1,146,368. Further, there can be used couplers for correcting unwanted absorption of developed dyes by a fluorescent dye released on coupling as described in U.S. Pat. No. 4,774,181, and couplers having, as an releasing group, a dye precursor group capable of forming a dye by the reaction with developing agents as described in U.S. Pat. No. 4,777,120.

Compounds which release a photographically useful residue on coupling can preferably be used in the present invention. Preferred examples of DIR couplers which release a development inhibitor include those described in patent specifications cited in the aforesaid RD No. 17643, item VII-F and RD No. 307105, item VII-F, JP-A-57-151944, JP-A-57-154234, JP-A-60- 184248, JP-A-63-37346, JP-A-63-37350, U.S. Pat. Nos. 4,248,962 and 4,782,012.

Couplers which release a bleaching accelerator as described in RD No. 11449, RD No. 24241 and JP-A-61-201247 are effective in shortening the time of a processing stage having bleaching power. Particularly, the effect thereof is remarkable when added to light-sensitive materials using the above-described tabular grains.

Preferred examples of couplers which release imagewise a nucleating agent or a development accelerator during development include those described in U.K. Patents 2,097,140 and 2,131,188, JP-A-59-157638 and JP-A- 59-170840. Further, there can preferably be used compounds which release a fogging agent, a development accelerator, a solvent for silver halide, etc. by the redox reaction with the oxidation product of the developing agents as described in JP-A-60-107029, JP-A- 60-252340, JP-A-1-44940 and JP-A-1-45687.

Other compounds which can be used in the present invention include competitive couplers described in U.S. Pat. No. 4,130,427; polyequivalent type couplers described in U.S. Pat. Nos. 4,283,472, 4,338,393 and 4,310,618; DIR redox compound releasing couplers, DIR coupler releasing couplers, DIR coupler releasing redox compounds and DIR redox releasing redox compounds described in JP-A-60-185950 and JP-A-62-24252; couplers which release a dye whose color is restored after elimination as described in European Patents 173,302A and 313,308A; couplers which release a ligand as described in U.S. Pat. No. 4,555,477; couplers which release a leuco dye as described in JP-A-63-75747; and couplers which release a fluorescent dye as described in U.S. Pat. No. 4,774,181.

The couplers which are used in the present invention can be introduced into the light-sensitive materials by various conventional dispersion methods.

Examples of high-boiling point organic solvents which can be used in the oil-in-water dispersion methods are described in U.S. Pat. No. 2,322,027. Specific examples of the high-boiling point organic solvents having a boiling point of not lower than 175° C. under atmospheric pressure which can be used in the oil-in-water dispersion methods include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl-)isophthalate, bis(1,1-diethylpropyl)-phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphonate), benzoic esters (e.g., 2-ethylhexyl benzoate, dodecyl benzoate, 2-ethylhexyl p-hydroxybenzoate), amides (e.g., N,N-diethyldodecaneamide, N,N-diethyllaurylamido, N-tetradecylpyrrolidone), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-tertoctylaniline) and hydrocarbons (e.g., paraffin, dodecylbenzene, diisopropylnaphthalene). Organic solvents having a boiling point of not lower than about 30° C., preferably not lower than 50° C., but not higher than 160° C. can be used as co-solvents. Typical examples of such organic solvents include ethyl acetate, butyl acetate, ethyl propionate, methyl ethyl ketone, cyclohexanone, 2-ethyoxyethyl acetate and dimethylformamide.

The stages and effects of latex dispersion methods and specific examples of impregnating latexes are described in U.S. Pat. No. 4,199,363 and West German Patent Application (OLS) Nos.2,541,274 and 2,541,230.

It is preferred that antiseptic or antifungal agents such as phenethyl alcohol or 1,2-benz-iso-thiazoline- 3-one, n-butyl p-hydroxybenzoate, phenol, 4-chloro- 3,5-dimethylphenol, 2-phenoxyethanol and 2-(4-thiazolyl)benzimidazole described in JP-A-63-257747, JP-A- 62-272248 and JP-A-1-80941 are added to the color light-sensitive materials of the present invention.

The present invention can be applied to various color light-sensitive materials. Typical examples of the color light-sensitive materials to which the present invention is applicable include genaral-purpose or movie color negative films, reversal color films for slide and TV, color paper, color positive films and reversal color paper.

Examples of suitable supports which can be used in the present invention are described in the aforesaid RD No. 17643, page 28, RD No. 18716, right column of page 647 to left column of page 648 and RD No. 307105, page 879.

The sum total of the layer thicknesses of the entire hydrophilic colloid layers on the emulsion layer side of the light-sensitive material of the present invention is preferably not more than 28 μm, more preferably not more than 23 μm, still more preferably not more than 18 μm, particularly preferably not more than 16 μm The layer swelling rate T½ is preferably not more than 30 seconds, more preferably not more than 20 seconds. The layer thickness refers to a layer thickness obtained by making the measurement under moisture conditioning at 25° C. and 55% RH for two days. The layer swelling rate T½ can be measured by any conventional method known in the art. For example, the layer swelling rate can be measured by using a swellometer of a type described in A. Green et. al., *Photographic Science and Engineering,* Vol. 19, No. 2, pp. 124–129. The layer swelling rate T½ is defined as a time required for swelling a layer to ½ the saturated swollen thickness thereof which is 90% of the maximum swollen layer thickness caused by processing with a color developing solution at 30° C. for 3¼ minutes.

The layer swelling rate T½ can be controlled by adding gelatin as a binder or by changing conditions with time after coating. The swelling ratio is preferably 150 to 400%. The swelling ratio can be calculated from the maximum swollen layer thickness under the above conditions by using the following formula:

Swelling ratio=(maximum swollen layer thickness−layer thickness)/layer thickness It is preferred that the light-sensitive material of the present invention is provided with a hydrophilic colloid layer (back layer) having a dry thickness of 2 to 20 μm in total on the opposite side to the emulsion layer side. It is also preferred that the back layer contains the above-described light absorber, filter dye, ultraviolet light absorber, antistatic agent, hardening agent, binder, plasticizer, lubricant, coating aid, surfactant, etc. The swelling ratio of the back layer is preferably 150 to 500%.

The color photographic materials of the present invention can be developed by conventional methods described in the aforesaid RD No. 17643, pp. 28–29, RD No. 18716, left column to right column of page 651 and RD No. 307105, pp. 880–881.

The color developing solutions which can be used in the development of the light-sensitive materials of present invention are preferably aqueous alkaline solutions mainly composed of aromatic primary amine color developing agents. Aminophenol compounds are useful as the developing agents and p-phenylenediamine compounds are preferred as the color developing agents. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate. Among them, 3-methyl- 4-amino-N-ethyl-N-β-hydroxyaniline sulfate is particularly preferred.

These compounds may be used either alone or in combination of two or more of them according to the intended purpose.

Generally, the color developing solutions contain pH buffering agents such as alkali metal carbonates, borates and phosphates, development inhibitors such as chlorides, bromides, iodides, benzimidazoles, benzothiazoles and mercapto compounds and anti-fogging agents. If desired, the color developing solutions may optionally contain preservatives such as hydroxylamine, diethylhydroxylamine, sulfites, hydrazine such as N,N-biscarboxymethylhydrazine phenylsemicarbazides, triethanolamine, and catecholsulfonic acids; organic solvents such as ethylene glycol and diethylene glycol; development accelerators such as benzyl alcohol, polyethylene glycol and quaternary ammonium salts; dye forming couplers; competitive couplers; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development is first carried out and color development is than carried out. Black-and-white developing solutions may contain conventional developing agents such as dihydroxybenzenes, (e.g., hydroquinone), 3-pyrazolidones (e.g., 1-phenyl-3-pyrazolidone) and aminophenols (e.g., N-methyl-p-aminophenol). These developing agents may be used either alone or in combination of two or more of them. The pH of the color developing solutions and the black-and-white developing solutions is generally in the range of 9 to 12. The replenishment rate of these developing solutions varies depending on the types of the color photographic materials, but is usually not more than 3 l per $m^2$ of the photographic material. The replenishment rate can be reduced to 500 ml or less when the concentration of bromide ion in the replenisher is reduced. When the replenishment is to be reduced, it is desirable that the contact area of the processing solution with air in the processing bath is reduced to prevent the solution from being evaporated or oxidized by air.

The contact area of the photographic processing solution with air in the processing bath can be represented by an opening ratio defined below.

Opening ratio=[contact area ($cm^2$) of processing solution with air]+[capacity ($cm^3$) of processing solution]

The opening ratio is preferably not more then 0.1, more preferably 0.001 to 0.05. Methods for reducing the opening ratio include a method wherein a cover such as a floating cover is provided on the surface of the photographic processing solution in the processing bath; a method using a movable cover as described in JP-A-1-82033; and slit developing methods as described in JP-A-63-216050.

It is preferred that the use of the opening ratio is applied to not only both the color development stage and the black-and-white development stage, but also to all of the subsequent stages such as bleaching, bleach-fixing, fixing, rinsing and stabilization stages. Further, the replenishment rate can be reduced by using a means for inhibiting the accumulation of bromide ion in the developing solution.

The color development time is generally 2 to 5 minutes. However, the processing time can be shortened by using the color developing agents at a higher concentration under higher temperature and higher pH conditions.

After color development, the photographic emulsion layer is generally bleached. Bleaching may be carried out simultaneously with fixing (bleach-fixing treatment) and they may be separately carried out. After bleaching, a bleach-fixing treatment may be conducted to expedite processing. Processing may be carried out with a bleach-fixing bath composed of two consecutive baths. Fixing may be conducted before the bleach-fixing treatment. After the bleach-fixing treatment, bleaching may be conducted according to the intended purpose. Examples of bleaching agents include compounds of polyvalent metals such as iron(III), peracids, quinones and nitro compounds. Typical examples of the bleaching agents include organic complex salts of iron(III) such as complex salts of aminopolycarboxylic acids (e.g., ethylenediaminetetraacetic acid, diethylenetriaminepentaacetic acid, cyclohexanediaminetetraacetic acid, methyliminodiacetic acid, 1,3-diamino-propanetetraacetic acid, glycol ether diaminetetraacetic acid, etc.) citric acid, tartaric acid, malic acid, etc. Among them, iron(III) complex salts of aminopolycarboxylic acids such as (ethylenediaminetetraacetato)iron(III) complex and (1,3-diaminopropanetetraacetato)iron(III) complex are preferred from the viewpoints of rapid processing and prevention of environmental pollution. Further, iron(III) complex salts of aminopolycarboxylic acids are useful for bleaching solutions and bleach-fixing solutions. The pH of the bleaching solutions containing the iron(III) complex salts of the aminopolycarboxylic acids and the bleach-fixing solutions containing said iron(III) complex salts is generally in the range of 4.0 to 8. Lower pH may be used to expedite processing.

If desired, the bleaching solution, the bleach-fixing solution and the prebath thereof may contain bleaching accelerators. Examples of the bleaching accelerators include compounds having a mercapto group or a disulfide group described in U.S. Pat. No. 3,893,858, West German Patents 1,290,812 and 2,059,988, JP-A-53- 32736, JP-A-53-57831, JP-A-53-37418, JP-A-53-72623, JP-A- 53-95630, JP-A-53-95631, JP-A-53-104232, J-A-53- 124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58- 16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ions. Among them, the compounds having a mercapto group or a disulfide group are preferred from the viewpoint of high accelerating effect. Particularly, the compounds described in U.S. Pat. No. 3,893,858, West German Patent 1,290,812 and JP-A-53- 95630 are preferred. Further, the compounds described in U.S. Pat. No. 4,552,834 are preferred. These bleaching accelerators may be incorporated in the photographic materials. These bleaching accelerators are particularly effective in conducing the bleach-fixing of the color photographic materials for photographing.

It is preferred that the bleaching solution and the bleach-fixing solution contain organic acids in addition to the above-described compounds to prevent bleach stain from being formed. Particularly preferred organic acids are compounds having an acid dissociation constant (pKa) of 2 to 5. Preferred examples of the organic acids include acetic acid, propionic acid and hydroxyacetic acid.

Examples of fixing agents which can be used in the fixing solution and the bleach-fixing solutions include thiosulfates, thiocyanates, thioether compounds, thioureas and various iodides. Among them, the thiosulfates are widely used. Particularly, ammonium thiosulfate is most widely used. Combinations of thiosulfates with thiocyanates, thioether compounds or thiourea are also preferred. Sulfites, bisulfites, carbonyl bisulfite adducts and sulfinic acid compounds (e.g., described in European Patent 294,769A) are preferred as preservatives for the fixing solution and the bleach-fixing solution. Further, it is preferred that various aminopolycarboxylic acids and organic phosphonic acids are added to the fixing solution and the bleach-fixing solution to stabilize the solutions. It is preferred that compounds having a pKa of 6.0 to 9.0, preferably imidazole compounds such as imidazole, 1-methylimidazole, 1-ethyl-imidazole and 2-methylimidazole are added to the fixing solution and the bleach-fixing solution in an amount of from about 0.1 to about 10 mols per liter to adjust the pH.

A shorter total desilverization time is preferable, so long as a failure in desilverization is not caused. The desilverization time is preferably 1 to 3 minutes, more preferably 1 to 2 minutes. The processing temperature is 25° to 50° C., preferably 35° to 45° C. The desilverization rate is improved within the preferred temperature range described above and stain can be effectively prevented from being formed after processing.

It is preferred that stirring is intensified as much as possible in the desilverization stage. Methods for intensifying stirring include a method wherein a jet stream of the processing solution is allowed to collide with the emulsion layer surface of the light-sensitive material as described in JP-A-62-183460; a method wherein a stirring effect is increased by using a rotating means as described in JP-A-62-183461; a method wherein while the emulsion layer surface is brought into contact with a wire blade provided in the solution, the light-sensitive material is transferred to thereby form a turbulent flow on the surface of the emulsion layer, whereby the stirring effect can be improved; and a method wherein the circulating flow rate of the processing solution as a whole is increased. These means for improving the stirring effect are effective in conducting the stirring of any of the bleaching solution, the bleach-fixing solution and the fixing solution. It is believed that an improvement in stirring expedites the feed of the bleaching agent and the fixing agent into the emulsion layers and as a result, the desilverization rate can be increased. The above-described means for improving stirring are more effective when the bleaching accelerators are used. These means have an effect of remarkably increasing an accelerating action or solving a problem of a fixation inhibiting effect due to the bleaching accelerators.

It is preferred that automatic processors used in the processing of the light-sensitive materials of the present invention are provided with a means for conveying the light-sensitive materials as described in JP-A-60-191257, JP-A-60-191258 and JP-A-60-191259. These conveying means can greatly reduce the amount of the processing solution brought over from the prebath to the subsequent bath, and have a high effect of preventing the performance of the processing solution from being deteriorated. Such an effect is particularly effective in shortening the processing time in each stage and reducing the replenishment rate of each processing solution.

Usually, the silver halide color photographic materials of the present invention are subjected to washing and/or a stabilization stage after desilverization. The amount of rinsing water in the washing stage widely varies depending on the characteristics (e.g., depending on materials used such as couplers) of the photographic materials used, the temperature of the rinsing water, the number of rinsing tanks (the number of stages), the replenishing system (countercurrent, direct flow) and other conditions. The relationship between the amount of water and the number of rinsing tanks in the multi-stage countercurrent system can be determined by the method described in the *Journal of the Society of Motion Picture and Television Engineers,* Vol. 64, p.248–253 (May 1955). According to the multi-stage countercurrent system described in the above publication, the amount of rinsing water can be greatly reduced. However, there is a problem that the residence time of water in the tanks is prolonged and as a result, bacteria grows and the resulting suspended matter is deposited on the photographic material. A method for reducing calcium ion and magnesium ion described in JP-A- 62-288838 can be effectively used for the color photographic materials of the present invention to solve the above-mentioned problem. Further, isothiazolone compounds, thiabendazole compounds, chlorine-containing germicides such as sodium chlorinated isocyanurate and benztriazole described in JP-A-57-8542 and germicides described in Chemistry of Germicidal Antifungal Agent (1986), written by Hiroshi Horiguchi, Sterilization, Disinfection, Antifungal Technique, edited by Sanitary Technique Society and Antibacterial and Antifungal Cyclopedie (1986), edited by Nippon Antibacterial Antifungal Society, can be used.

The pH of rinsing water in the treatment of the photographic materials of the present invention is in the range of 4 to 9, preferably 5 to 9. The temperature of the rinsing water and the washing time vary depending on the characteristics of the photographic materials used, etc., but the temperature and time of washing are generally 15° to 45° C. for 20 seconds to 10 minutes, preferably 25° to 40° C. for 30 seconds to 5 minutes. The photographic materials of the present invention may be processed directly with stabilizing solutions in place of said rinsing water. Such stabilizing treatment can be carried out by conventional methods descried in JP-A- 57-8543, JP-A-58-14834 and JP-A-60-220345.

The stabilizing treatment subsequent to the rinsing may be conducted. The stabilizing treatment may be used as the final bath for the color photographic materials for photographing. An example thereof includes a stabilizing bath containing a dye stabilizer and a surfactant. Examples of the dye stabilizer include aldehydes such as formalin and glutaraldehyde, N-methylol compounds, hexamethylenetetramine and aldehyde-sulfite adducts. The stabilizing bath may contain various chelating agents and antifungal agents.

Overflow solution from the replenishment of rinsing water and/or stabilizing can be reused in other stages such as in the desilverization stage.

It is preferred that the concentration of each processing solution is corrected by adding water when each processing solution is concentrated by evaporation during processing with automatic processors, etc.

The color developing agents may be incorporated in the silver halide color photographic materials of the present invention for the purpose of simplifying and expediting processing. It is preferred that precursors for the color developing agents are used for the incorporation thereof in the photographic materials. Examples of the precursors include indoaniline compounds described in U.S. Pat. No. 3,342,597; Schiff base silver compounds described in U.S. Pat. No. 3,342,599 *Research Disclosure* No. 14850 and ibid., No. 15159; aldol compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated in the silver halide color photographic materials of the present invention for the purpose of accelerating color development. Typical examples of the compounds include those described in JP-A-56-64339, JP-A- 57-144547 and JP-A-58-115438.

In the present invention, various processing solutions are used at a temperature of 10° to 50° C. Generally, a temperature of 33° to 38° C. is used. However, it is possible that a higher temperature is used to accelerate processing and to shorten the processing time, while lower temperature is used to improve image quality and to improve the stability of the processing solutions.

The silver halide light-sensitive materials of the present invention can be applied to heat developing light-sensitive materials described in U.S. Patent 4,500,626, JP-A-60-133449, JP-A-59-218443, JP-A-61- 238056 and European Patent 210,660A2.

The presents invention is now illustrated in greater detail by reference to the following examples which, however, are not to be construed as limiting the present invention in any way.

EXAMPLE 1

Preparation of sample 101

An undercoated cellulose triacetate film support of 127 μm in thickness was coated with the following layers having the following compositions in order to prepare a multi-layer color light-sensitive material as sample 101. Numerals represent coating weights per $m^2$. The effects of the following compounds added are not limited to the uses described below.

| | |
|---|---|
| First layer: antihalation layer | |
| Black colloidal silver | 0.20 g |
| Gelatin | 1.9 g |
| Ultraviolet light absorber U-1 | 0.04 g |
| Ultraviolet light absorber U-2 | 0.1 g |
| Ultraviolet light absorber U-3 | 0.1 g |
| Ultraviolet light absorber U-4 | 0.1 g |
| Ultraviolet light absorber U-6 | 0.1 g |
| High-boiling organic solvent Oil-1 | 0.1 g |
| Microcrystalline solid dispersion of Dye E-1 | 0.1 g |
| Second layer: interlayer | |
| Gelatin | 0.04 g |
| High-boiling organic solvent Oil-3 | 0.1 g |
| Dye D-4 | 0.4 mg |
| Third layer: interlayer | |
| Fine-grain silver iodobromide emulsion wherein the surfaces and interiors of the grains were fogged (mean grain size; 0.06 μm, coefficient of variation: 18%, AgI content: 1 mol %) | 0.05 g as Ag |

-continued

| | |
|---|---|
| Gelatin | 0.4 g |
| Fourth layer: low-sensitivity red-sensitive emulsion layer | |
| Emulsion A | 0.1 g as Ag |
| Emulsion B | 0.4 g as Ag |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Coupler C-11 | 0.05 g |
| High-boiling organic solvent Oil-2 | 0.1 g |
| Fifth layer: Intermediate-sensitivity red-sensitive emulsion layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| Coupler C-9 | 0.05 g |
| Coupler C-11 | 0.05 g |
| High-boiling organic solvent Oil-2 | 0.1 g |
| Sixth layer: high-sensitivity red-sensitive emulsion layer | |
| Emulsion D | 0.4 g as Ag |
| Geltin | 1.1 g |
| Coupler C-1 | 0.3 g |
| Coupler C-2 | 0.1 g |
| Coupler C-3 | 0.7 g |
| Coupler C-9 | 0.1 g |
| Coupler C-11 | 0.1 g |
| Additive P-1 | 0.1 g |
| Seventh layer: interlayer | |
| Gelatin | 0.6 g |
| Additive M-1 | 0.3 g |
| Color mixing inhibitor Cpd-K | 2.6 mg |
| Ultraviolet light-absorber U-1 | 0.1 g |
| Ultraviolet light-absorber U-6 | 0.1 g |
| Dye D-1 | 0.02 g |
| Eighth layer: interlayer | |
| Silver iodobromide emulsion wherein the surface and interior of the grains were fogged (mean grain size: 0.06 μm, coefficient of variation: 16%, AgI content: 0.3 mol %) | 0.02 g as Ag |
| Gelatin | 1.0 g |
| Additive P-1 | 0.2 g |
| Color mixing inhibitor Cpd-N | 0.1 g |
| Color mixing inhibitor Cpd-A | 0.1 g |
| Ninth layer: low-sensitivity green-sensitive emulsion layer | |
| Emulsion E | 0.1 g as Ag |
| Emulsion F | 0.2 g as Ag |
| Emulsion G | 0.2 g as Ag |
| Gelatin | 0.5 g |
| Coupler C-4 | 0.05 g |
| Coupler C-7 | 0.05 g |
| Coupler C-8 | 0.20 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.1 g |
| High-boiling organic solvent Oil-2 | 0.1 g |
| Tenth layer: intermediate-sensitivity green-sensitive emulsion layer | |
| Emulsion G | 0.3 g as Ag |
| Emulsion H | 0.1 g as Ag |
| Gelatin | 0.6 g |

| | |
|---|---|
| Coupler C-4 | 0.1 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling organic solvent Oil-2 | 0.01 g |
| Eleventh layer: high-sensitivity green-sensitive emulsion layer | |
| Emulsion I | 0.5 g as Ag |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.02 g |
| High-boiling organic solvent Oil-2 | 0.02 g |
| Twelfth layer: interlayer | |
| Gelatin | 0.6 g |
| Dye D-1 | 0.1 g |
| Dye D-2 | 0.05 g |
| Dye D-3 | 0.07 g |
| Thirteenth layer: yellow filter layer | |
| Yellow colloidal silver | 0.07 g as Ag |
| Gelatin | 1.1 g |
| Color mixing inhibitor Cpd-A | 0.01 g |
| High-boiling organic solvent Oil-1 | 0.01 g |
| Microcrystalline solid dispersion of dye E-2 | 0.05 g |
| Fourteeth layer: interlayer | |
| Gelatin | 0.6 g |
| Fifteenth layer: low-sensitivity blue-sensitive emulsion layert | |
| Emulsion J | 0.2 g as Ag |
| Emulsion K | 0.3 g as Ag |
| Emulsion L | 0.1 g as Ag |
| Gelatin | 0.8 g |
| Coupler C-5 | 0.2 g |
| Coupler C-6 | 0.2 g |
| Coupler C-10 | 0.4 g |
| Sixteenth layer: intermediate-sensitivity blue-sensitive emulsion layer | |
| Emulsion L | 0.1 g as Ag |
| Emulsion M | 0.4 g as Ag |
| Gelatin | 0.9 g |
| Coupler C-5 | 0.3 g |

| | |
|---|---|
| Coupler C-6 | 0.1 g |
| Coupler C-10 | 0.1 g |
| Seventeenth layer: high-sensitivity blue-sensitive emulsion layer | |
| Emulsion N | 0.4 g as Ag |
| Gelatin | 1.2 g |
| Coupler C-5 | 0.1 g |
| Coupler C-6 | 0.6 g |
| Coupler C-10 | 0.1 g |
| Eighteenth layer: first protective layer | |
| Gelatin | 0.7 g |
| Ultraviolet light-absorber U-1 | 0.04 g |
| Ultraviolet light-absorber U-2 | 0.01 g |
| Ultraviolet light-absorber U-3 | 0.03 g |
| Ultraviolet light-absorber U-4 | 0.03 g |
| Ultraviolet light-absorber U-5 | 0.05 g |
| Ultraviolet light-absorber U-6 | 0.05 g |
| High-boiling organic solvent Oil-1 | 0.02 g |
| Formalin scavenger Cpd-C | 0.2 g |
| Formalin scavenger Cpd-I | 0.4 g |
| Dye D-3 | 0.05 g |
| Compound Cpd-N | 0.02 g |
| Nineteenth layer: second protective layer | |
| Colloidal silver | 0.1 mg as Ag |
| Fine-grain silver iodobromide emulsion (mean grain size: 0.06 μm, AgI content: 1 mol %) | 0.1 mg as Ag |
| Gelatin | 0.4 g |
| Twentieth layer: third protective layer | |
| Gelatin | 0.4 g |
| Polymethyl methacrylate (average particle size: 1.5 μm) | 0.1 g |
| Methyl methacrylate/acrylic acid (4:6) copolymer (average particle size: 1.5 μm) | 0.1 g |
| Silicone oil | 0.03 g |
| Surfactant W-1 | 3.0 mg |
| Surfactant W-2 | 0.03 g |

Additives F-1 to F-8 in addition to the above-described ingredients were added to all of the emulsion layers. Further, the hardening agent H-1 for gelatin and surfactants W-3, W-4, W-5, W-6 and W-7 for coating and emulsification in addition to the above-described ingredients were added to each layer.

Furthermore, phenol, 1,2-benzisothiazoline-3-one, 2-phenoxyethanol and phenethyl alcohol as antiseptic and antifungal agents were added.

The compounds used in sample 101 have the following structural formulae.

C-1

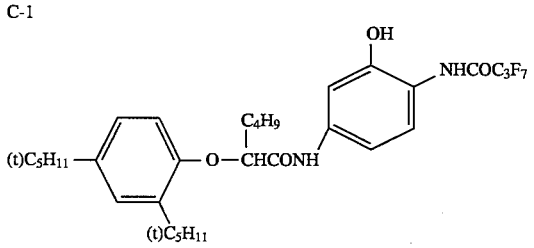

C-2

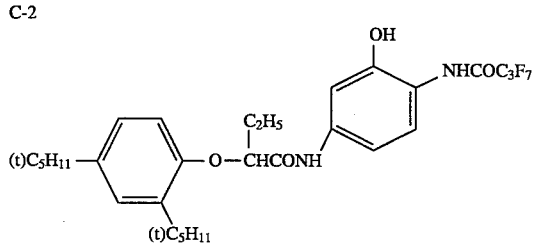

C-3
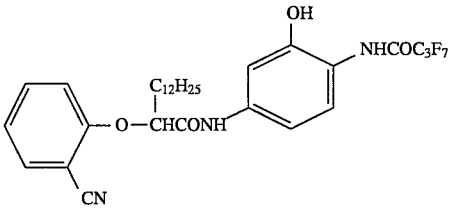
-continued
C-4
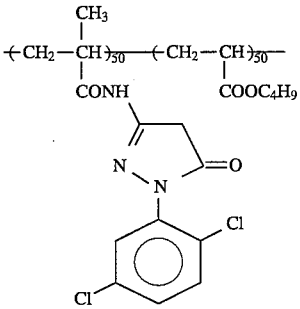
Numeral represents wt %
Average MW: about 25,000
C-5
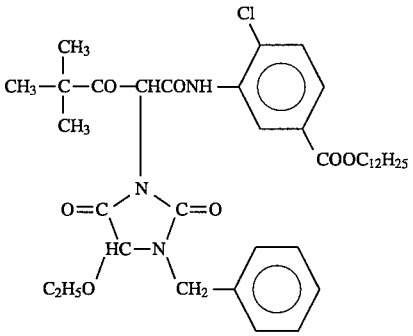
C-6
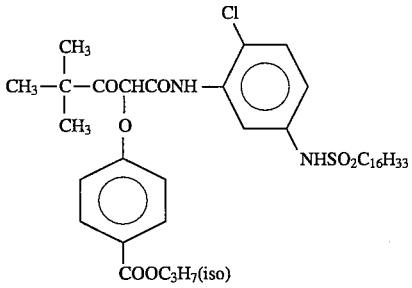
C-7
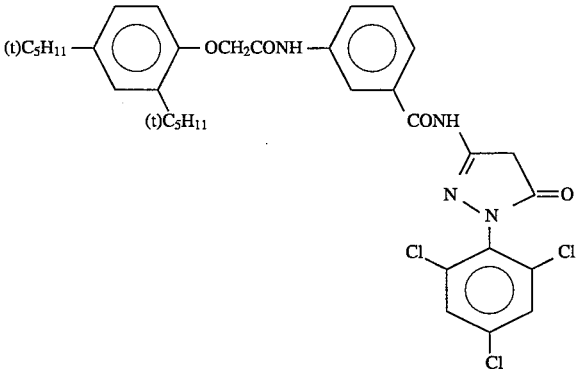
C-8
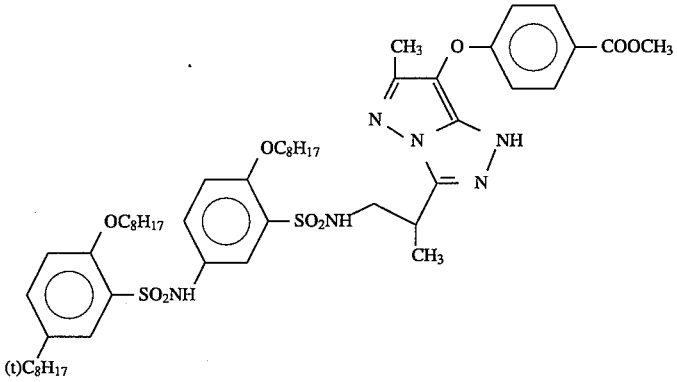

C-9
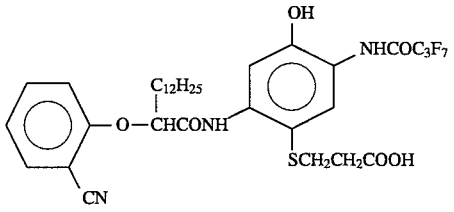
-continued
C-10
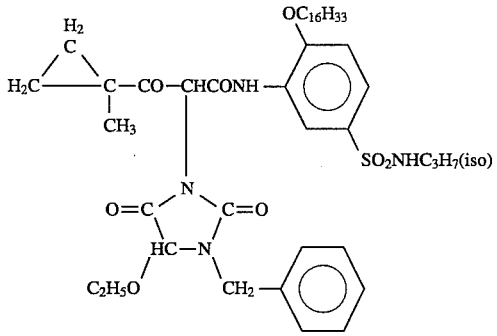
C-11
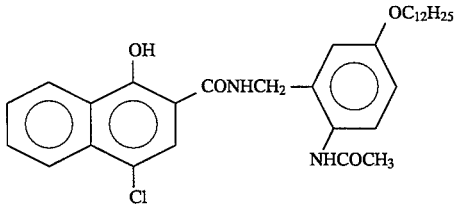
Oil-1
Dibutyl phthalate
Oil-2
Tricresyl phosphate
Oil-3
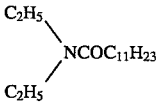
Cpd-A
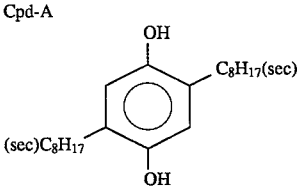
Cpd-B
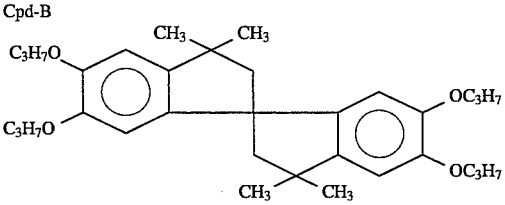
Cpd-C
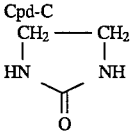
Cpd-E
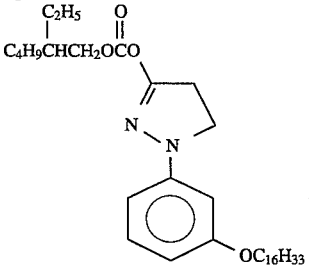
Cpd-E
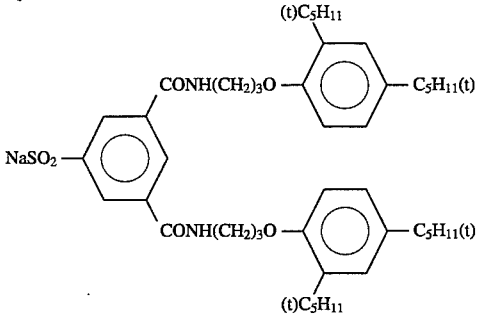
Cpd-G
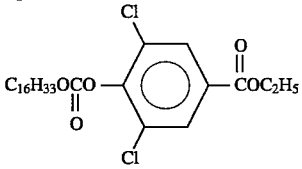

Cpd-H
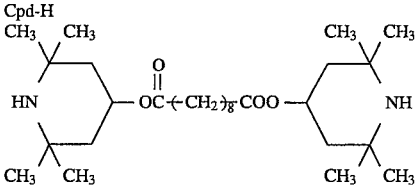
Cpd-K
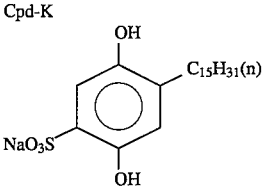
UV-1
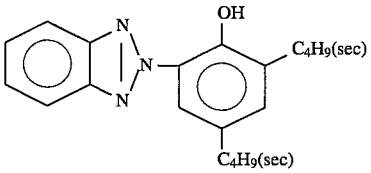
Cpd-F
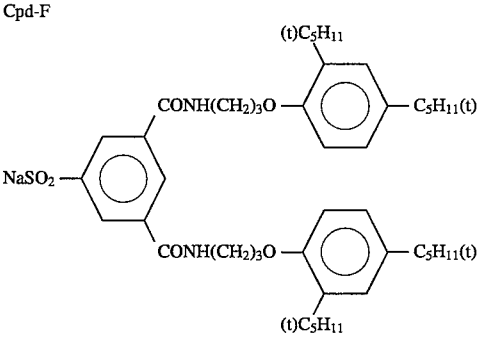
-continued
Cpd-I
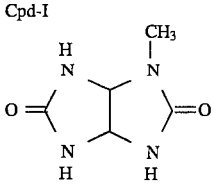
Cpd-N
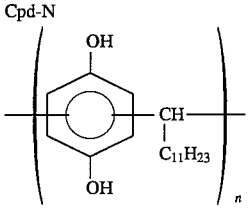
Average MW: 9000
Cpd-G
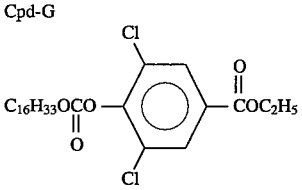
Cpd-H
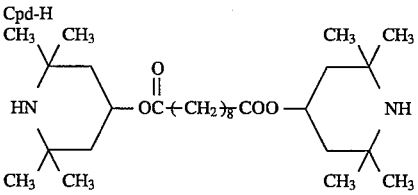
Cpd-I
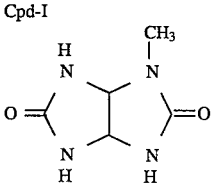
Cpd-K
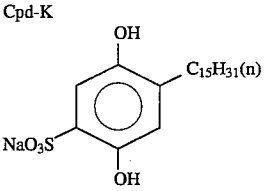
Cpd-L
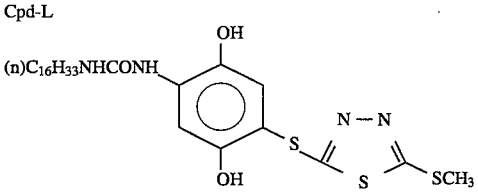
Cpd-M
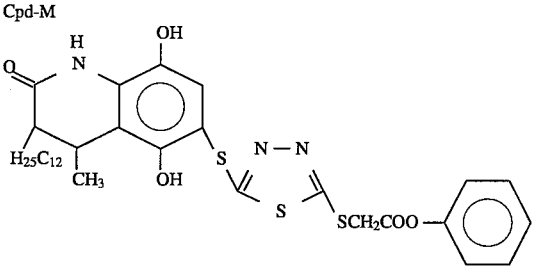
Cpd-N
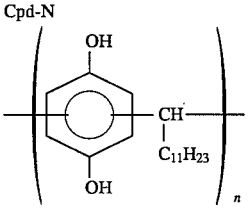
Average MW: 9000

U-1
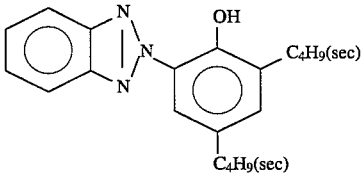
-continued
U-2
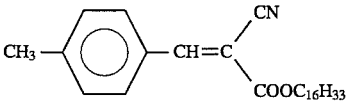
U-3
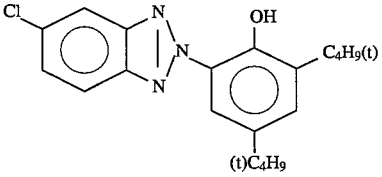
U-4
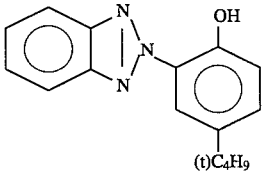
U-5
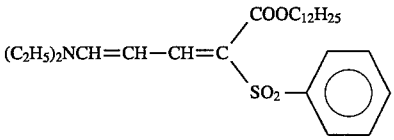
U-6
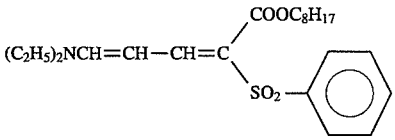
S-1
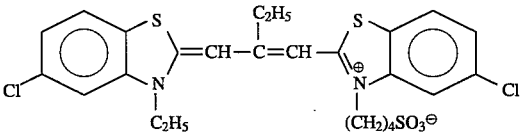
S-2
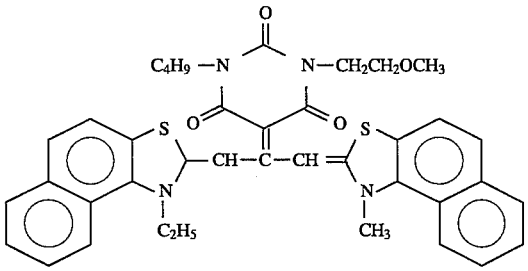
S-3
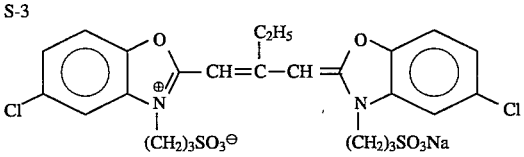
S-4
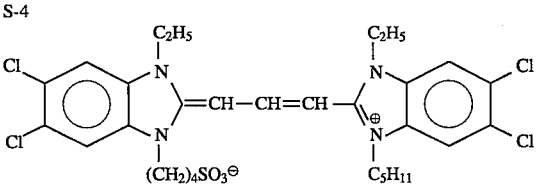
S-5
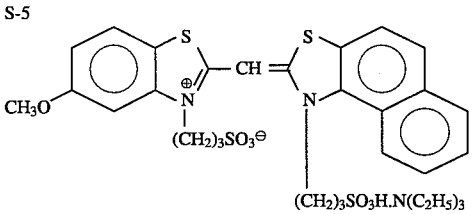
S-6
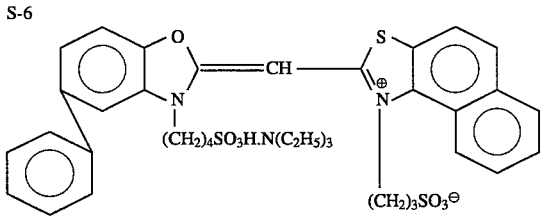
S-7
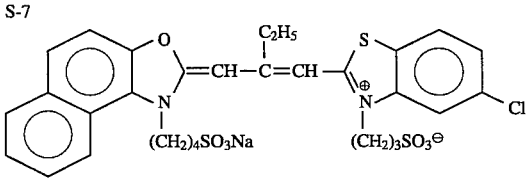

S-8
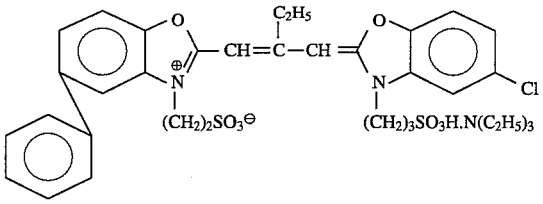
-continued
D-1
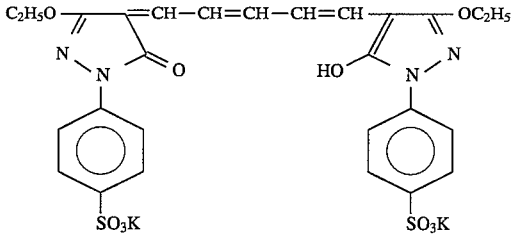
D-2
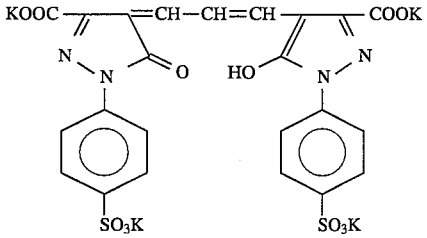
D-3
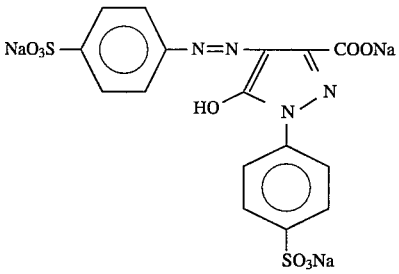
D-4
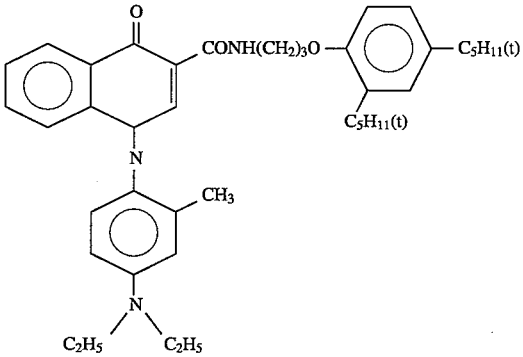
E-1
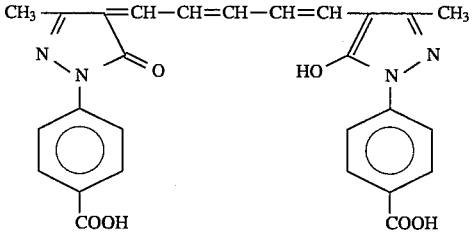
E-2
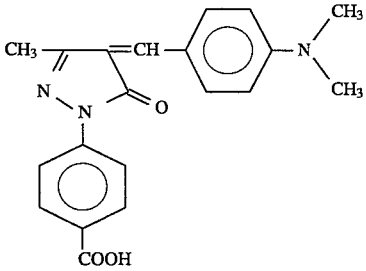
H-1
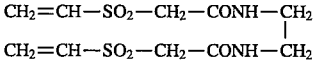
W-1
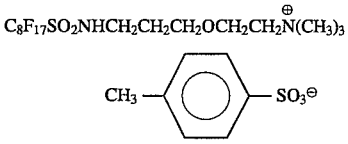
W-2
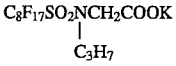
W-3
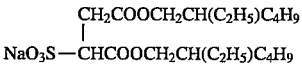
W-4
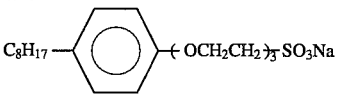

W-5

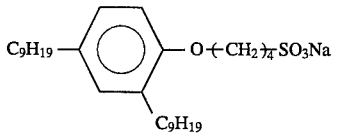

-continued

W-6

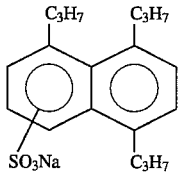

TABLE 8

Silver iodobromide emulsion used in sample 101

| Emulsion | | Mean grain size in terms of average diameter of spheres (μm) | Coefficient of variation (%) | AgI content (%) |
|---|---|---|---|---|
| A | Monodisperse tetradecahedral grains | 0.28 | 16 | 3.7 |
| B | Monodisperse cubic internal latent image type grains | 0.30 | 10 | 3.3 |
| C | Monodisperse tabular grains, average aspect ratio: 4.0 | 0.38 | 18 | 5.0 |
| D | Monodisperse tabular grains, average aspect ratio: 7.0 | 0.68 | 25 | 2.0 |
| E | Monodisperse cubic grains | 0.20 | 17 | 4.0 |
| F | Monodisperse cubic grains | 0.23 | 16 | 4.0 |
| G | Monodisperse cubic internal latent image type grains | 0.28 | 11 | 3.5 |
| H | Monodisperse cubic internal latent image type grains | 0.32 | 9 | 3.5 |
| I | Monodisperse tabular grains, average aspect ratio: 7.0 | 0.80 | 28 | 1.5 |
| J | Monodisperse tetradecahedral grains | 0.30 | 18 | 4.0 |
| K | Monodisperse tabular grains, average aspect ratio: 7.0 | 0.45 | 17 | 4.0 |
| L | Monodisperse cubic internal image type grains | 0.46 | 14 | 3.5 |
| M | Monodisperse tabular grains, average aspect ratio: 7.0 | 0.55 | 13 | 4.0 |
| N | Monodisperse tabular grains, average aspect ratio: 7.0 | 1.00 | 33 | 1.3 |

TABLE 9

Spectral sensitization of emulsions A to N

| Emulsion | Sensitizing dye added | Amount added per mol of silver halide (g) | Stage where sensitizing dye was added |
|---|---|---|---|
| A | S-1 | 0.025 | immediately after chemical sensitization |
| | S-2 | 0.25 | immediately after chemical sensitization |
| B | S-1 | 0.01 | immediately after completion of formation of grains |
| | S-2 | 0.25 | immediately after completion of formation of grains |
| C | S-1 | 0.02 | just before initiation of chemical sensitization |
| | S-2 | 0.25 | just before initiation of chemical sensitization |
| D | S-1 | 0.01 | immediately after chemical sensitization |
| | S-2 | 0.10 | immediately after chemical sensitization |
| | S-7 | 0.01 | immediately after chemical sensitization |
| E | S-3 | 0.5 | immediately after chemical sensitization |
| | S-4 | 0.1 | immediately after chemical sensitization |
| F | S-3 | 0.3 | immediately after chemical sensitization |
| | S-4 | 0.1 | immediately after chemical sensitization |
| G | S-3 | 0.25 | immediately after completion of formation of grains |
| | S-4 | 0.08 | immediately after completion of formation of grains |
| H | S-3 | 0.2 | during formation of grains |
| | S-4 | 0.06 | during formation of grains |
| I | S-3 | 0.3 | just before initiation of chemical sensitization |
| | S-4 | 0.07 | just before initiation of chemical sensitization |
| | S-8 | 0.1 | just before initiation of chemical sensitization |
| J | S-6 | 0.2 | during formation of grains |
| | S-5 | 0.05 | during formation of grains |
| K | S-6 | 0.2 | just before initiation of chemical sensitization |
| | S-5 | 0.05 | just before initiation of chemical sensitization |
| L | S-6 | 0.22 | immediately after completion of formation of grains |
| | S-5 | 0.06 | immediately after completion of formation of grains |
| M | S-6 | 0.15 | just before initiation of chemical sensitization |
| | S-5 | 0.04 | just before initiation of chemical sensitization |
| N | S-6 | 0.22 | immediately after completion of formation of grains |
| | S-5 | 0.06 | immediately after completion of formation of grains |

Preparation of Samples 102 to 104

Samples 102 to 104 were prepared in the same manner as in the preparation of Sample 101 except that an equimolar amount of each of the compounds of the present invention and comparative compounds indicated in Table 10 was used in place of each of the couplers used in the 15th, 16th and 17th layers of Sample 101.

Preparation of Samples 105 to 111

Samples 105 to 111 were prepared in the same manner as in the preparation of Sample 101 except that an equimolar amount of each of the compounds of the present invention and comparative compounds indicated in Table 10 was used in place of each of the couplers used in the 15th, 16th and 17th layers of Sample 101 and further 10 mg (per $m^2$) of each of the DIR compounds of the present invention indicated in Table 10 were added to the 2nd layer (interlayer).

The resulting Samples 101 to 111 were cut into strips, and the edge effect was measured. The edge effect was measured in the following manner. The sample was exposed through slits of 1 mm and 20 μm in line width and processed in the following stages. The density of the developed sample was measured through a blue filter by using a microdensitometer. The ratio of 20 μm/1 mm was referred to as the value of edge effect.

| | Processing Stage | | | |
|---|---|---|---|---|
| Stage | Time (min) | Temp. (°C.) | Capacity of tank (l) | Replenishment rate (l/$m^2$) |
| Black-and-White development | 6 | 38 | 12 | 2.2 |
| First rinsing | 2 | 38 | 4 | 7.5 |
| Reversal | 2 | 38 | 4 | 1.1 |
| Color development | 6 | 38 | 12 | 2.2 |
| Compensating | 2 | 38 | 4 | 1.1 |
| Bleaching | 6 | 38 | 12 | 0.22 |
| Fixing | 4 | 38 | 8 | 1.1 |
| Second rinsing | 4 | 38 | 8 | 7.5 |
| Stabilization | 1 | 25 | 2 | 1.1 |

Each processing solution had the following composition.

| Black-and-White developing solution | Mother Solution | Replenisher |
|---|---|---|
| Pentasodium nitrilo-N,N,N-trimethylene phosphonate | 2.0 g | 2.0 g |
| Sodium sulfite | 30 g | 30 g |
| Hydroquinone-potassium monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Add water to make | 1000 ml | 1000 ml |
| pH | 9.60 | 9.60 |
| pH was adjusted with hydrochloride acid or potassium hydroxide. | | |

Reversal solution
Mother solution and replenisher being the same.

| | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Add water to make | 1000 ml |
| pH | 6.00 |

-continued

| | |
|---|---|
| pH was adjusted with hydrochloric acid or sodium hydroxide. | |

| Color developing solution | Mother Solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-(β-methanesulfonamidoethyl)-3-methyl-4-aminoaniline sulfate | 11 g | 11 g |
| 3,6-Dithia-1,8-octanediol | 1.0 g | 1.0 g |
| Add water to make | 1000 ml | 1000 ml |
| pH | 11.80 | 12.00 |
| pH was adjusted with hydrochloric acid or potassium hydroxide. | | |

Compensating solution
Mother solution and replensisher being the same.

| | |
|---|---|
| Disodium ethylenediaminetetraacetate dihydrate | 8.0 g |
| Sodium sulfite | 12 g |
| 1-thioglycerine | 0.4 ml |
| Sorbitan ester | 0.1 g |

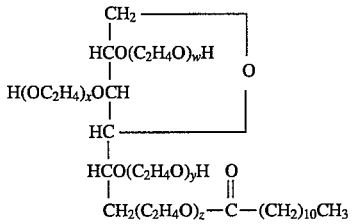

$(w + x + y + z = 20)$

| | |
|---|---|
| Add water to make | 1000 ml |
| pH | 6.20 |
| pH was adjusted with hydrochloric acid or sodium hydroxide. | |

| Bleaching solution | Mother Solution | Replenisher |
|---|---|---|
| Disodium ethylenediaminetetraacetate dihydrate | 2.0 g | 4.0 g |
| Ammonium ethylenediaminetetraacetate ferrate dihydrate | 120 g | 240 g |
| Potassium bromide | 100 g | 200 g |
| Ammonium nitrate | 10 g | 20 g |
| Add water to make | 1000 ml | 1000 ml |
| pH | 5.70 | 5.50 |
| pH was adjusted with hydrochloric acid or sodium hydroxide. | | |

Fixing Solution
Mother solution and replenisher being the same.

| | |
|---|---|
| Ammonium thiosulfate | 80 g |
| Sodium sulfite | 5.0 g |
| Sodium bisulfite | 5.0 g |
| Add water to make | 1000 ml |
| pH | 6.60 |
| pH was adjusted with hydrochloric acid or aqueous ammonia. | |

-continued

| Stabilizing solution<br>Mother solution and replenisher being the same. | |
|---|---|
| Formalin (37%) | 5.0 ml |
| Polyoxyethylene p-monononylphenyl ether (average degree of polymerization: 10) | 10 ml |
| Add water to make | 1000 ml |
| pH | not adjusted |

The results are shown in Table 10. It is apparent from Table 10 that the edge effect is high only when the couplers of the present invention and the DIR compounds of the present invention are used in combination. Further, Samples 101 to 111 were stored under conditions of 45° C. and 80% RH. These samples and the samples stored at room temperature were simultaneously subjected to the above-described processing. It was found that the samples of the present invention scarcely cause a lowering in the sensitivity and in the maximum density in comparison with the comparative samples.

TABLE 10

| Sample | Yellow coupler used in 15th layer | Yellow coupler used in 16th layer | Yellow coupler used in 17th layer | DIR compound used in 2nd layer | Edge effect |
|---|---|---|---|---|---|
| 101 (Comp. Ex.) | C-5<br>C-6<br>C-10 | C-5<br>C-6<br>C-10 | C-5<br>C-6<br>C-10 | — | 1.02 |
| 102 (Comp. Ex.) | C-5<br>C-6<br>Y-28 | C-5<br>C-6<br>Y-28 | C-5<br>C-6<br>Y-28 | — | 1.03 |
| 103 (Comp. Ex.) | Y-7<br>Y-43 | Y-6<br>Y-7 | C-6<br>Y-7 | — | 1.03 |
| 104 (Comp. Ex.) | Y-3 | Y-28 | Y-28 | — | 1.04 |
| 105 (Comp. Ex.) | C-5<br>C-6<br>C-10 | C-5<br>C-6<br>C-10 | C-5<br>C-6<br>C-10 | I-2 | 1.08 |
| 106 (Invention) | C-5<br>C-6<br>Y-28 | C-5<br>C-6<br>Y-28 | C-5<br>C-6<br>Y-28 | I-2 | 1.17 |
| 107 (Invention) | Y-7<br>Y-43 | Y-6<br>Y-7 | Y-6<br>Y-7 | I-2 | 1.16 |
| 108 (Invention) | Y-3 | Y-28 | Y-28 | I-2 | 1.18 |
| 109 (Invention) | C-5<br>C-6<br>Y-28 | C-5<br>C-6<br>Y-28 | C-5<br>C-6<br>Y-28 | I-57 | 1.21 |
| 110 (Invention) | Y-7<br>Y-43 | Y-6<br>Y-7 | Y-6<br>Y-7 | I-57 | 1.24 |
| 111 (Invention) | Y-3 | Y-28 | Y-28 | I-57 | 1.23 |

EXAMPLE 2

Sample A is prepared in the same manner as in the preparation of Sample 201 of Example 2 of JP-A-2- 90151 except that an equimolar amount of the coupler Y-2 of the present invention is used in place of the coupler Cp-N used in the 10th layer of the sample 201 of Example 2 of JP-A-2-90151, an equimolar amount of the coupler Y- 7 of the present invention is used in place of the coupler Cp-N used in the 11th layer thereof, and further 10 mg (per $m^2$) of the compound I-2 of the present invention is added to the 2nd layer (interlayer). Sample A is tested in the same manner as in Example 1. It is found that similar results to those of Example 1 are obtained.

EXAMPLE 3

Sample B is prepared in the same manner as in the preparation of the color photographic material of Example 1 of JP-A-l-158431 except that an equimolar amount of the coupler Y-45 of the present invention is used in place of the coupler ExY-1 used in the 11th layer of the color photographic material of Example 1 of JP-A-1-158431 and further 50 mg (per $m^2$) of the compound I-10 of the present invention is added to the 5th layer. Sample B is tested in the same manner as in Example 1. It is found that favorable results similar to those of Example 1 are obtained.

EXAMPLE 4

Sample C is prepared in the same manner as in the preparation of Sample 1 of Example 1 of JP-A-2- 90145 except that an equimolar amount of the coupler Y- 28 of the present invention is used in place of the coupler ExY-1 used in the 12th layer of Sample 1 of Example 1 of JP-A-2-90145 and further 10 mg (per $m^2$) of the compound 1-57 of the present invention is added to the 5th layer (interlayer). Sample C is tested in the same manner as in Example 1. It is found that favorable results similar to those of Example 1 are obtained.

EXAMPLE 5

Sample D is prepared in the same manner as in the same manner as in the preparation of Sample 214 of Example 2 of JP-A-2-139544 except that an equimolar amount of the coupler Y-54 of the present invention is used in place of yellow coupler ExY, and further 15 mg (per $m^2$) of the compound 1-57 of the present invention is added to the 2nd layer. Sample D is tested in the same manner as in Example 1. It is found that favorable results similar to those of Example 1 are obtained.

EXAMPLE 6

Samples E, F, G, H, I, J, K, L and M are prepared in the same manner as in the preparation of Sample 107 of Example 1, except that each of the compounds I-10, I-12, I-28, I-36, I-48, I-51, I-58, I-70 and I-87 is used in place of the compound I-2. The resulting samples E to M are tested in the same manner as in Example 1. It is found that favorable results similar to those of Example 1 are obtained.

According to the present invention, silver halide color photographic materials which are excellent in sharpness and long-term storage stability can be obtained.

The object of the present invention is to provide a silver halide color photographic material which is excellent in sharpness and long-time stability.

The present invention provides a silver halide color photographic material containing a malondiamide type yellow coupler and a DIR compound.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein at least one layer of said photographic material contains at least one yellow coupler represented by the following general formulas (3) or (2):

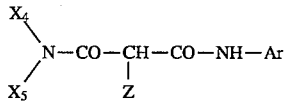

(3)

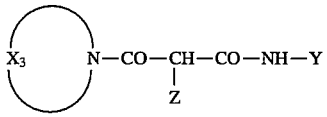

(2)

wherein $X_4$ and $X_5$ each represents an alkyl group, or an aromatic group; Ar represents a phenyl group having at least one substituent group at the ortho-position, said substituent group being selected from the group consisting of a halogen atom, an alkoxycarbonyl group, an acylamino group, a sulfonamido group, a carbamoyl group, an N-sulfonylcarbamoyl group, a sulfamoyl group, an alkoxy group, an aryloxy group, an aryloxycarbonyl group, an N-acylsulfamoyl group, a sulfonyl group, an alkoxycarbonylamino group, a cyano group, a nitro group, a carbonyl group, a hydroxyl group, a sulfo group, an alkylthio group, a ureido group, an aryl group, a heterocyclic group, an alkyl group, an acyl group, an acyloxy group, an arylthio group, a sulfamoylamino group and an N-sulfonylsulfamoyl group; $X_3$ represents an organic residue which forms a nitrogen-containing heterocyclic group together with >N—; Y represents an aryl group or a heterocyclic group; and Z represents a group which is released when the coupler of general formulas (3) or (2) reacts with the oxidation product of a developing agent; and at least one layer of said photographic material contains at least one compound represented by the following general formulas (H) , (I) or (J)

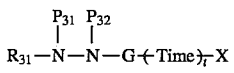

(H)

-continued

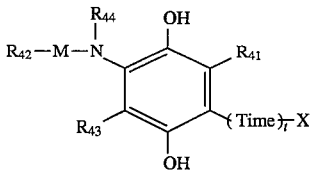

(I)

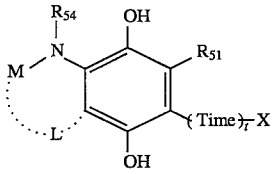

(J)

wherein $R_{31}$ represents an aryl group, a heterocyclic group, an alkyl group, an aralkyl group, an alkenyl group or an alkynyl group; $P_{31}$ and $P_{32}$ represent a hydrogen atom or a protective group which can be removed during development; Time represents a group which releases X; X represents a development inhibitor; and G represents a polarizable group; t represents 0 or 1; $R_{42}$ represents an aliphatic group, an aromatic group or a heterocyclic group; M represents

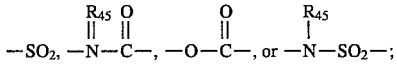

$R_{44}$, $R_{45}$, and $R_{54}$ each represents a hydrogen atom, an alkyl group or an aryl group; L represents a divalent linking group required for forming a 5- to 7-membered ring; $R_{41}$ $R_{43}$ and $R_{51}$ each represents a hydrogen atom or a group which can be attached to a hydroquinone nucleus.

2. The silver halide color photographic material of claim 1, wherein $X_4$ and $X_5$ each is a straight-chain, branched or cyclic, saturated or unsaturated, substituted or unsubstituted alkyl group having 1 to 30 carbon atoms and if substituted, the substituent groups are selected from the group consisting of a halogen atom, an alkoxycarbonyl group, an acylamino group, a sulfonamido group, a carbamoyl group, an N-sulfonylcarbamoyl group, a sulfamoyl group, an alkoxy group, an aryloxy group, an aryloxycarbonyl group, an N-acylsulfamoyl group, a sulfonyl group, an alkoxycarbonylamino group, a cyano group, a nitro group, a carboxyl group, a hydroxyl group, a sulfo group, an alkylthio group, a ureido group, an aryl group, a heterocyclic group, an alkyl group, an acyl group, an acyloxy group, an arylthio group, a sulfamoylamino group and an N-sulfonylsulfamoyl group.

3. The silver halide color photographic material of claim 1, wherein $X_4$, $X_5$ and Ar are substituted or unsubstituted aryl group having 6 to 20 carbon atoms and if substituted, the substituent groups are selected from the group consisting of a halogen atom, an alkoxycarbonyl group, an acylamino group, a sulfonamido group, a carbamoyl group, an N-sulfonylcarbamoyl group, a sulfamoyl group, an alkoxy group, an aryloxy group, an aryloxycarbonyl group, an N-acylsulfamoyl group, a sulfonyl group, an alkoxycarbonylamino group, a cyano group, a nitro group, a carboxyl group, a hydroxyl group, a sulfo group, an alkylthio group, a ureido group, an aryl group, a heterocyclic group, an alkyl group, an acyl group, an acyloxy group, an arylthio group, a sulfamoylamino group and an N-sulfonylsulfamoyl group.

4. The silver halide color photographic material of claim 1, wherein the nitrogen-containing heterocyclic group represented by $X_3$ together with >N— is a 3- to 12-membered, substituted or unsubstituted, saturated or unsaturated, monocyclic or condensed ring heterocyclic group having 1 to 20 carbon atoms and if substituted, the substituent groups are selected from the group consisting of a halogen atom, an alkoxycarbonyl group, an acylamino group, a sulfonamido group, a carbamoyl group, an N-sulfonylcarbamoyl group, a sulfamoyl group, an alkoxy group, an aryloxy group, an aryloxycarbonyl group, an N-acylsulfamoyl group, a sulfonyl group, an alkoxycarbonylamino group, a cyano group, a nitro group, a carboxyl group, a hydroxyl group, a sulfo group, an alkylthio group, a ureido group, an aryl group, a heterocyclic group, an alkyl group, an acyl group, an acyloxy group, an arylthio group, a sulfamoylamino group and an N-sulfonylsulfamoyl group.

5. The silver halide color photographic material of claim 1, wherein when $X_4$ and $X_5$ each represents a substituted alkyl group, or a substituted aryl group, when $X_3$ represents substituted nitrogen-containing heterocyclic group together with >N—, the substituent groups are selected from the group consisting of an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group and an aryl group.

6. The silver halide color photographic material of claim 1, where Ar and Y are a substituted aryl group and the substituent is selected from the group consisting of a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, an alkyl group, a nitro group and an aryl group.

7. The silver halide color photographic material of claim 1, wherein Y is a phenyl group having at least one substituent group at the ortho-position.

8. The silver halide color photographic material of claim 1, wherein the couplers of general formula (2) are represented by the following formula (4) or (5);

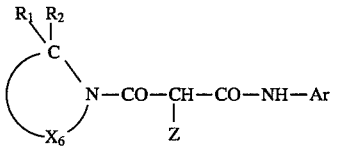

(4)

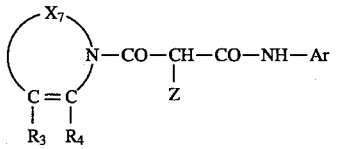

(5)

wherein Z is as defined in general formula (1); $X_4$ and $X_5$ each represents an alkyl group or an aromatic group; Ar represents a phenyl group having at least one substituent group at the orthoposition; $X_6$ represents an organic residue which forms a nitrogen-containing heterocyclic group (monocyclic or condensed ring) together with —C($R_1R_2$)—N<; $X_7$ represents an organic residue which forms a nitrogen-containing heterocyclic group (monocyclic or condensed ring) together with —C($R_3$)=C($R_4$)—N<; and $R_1$, $R_2$, $R_3$ and $R_4$ each represents a hydrogen atom or a substituent group.

9. The silver halide color photographic material of claim 1, wherein the couplers of general formulae (2) and (3) are nondiffusible type couplers.

10. The silver halide color photographic material of claim 1, wherein G represents an acid group.

11. The silver halide color photographic material of claim 1, wherein the group represented by $-(\text{Time})_t X$ in general formula (H), (I) or (J) is a group which is released as $-(\text{Time})_t X$ only when the redox mother nucleus represented by A undergoes a cross oxidation reaction during development to form an oxidation product.

12. The silver halide color photographic material of claim 1, wherein Time is bonded to G through a sulfur atom, a nitrogen atom, an oxygen atom or a selenium atom.

13. The silver halide color photographic material of claim 1, wherein Time is represented by the following general formulae:

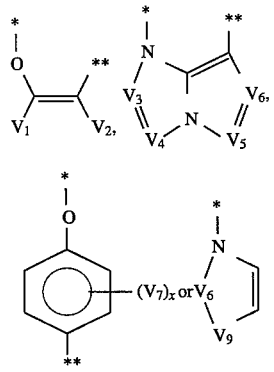

wherein $V_1$ and $V_2$ each represents a substituent group; $V_3$, $V_4$, $V_5$ and $V_6$ each represents a nitrogen atom or a methine group; $V_7$ represents a substituent group; x represents an integer of 0 to 4 and when x is two or greater, two or more $V_7$ groups may be the same or different, or two $V_7$ groups may be combined together to form a ring structure; $V_8$ represents a —CO— group, an —$SO_2$— group, an oxygen atom or an imino group; $V_9$ represents a non-metallic atomic group for forming a 5- to 7-membered ring; and $V_{10}$ represents a hydrogen atom or a substituent group wherein the substituents represented by $V_1$, $V_2$, $V_7$ and $V_{10}$ are selected from the group consisting of an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, and a heterocyclic residue.

14. The silver halide color photographic material of claim 1, wherein the group represented by Time is a redox group, Time is a group represented by the following general formula:

$$*—P—(Y=Z)_k—Q—B$$

wherein P and Q represent independently an oxygen atom or an imino group which may be substituted with a sulfonyl or an acyl group; at least one or more of the Y and Z groups represents a methine group having at least one substituent group X, and the other Y and Z each represents a methine group, which may be substituted by X, or a nitrogen atom; k represents an integer of 1 to 3 and one or more Y and Z groups may be the same or different; and B represents a hydrogen atom or a group which is released by an alkali and the substituent groups of any two of P, Y, Z, Q and B are each a divalent group and are combined together to form a ring structure.

15. The silver halide color photographic material of claim 14, wherein the redox groups represented by *—P—(Y=Z)$_k$—Q—B are represented by the following formulae:

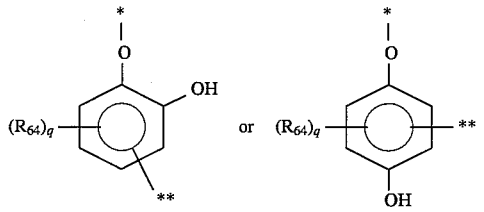

wherein the mark * represents a position where the group is bonded to G in general formulas (H), (I) or (J); the mark ** represents a position where the group is bonded to X; $R_{64}$ represents a substituent group; and q represents an integer of 0 to 3, and when q is 2 or greater, two or more $R_{64}$ groups may be the same or different, and two $R_{64}$ groups on neighboring carbon atoms are each a divalent group and may be combined together to form a ring structure.

16. The silver halide color photographic material of claim 1, wherein X is a mercapto group attached to a heterocyclic ring represented by the following formula (X') or is a heterocyclic compound capable of forming imino silver represented by the following general formula (X"):

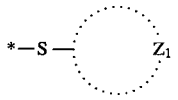

(X')

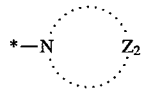

(X")

wherein $Z_1$ represents a non-metallic atomic group required for forming a monocyclic or condensed ring heterocyclic ring; and $Z_2$ represents a non-metallic atomic group required for forming a monocyclic or condensed ring heterocyclic ring together with N; and the mark * represents a position where the group is bonded to Time.

17. The silver halide color photographic material of claim 16, wherein the heterocyclic ring represented by $Z_1$ is selected from the group consisting of azoles, azaindenes and azines.

18. The silver halide color photographic material of claim 16, wherein the heterocyclic ring represented by $Z_2$ is selected from the group consisting of triazoles, indazole, benzimidazole, azaindenes and tetrazole.

19. The silver halide color photographic material of claim 1, wherein said compound is represented by the following general formula (H):

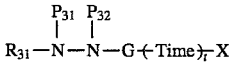

(H)

wherein $R_{31}$, $P_{31}$, $P_{32}$, Time, X and t are as defined above.

20. The silver halide color photographic material of claim 1, wherein said at least one compound of general formulas (H), (I) or (J) are present in an amount of 0.001 to 0.2 mmol/$m^2$.

21. The silver halide color photographic material of claim 1, wherein said at least one yellow coupler of general formulae (2) and (3) are present in an amount of 1.0 to $1.0\times10^{-3}$ mol, per mol of silver halide.

22. The silver halide color photographic material of claim 1, wherein said material is a reversal material.

23. The silver halide color photographic material of claim 1, wherein said compound is represented by the following general formula (I):

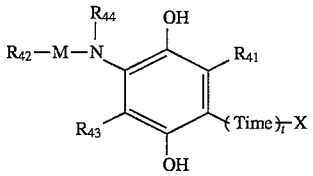

(I)

wherein the substituents are as defined above.

24. The silver halide color photographic material of claim 1, wherein said compound is represented by the following general formula (J):

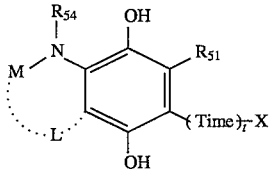

(J)

wherein the substituents are as defined above.

25. The silver halide color photographic material according to claim 16, wherein said heterocyclic rings of formulas (X') and (X") may have one or more substituent groups selected from the group consisting of an $R_{77}$ group, an $R_{78}O$— group an $R_{77}S$-group, an $R_{77}OCO$— group, an $R_{77}OSO_2$—]group, a halogen, a cyano group, a nitro group, an $R_{77}SO_2$— group, an $R_{78}CO$— group, an $R_{77}COO$— group,

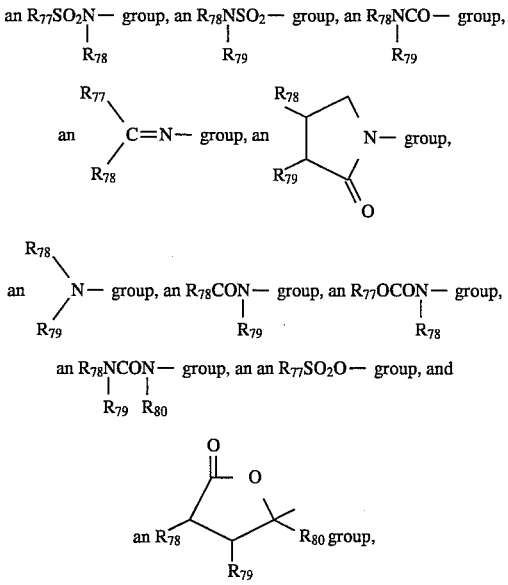

wherein $R_{77}$ represents an aliphatic group, an aromatic group or a heterocyclic group; and $R_{78}$, $R_{79}$, and $R_{80}$ each represents an aliphatic group, an aromatic group, a heterocyclic group or a hydrogen atom.

* * * * *